US010294719B2

(12) United States Patent
Yamagishi et al.

(10) Patent No.: US 10,294,719 B2
(45) Date of Patent: May 21, 2019

(54) SHIELDING APPARATUS

(71) Applicant: TACHIKAWA CORPORATION, Tokyo (JP)

(72) Inventors: Kazuto Yamagishi, Tokyo (JP); Masaya Yamaguchi, Tokyo (JP); Tsubasa Asaka, Tokyo (JP); Takenobu Ebato, Tokyo (JP)

(73) Assignee: TACHIKAWA CORPORATION, Tokyo (JP)

( * ) Notice: Subject to any disclaimer, the term of this patent is extended or adjusted under 35 U.S.C. 154(b) by 354 days.

(21) Appl. No.: 15/326,064

(22) PCT Filed: Jul. 6, 2015

(86) PCT No.: PCT/JP2015/069450
§ 371 (c)(1),
(2) Date: May 19, 2017

(87) PCT Pub. No.: WO2016/009881
PCT Pub. Date: Jan. 21, 2016

(65) Prior Publication Data

US 2017/0298691 A1 Oct. 19, 2017

(30) Foreign Application Priority Data

Jul. 14, 2014 (JP) ..... 2014-144524
Dec. 5, 2014 (JP) ..... 2014-246823
Feb. 5, 2015 (JP) ..... 2015-021647

(51) Int. Cl.
*E06B 9/322* (2006.01)
*E06B 9/80* (2006.01)
(Continued)

(52) U.S. Cl.
CPC ..... *E06B 9/80* (2013.01); *E06B 9/26* (2013.01); *E06B 9/304* (2013.01); *E06B 9/322* (2013.01);
(Continued)

(58) Field of Classification Search
CPC ..... E06B 9/304; E06B 9/322; E06B 9/388; E06B 9/42; E06B 9/581; E06B 9/582;
(Continued)

(56) References Cited

U.S. PATENT DOCUMENTS 4,011,929 A * 3/1977 Jeram ..... F16F 7/01 188/268
4,535,829 A * 8/1985 Fukuchi ..... E06B 9/60 160/291
(Continued)

FOREIGN PATENT DOCUMENTS

DE 202006006067 * 4/2006 ..... E05B 65/20
JP 08303514 * 4/1995 ..... F16F 9/14
(Continued)

OTHER PUBLICATIONS

International Search Report dated Sep. 15, 2015 from corresponding International Application No. PCT/JP2015/069450; 2 pg.

*Primary Examiner* — Beth A Stephan
(74) *Attorney, Agent, or Firm* — Maier & Maier, PLLC

(57) ABSTRACT

A shielding device for opening and closing a shielding member by rotation of a winding shaft, the shielding device including a speed controller configured to control an automatic movement speed of the shielding member, wherein the speed controller includes: a housing containing a viscous fluid; and a moving member contained in the housing and configured to move by rotation of the winding shaft, and the speed controller is configured so that resistance the moving
(Continued)

SECOND EMBODIMENT member receives from the viscous fluid varies with movement of the moving member, is provided.

18 Claims, 41 Drawing Sheets

(51) Int. Cl.

| | |
|---|---|
| ***E06B 9/304*** | (2006.01) |
| ***E06B 9/388*** | (2006.01) |
| ***E06B 9/58*** | (2006.01) |
| ***E06B 9/26*** | (2006.01) |
| ***E06B 9/42*** | (2006.01) |
| *E06B 9/68* | (2006.01) |
| *E06B 9/72* | (2006.01) |
| *E06B 9/262* | (2006.01) |

(52) U.S. Cl.
CPC ..... *E06B 9/388* (2013.01); *E06B 9/42* (2013.01); *E06B 9/581* (2013.01); *E06B 9/582* (2013.01); *E06B 2009/2625* (2013.01); *E06B 2009/6809* (2013.01); *E06B 2009/725* (2013.01); *E06B 2009/808* (2013.01)

(58) Field of Classification Search
CPC ..... E06B 9/80; E06B 9/26; E06B 2009/2625; E06B 2009/6809; E06B 2009/725; E06B 2009/808; F16D 57/007; F16D 57/02
See application file for complete search history.

(56) References Cited

U.S. PATENT DOCUMENTS

| | | | | |
|---|---|---|---|---|
| 5,634,507 | A * | 6/1997 | Kwoka | E06B 9/74 160/296 |
| 6,155,328 | A * | 12/2000 | Welfonder | E06B 9/42 160/296 |
| 6,591,890 | B1 * | 7/2003 | Grubb | E06B 9/80 160/291 |
| 6,854,503 | B2 * | 2/2005 | Cross | E06B 9/322 160/168.1 R |
| 7,086,441 | B2 * | 8/2006 | Barriault | E05D 13/003 160/296 |
| 7,360,736 | B2 * | 4/2008 | Zangirolami | E06B 9/54 160/296 |
| 8,146,852 | B2 * | 4/2012 | Biller | B60R 22/4676 242/381 |
| 2002/0179258 | A1 * | 12/2002 | Welfonder | E06B 9/42 160/313 |
| 2003/0075845 | A1 | 4/2003 | Krammer | |
| 2004/0261958 | A1 | 12/2004 | Sugiyama et al. | |
| 2005/0284589 | A1 * | 12/2005 | Dickinson, III | E06B 9/80 160/296 |
| 2009/0139057 | A1 | 6/2009 | Honda et al. | |
| 2013/0152478 | A1 * | 6/2013 | Lhotak | E06B 9/70 49/358 |
| 2015/0285000 | A1 * | 10/2015 | Liu | E06B 9/80 242/396 |

FOREIGN PATENT DOCUMENTS

| | | | |
|---|---|---|---|
| JP | H07-324572 | A | 12/1995 |
| JP | H09-256729 | A | 9/1997 |
| JP | H11-270257 | A | 10/1999 |
| JP | 2000-027570 | A | 1/2000 |
| JP | 2004-518923 | A | 6/2004 |
| JP | 2005-232841 | A | 9/2005 |
| JP | 2007-063884 | A | 3/2007 |

* cited by examiner

FIRST EMBODIMENT

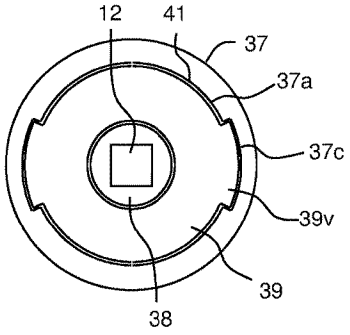
Fig.3C
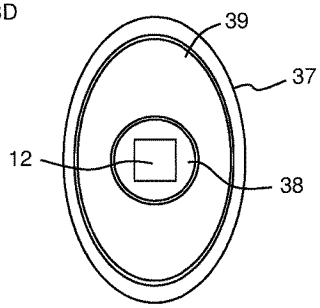
Fig.3D
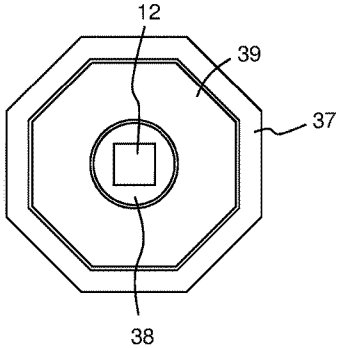
Fig.3E
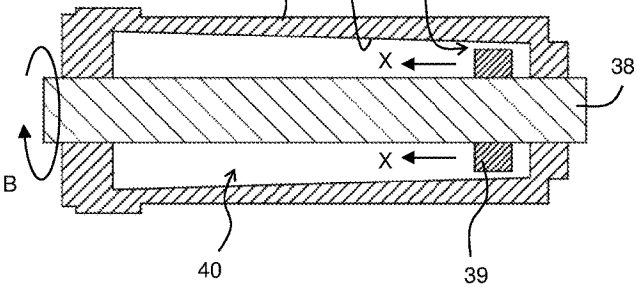
Fig.3A FIRST EMBODIMENT WHEN BOTTOM RAIL STARTS TO DESCEND
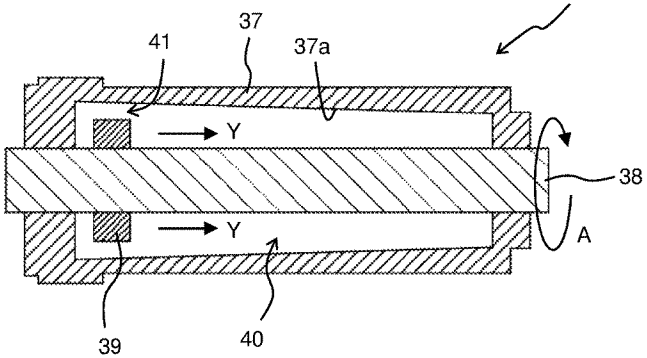
Fig.3B IMMEDIATELY BEFORE DESCENT OF BOTTOM RAIL IS COMPLETE

FIRST EMBODIMENT

SECOND EMBODIMENT

DURING SELF-WEIGHT
DESCENT OF BOTTOM RAIL

DURING ASCENT
OPERATION OF BOTTOM RAIL

THIRD EMBODIMENT
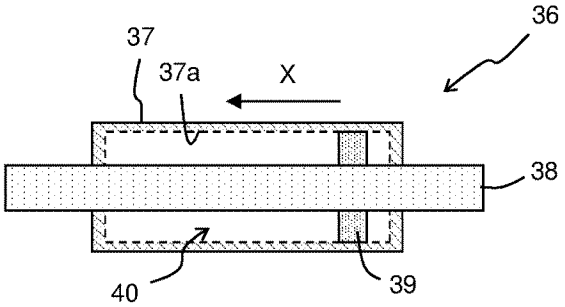
Fig. 6A
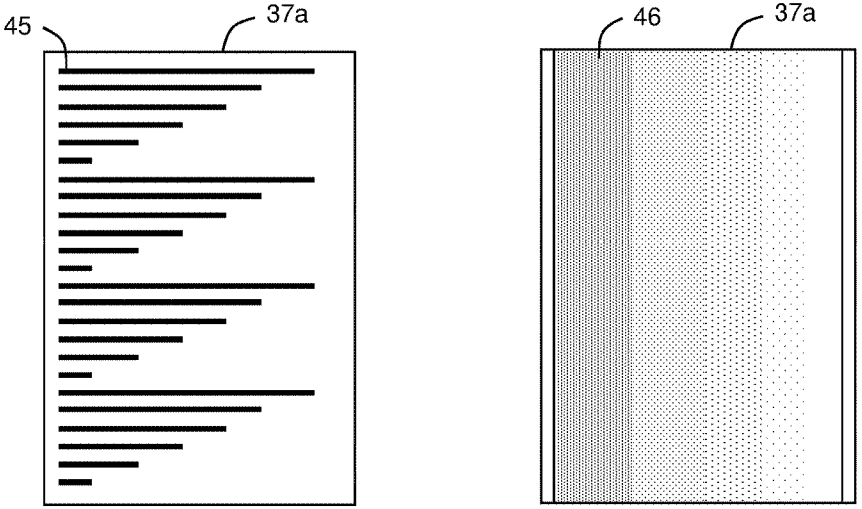
Fig. 6B
EXAMPLE CONFIGURATION1
NUMBER OF GROOVES CHANGES
Fig. 6C
EXAMPLE CONFIGURATION2
NUMBER OF RECESSES CHANGES
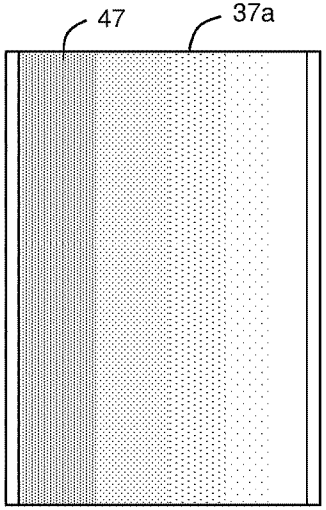
Fig. 6D
EXAMPLE CONFIGURATION3
ELASTIC MODULUS CHANGES

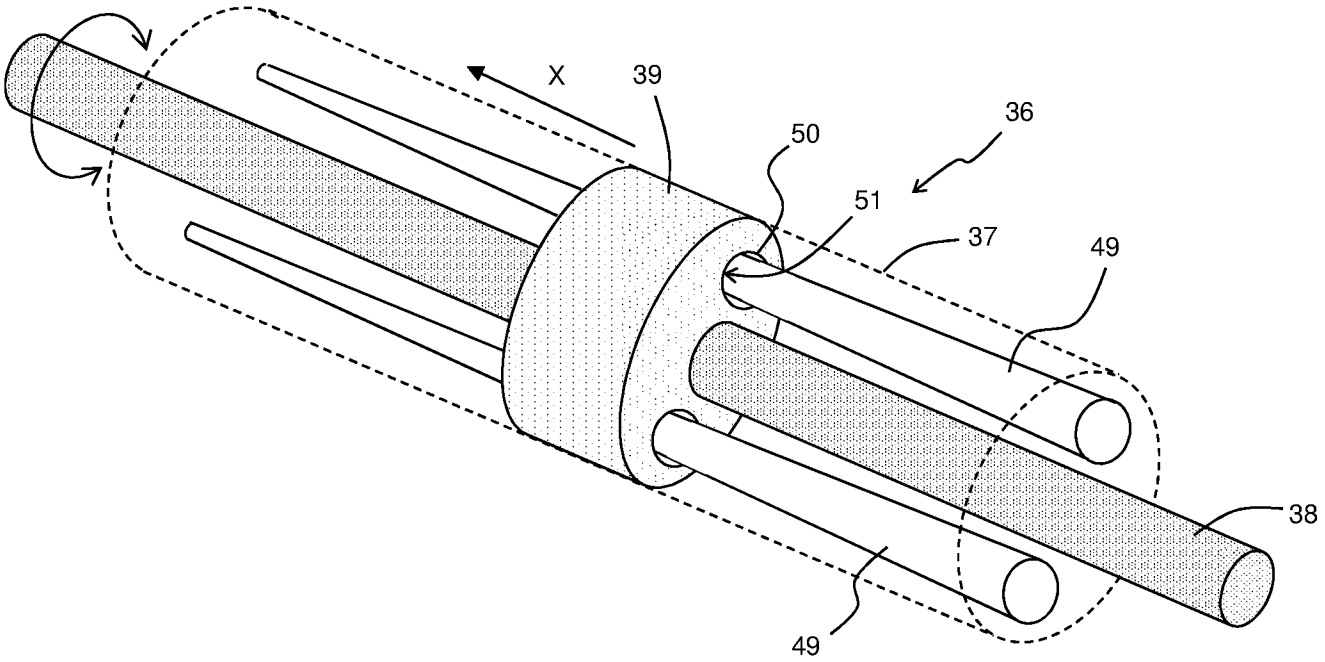
Fig. 7 FOURTH EMBODIMENT

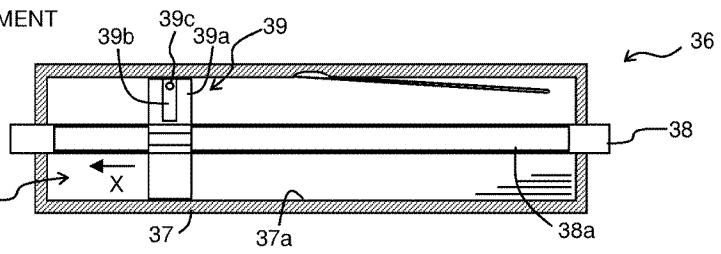
Fig. 8A
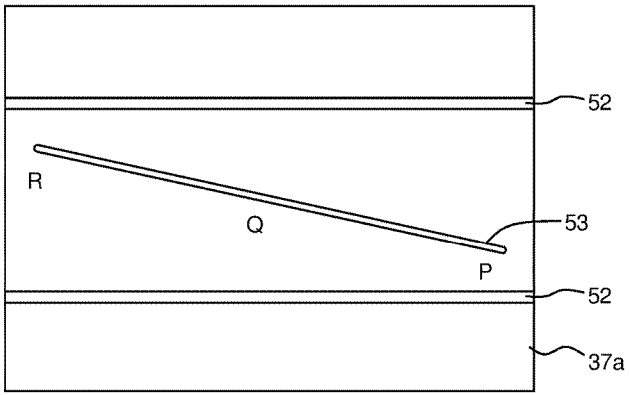
Fig. 8B
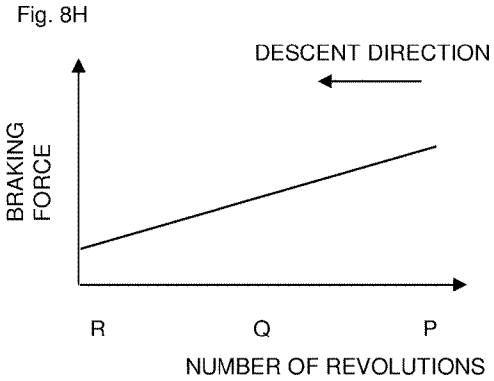
Fig. 8H
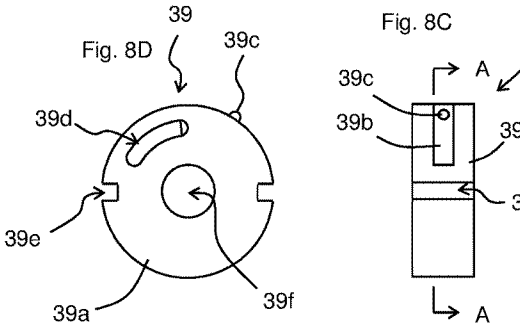
Fig. 8D
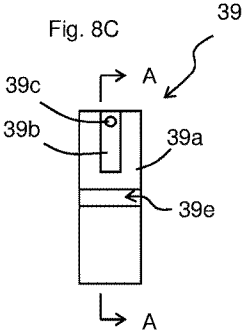
Fig. 8C
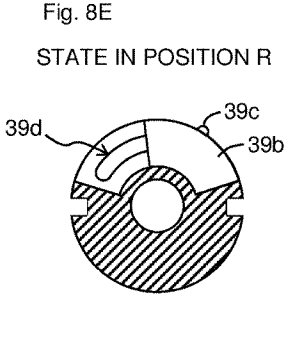
Fig. 8E STATE IN POSITION R
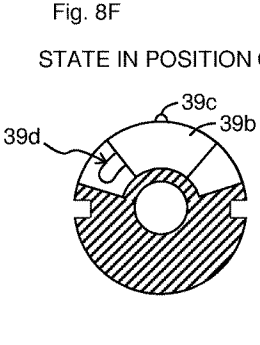
Fig. 8F STATE IN POSITION Q
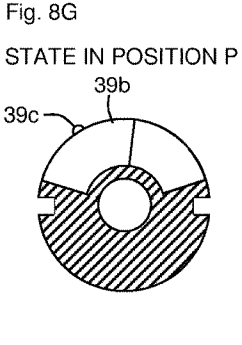
Fig. 8G STATE IN POSITION P

SIXTH EMBODIMENT

STATE IN POSITION R

STATE IN POSITION P

SEVENTH EMBODIMENT

EIGHTH EMBODIMENT

A-A SECTIONAL VIEW

B-B SECTIONAL VIEW

C-C SECTIONAL VIEW

D-D SECTIONAL VIEW 36
12
37e
37d
37f
37
38a
38
39
39e
40
X
A
B
C
D
52
U
T
S

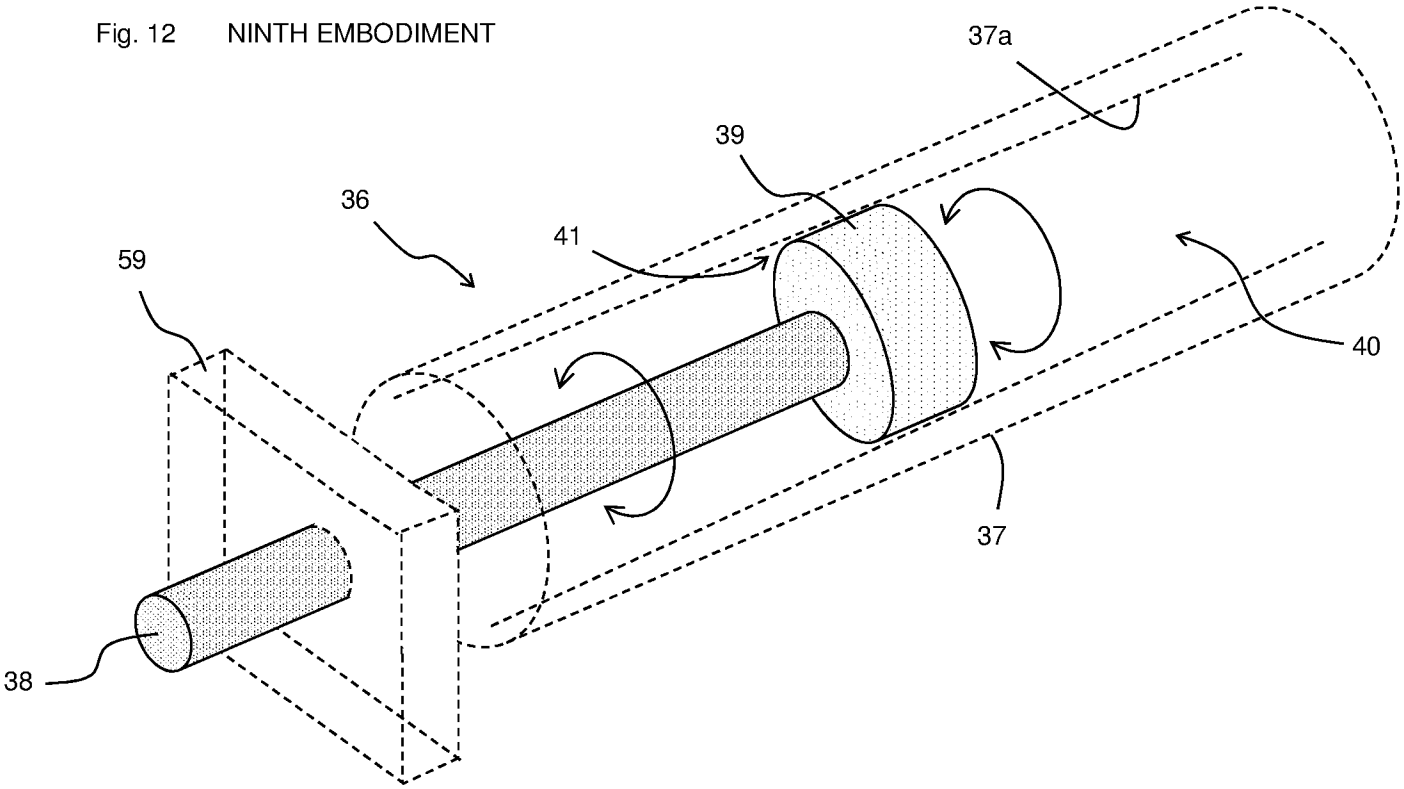
Fig. 12 NINTH EMBODIMENT

TENTH EMBODIMENT

ELEVENTH EMBODIMENT

TWELFTH EMBODIMENT

THIRTEENTH EMBODIMENT

A-A SECTIONAL VIEW

B-B SECTIONAL VIEW

C-C SECTIONAL VIEW
Dig.16E
D-D SECTIONAL VIEW

E-E SECTIONAL VIEW

F-F SECTIONAL VIEW
R
A
B
C
D
E
F
X
12
36
37
37d
37e
37f
38
38a
38c
38d
39
39e
40
52
62
62a

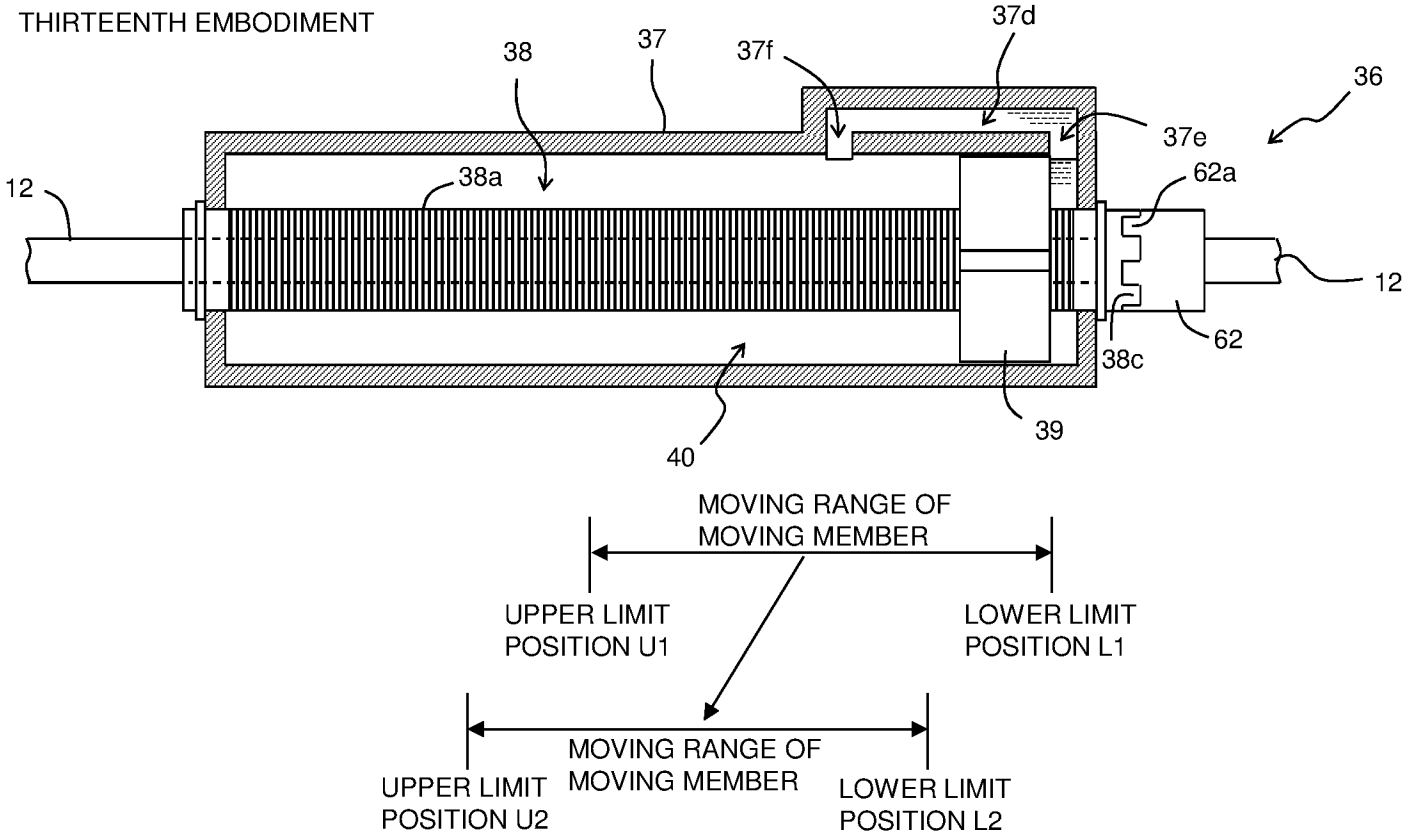
Fig. 17 THIRTEENTH EMBODIMENT

FOURTEENTH EMBODIMENT
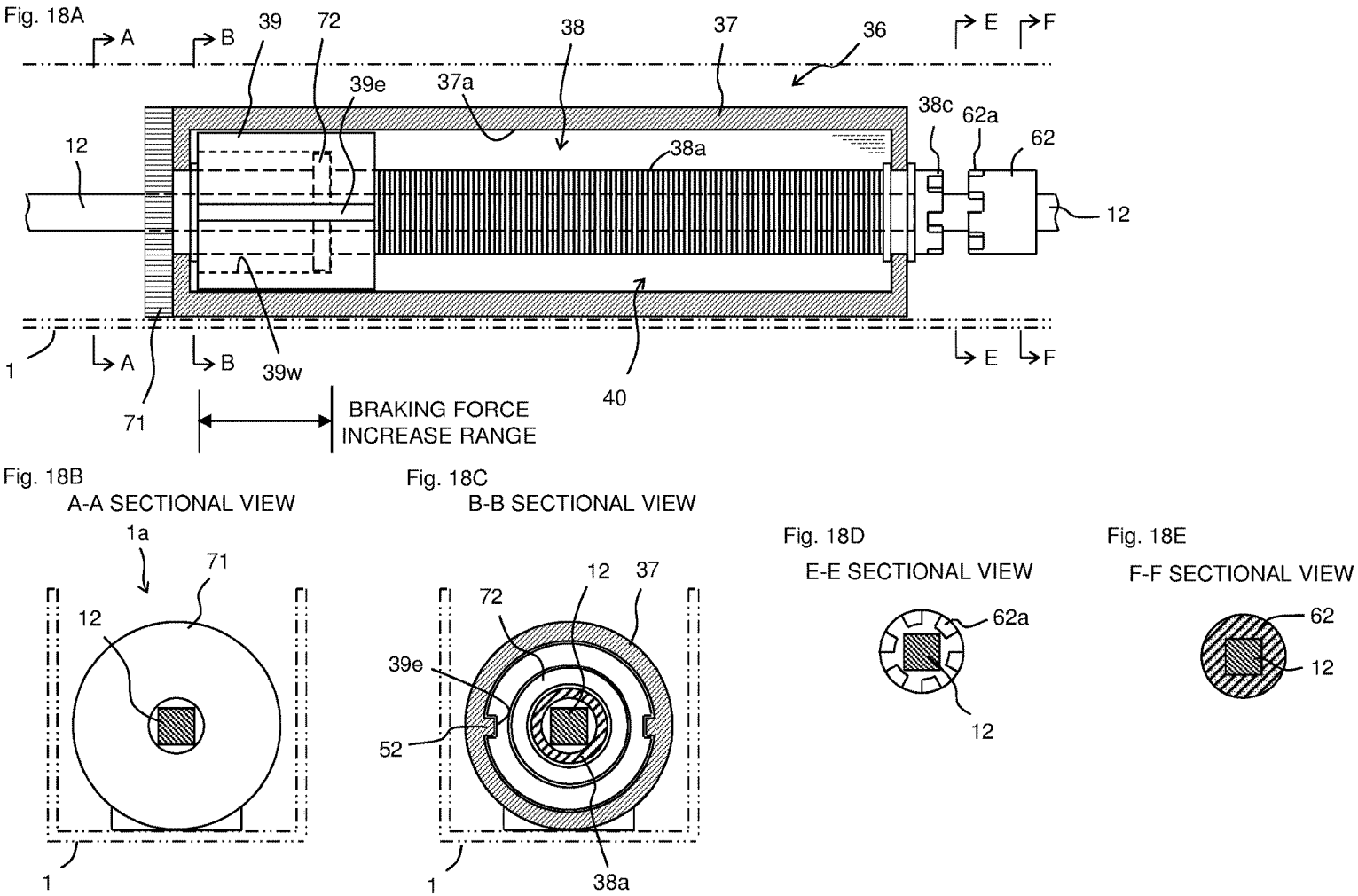

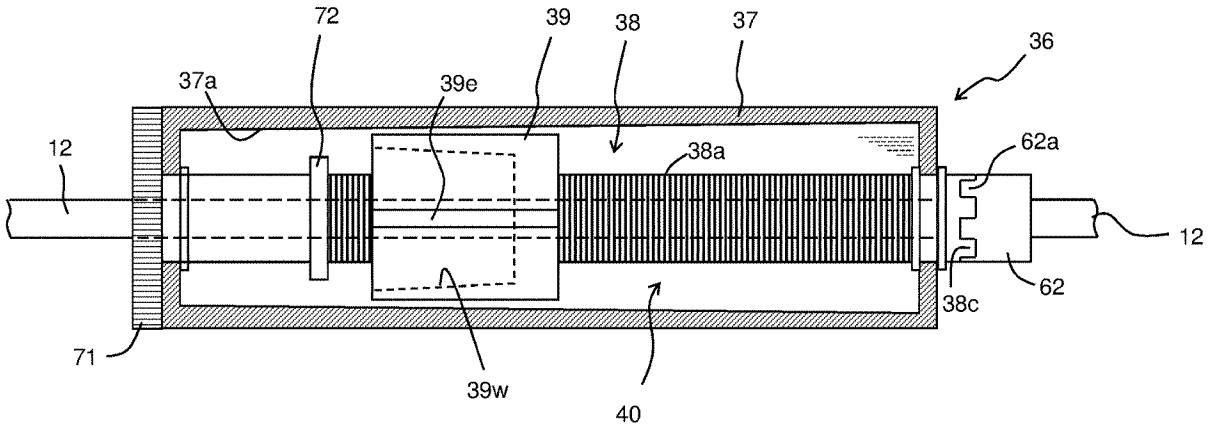
Fig. 20 MODIFICATION 1 OF FOURTEENTH EMBODIMENT
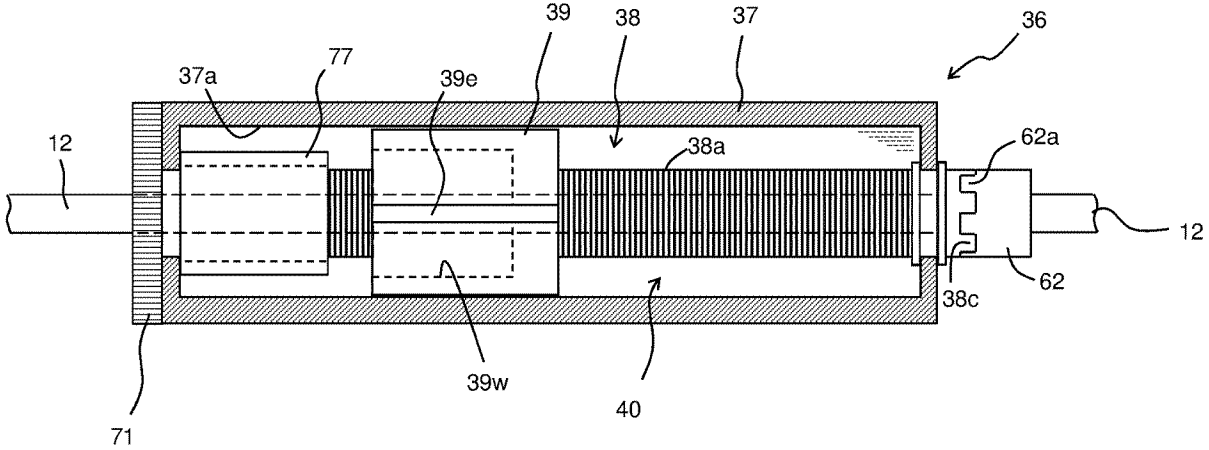
Fig. 21 MODIFICATION 2 OF FOURTEENTH EMBODIMENT

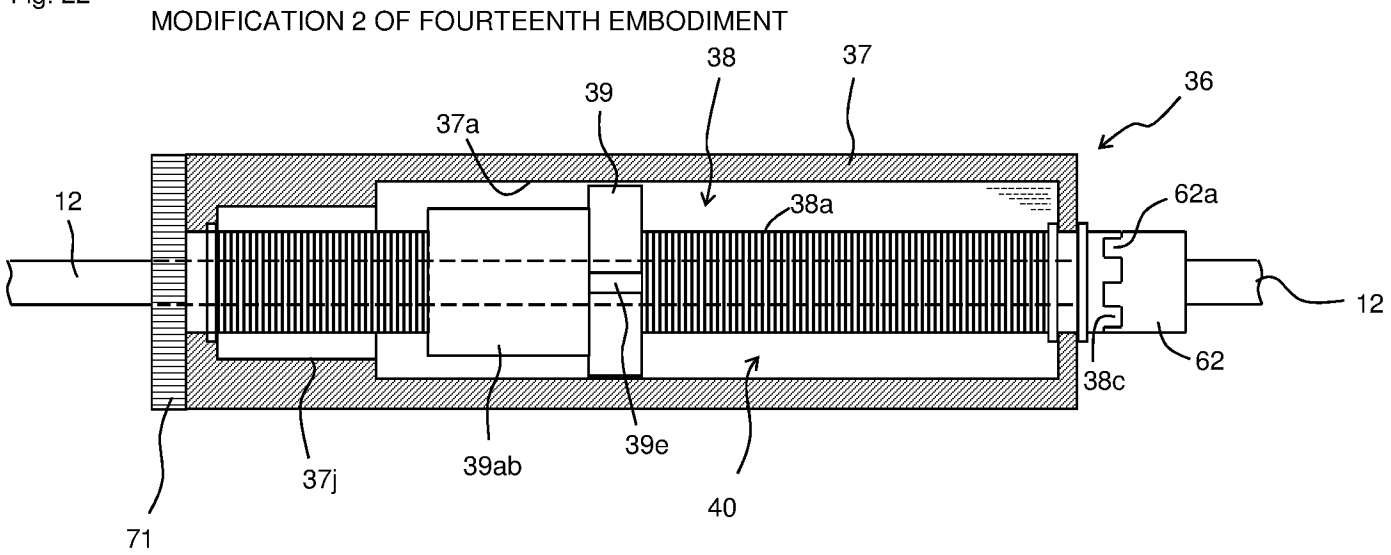
Fig. 22 MODIFICATION 2 OF FOURTEENTH EMBODIMENT

MODIFICATION 1 OF FIFTEENTH EMBODIMENT

Fig. 23B A-A SECTIONAL VIEW
Fig. 23C B-B SECTIONAL VIEW
Fig. 23D C-C SECTIONAL VIEW
BRAKING FORCE INCREASE RANGE
SCREW
X
36
12
74
74a
74b
74c
39z
39x
39y
37
37a
37g
37h
37i
38
39
40a
40b
41
A
B
C

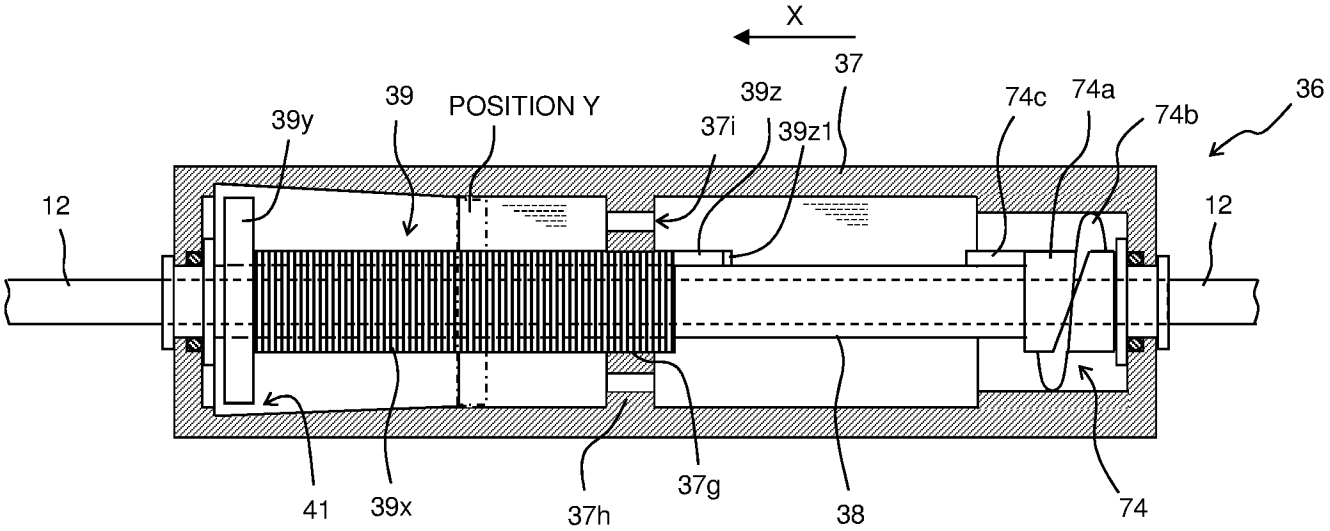
Fig. 24 FIFTEENTH EMBODIMENT

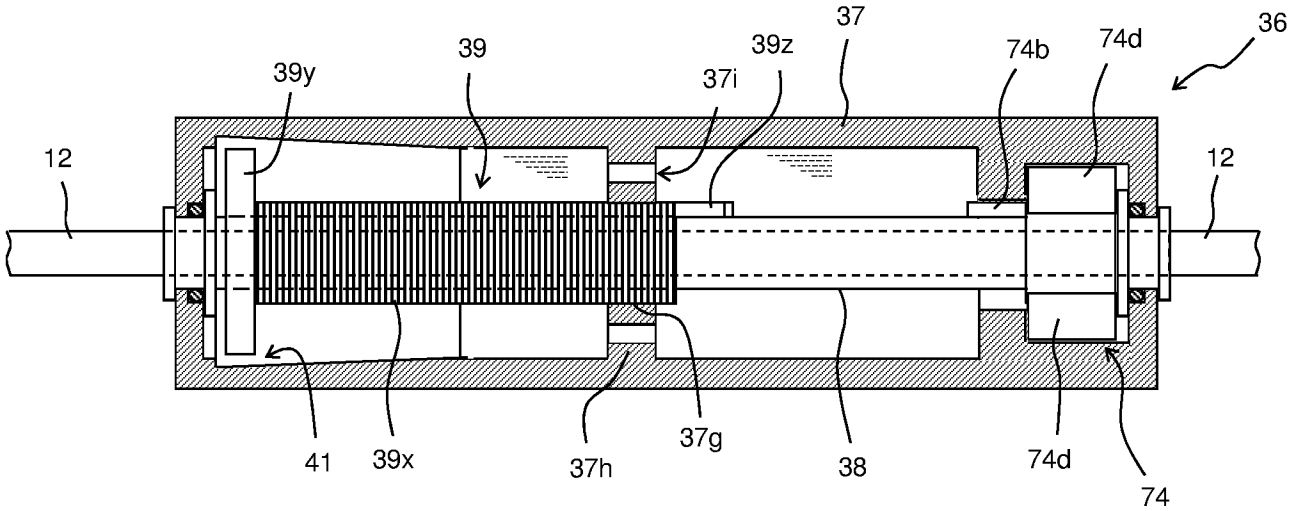
Fig. 25 MODIFICATION 1 OF FIFTEENTH EMBODIMENT

SIXTEENTH EMBODIMENT

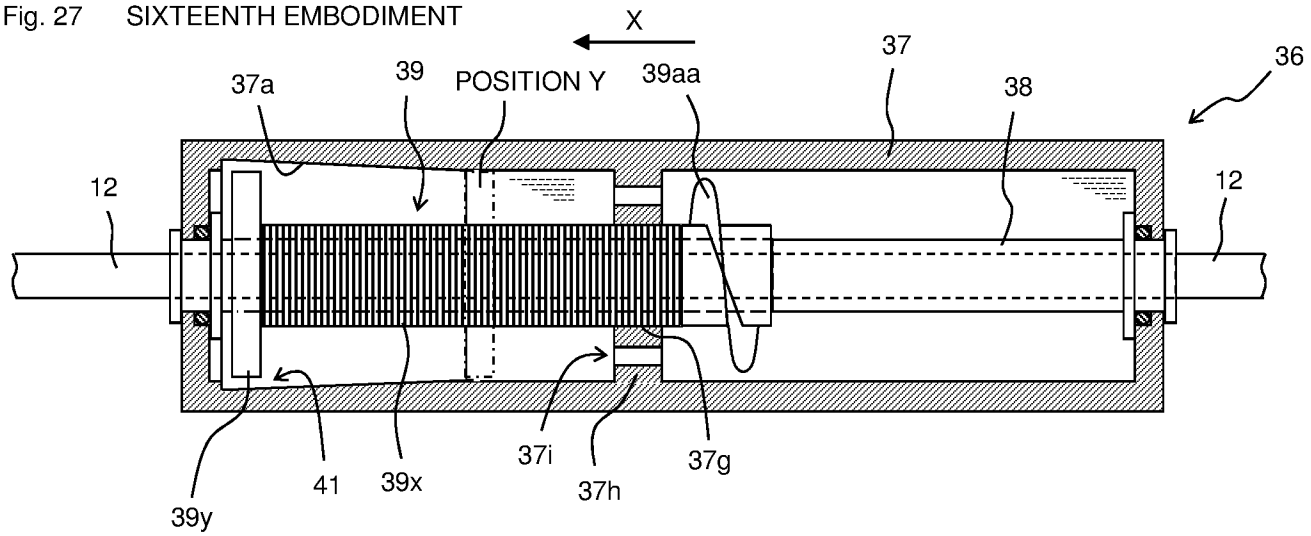
Fig. 27 SIXTEENTH EMBODIMENT

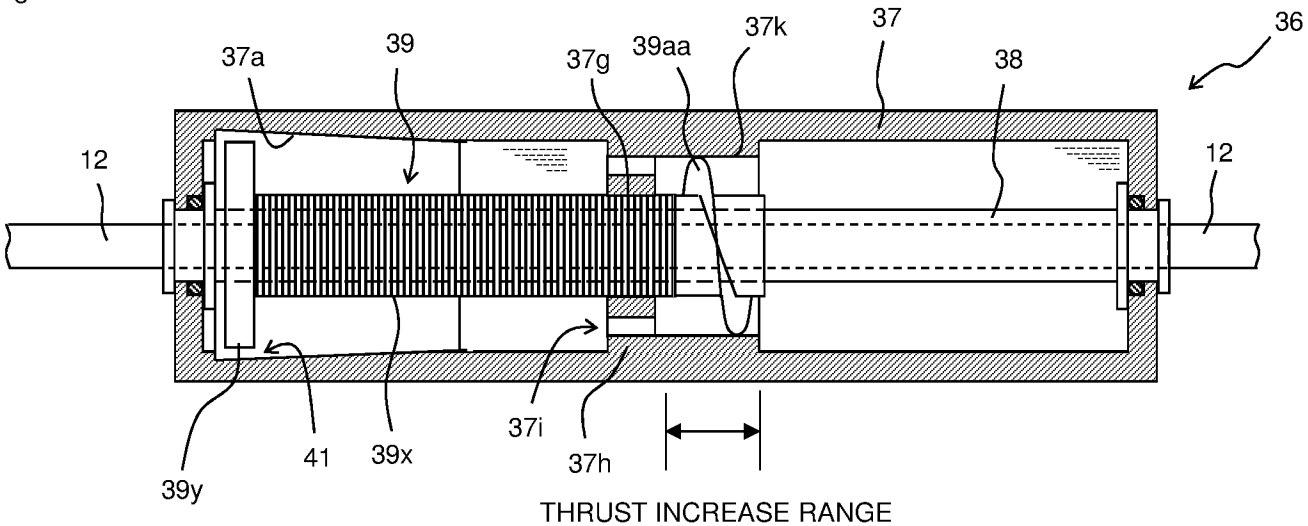
Fig. 28 MODIFICATION 1 OF SIXTEENTH EMBODIMENT

Fig. 29A SEVENTEENTH EMBODIMENT

Fig. 29B A-A SECTIONAL VIEW

Fig. 29C B-B SECTIONAL VIEW

EIGHTEENTH EMBODIMENT

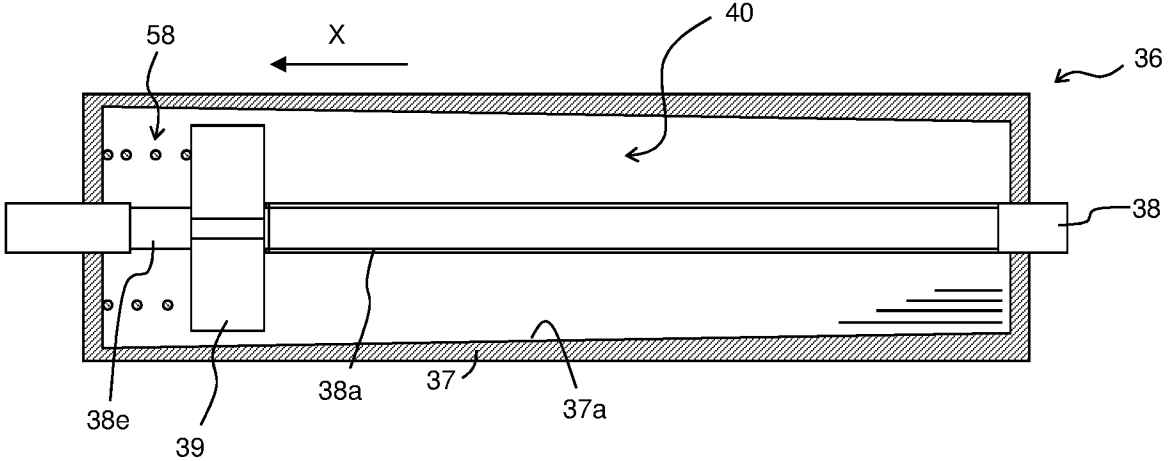
Fig. 31 NINETEENTH EMBODIMENT

NINETEENTH EMBODIMENT

NINETEENTH EMBODIMENT

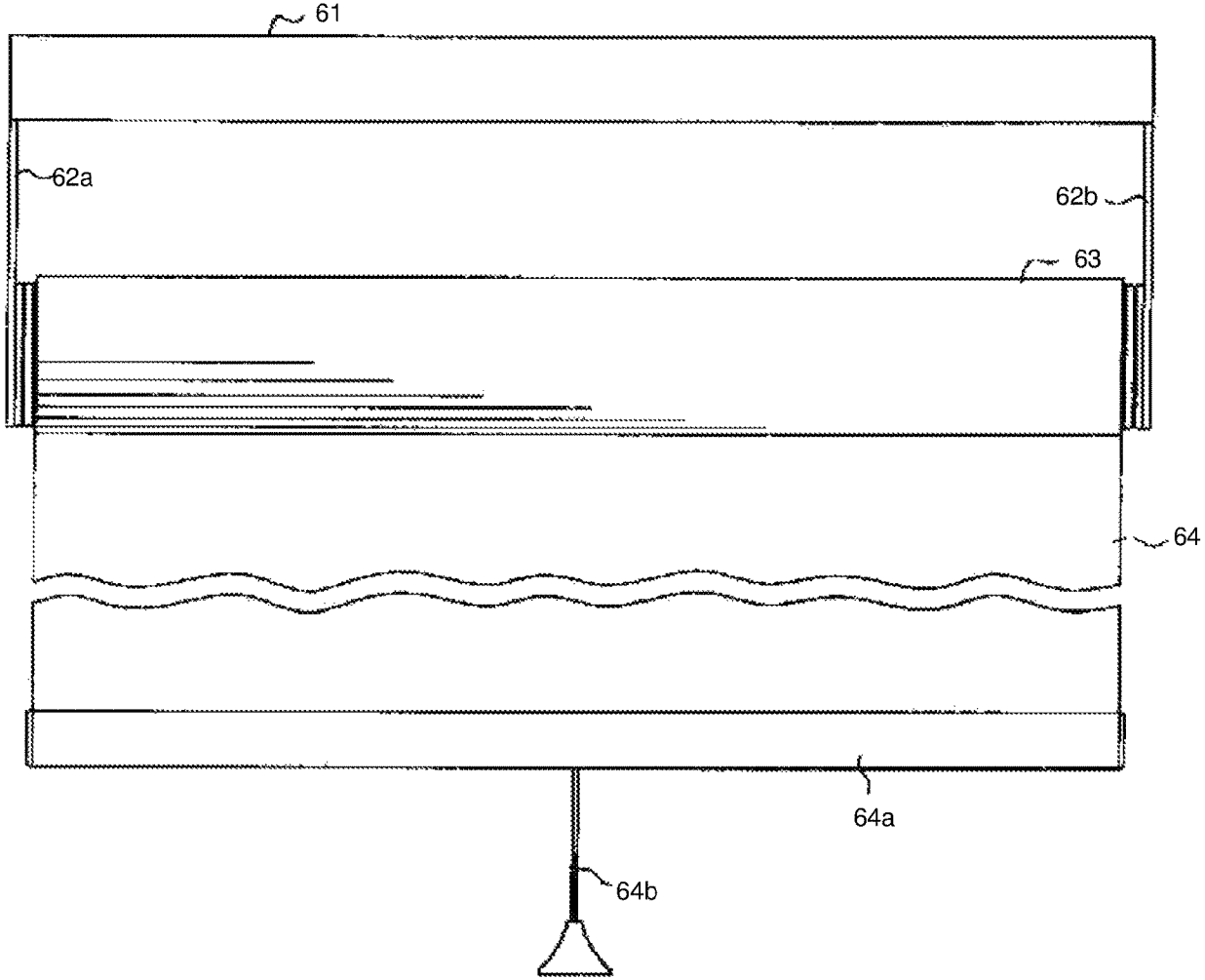
Fig. 34 TWENTIETH EMBODIMENT

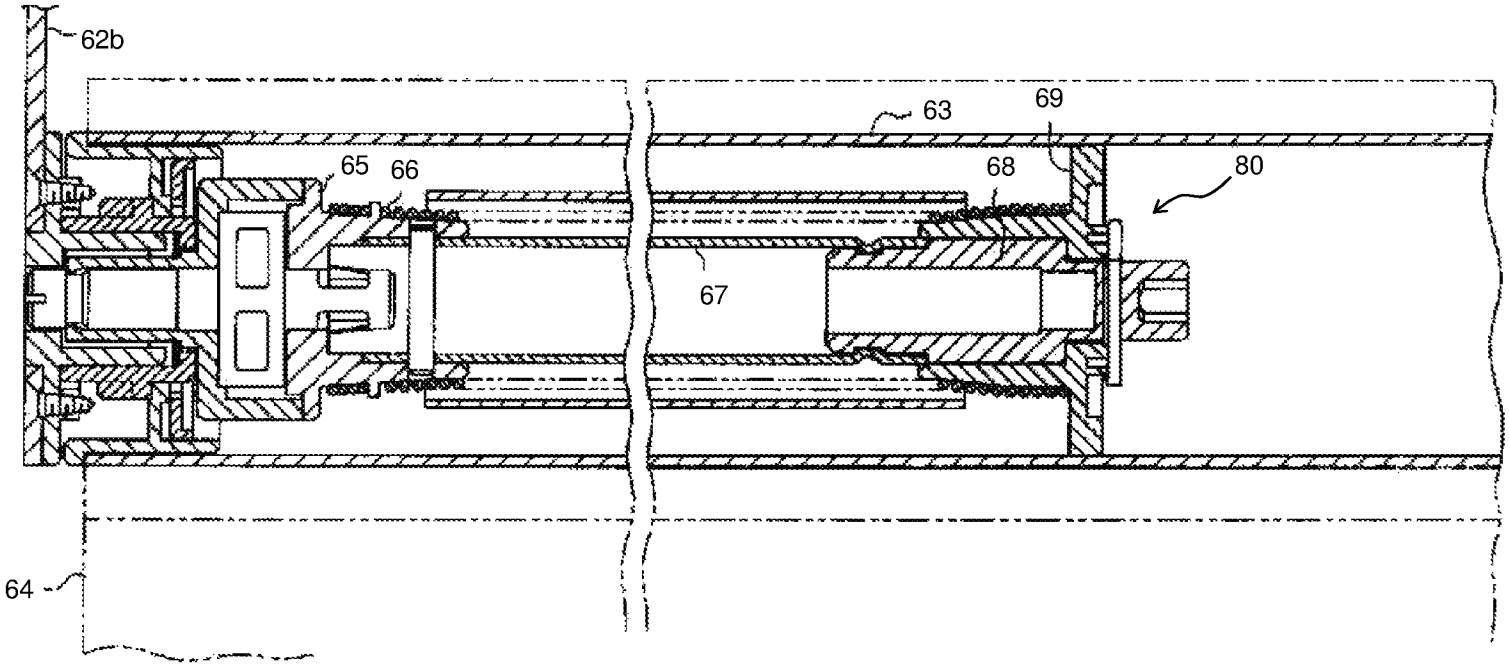
Fig. 35 TWENTIETH EMBODIMENT

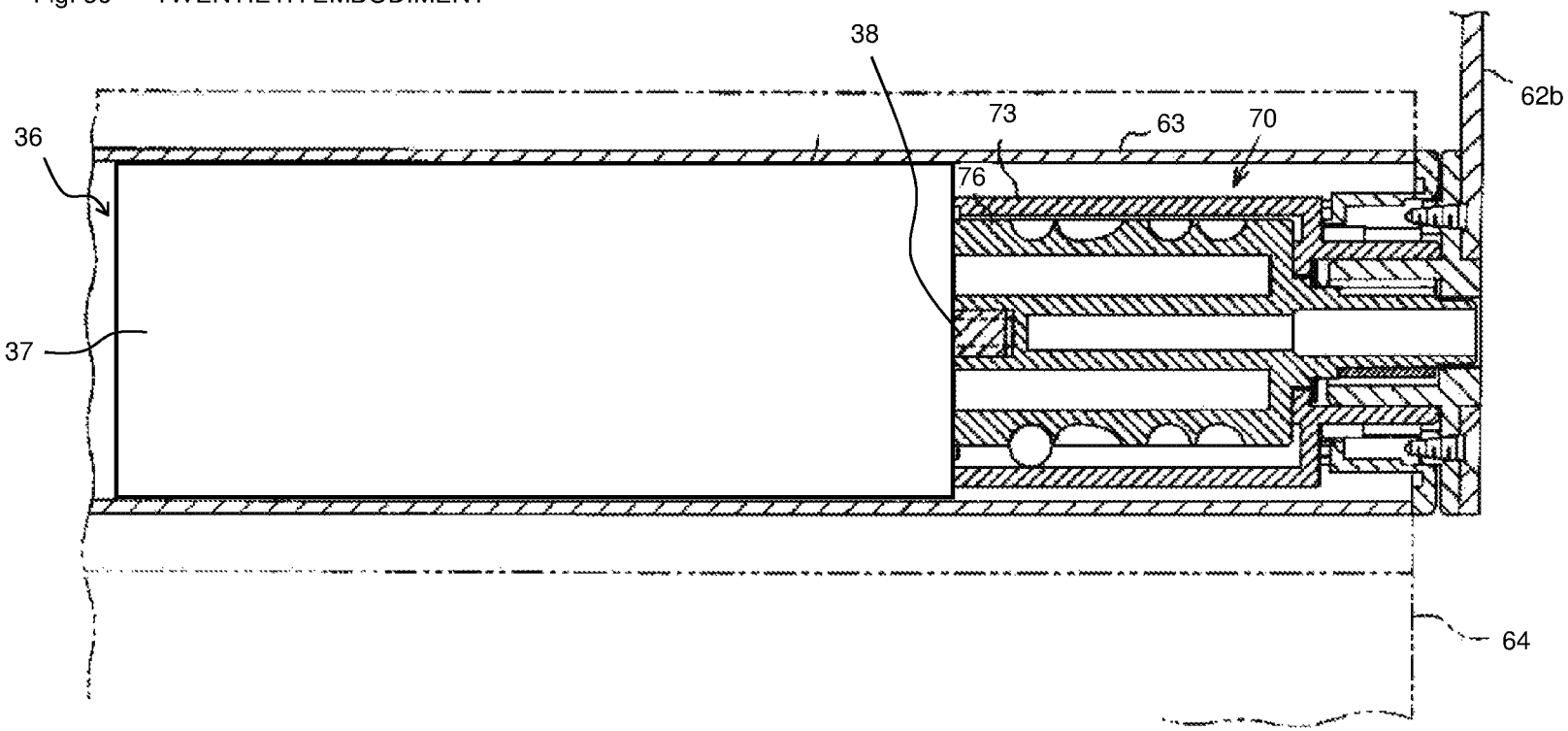
Fig. 36 TWENTIETH EMBODIMENT

TWENTIETH EMBODIMENT

TWENTIETH EMBODIMENT
Fig. 38A WHEN WEIGHT BAR STARTS TO ASCEND
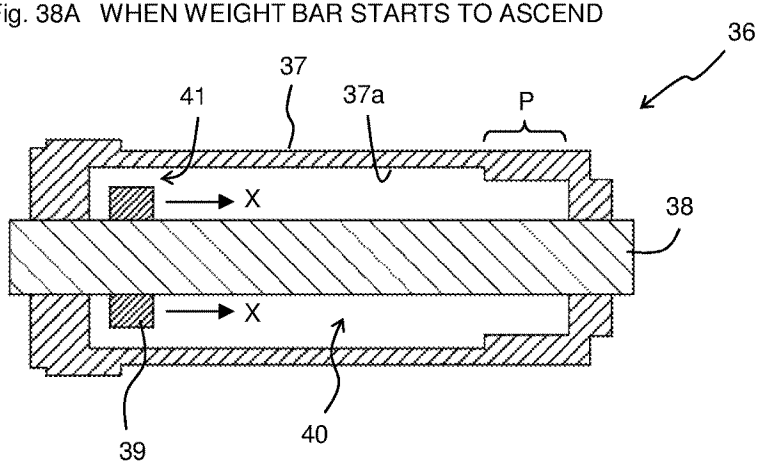
Fig. 38B IMMEDIATELY BEFORE ASCENT OF WEIGHT BAR IS COMPLETE
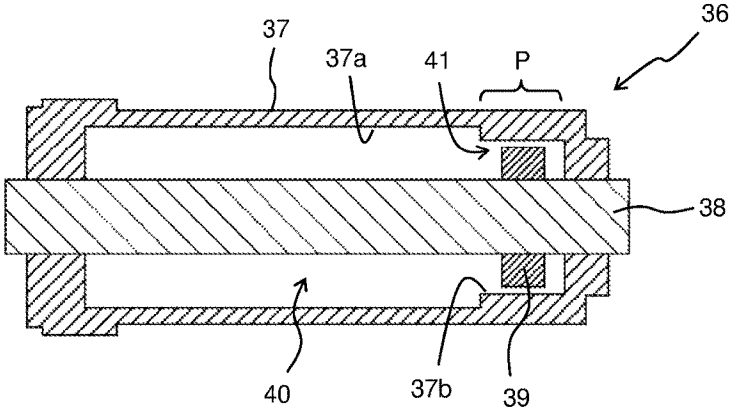

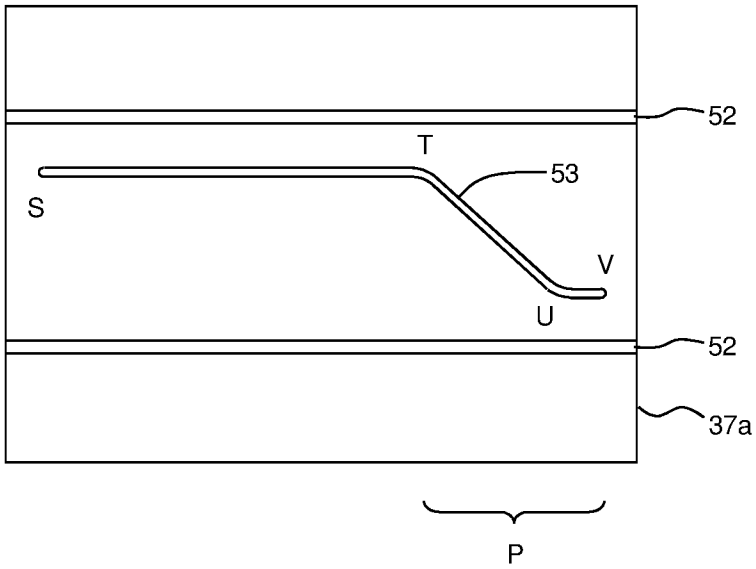
Fig. 39 TWENTY-FIRST EMBODIMENT

HORIZONTAL BLIND

ROMAN SHADE

AUTOMATIC ASCENT IN REVERSE CHARACTERISTICS SHIELDING APPARATUS
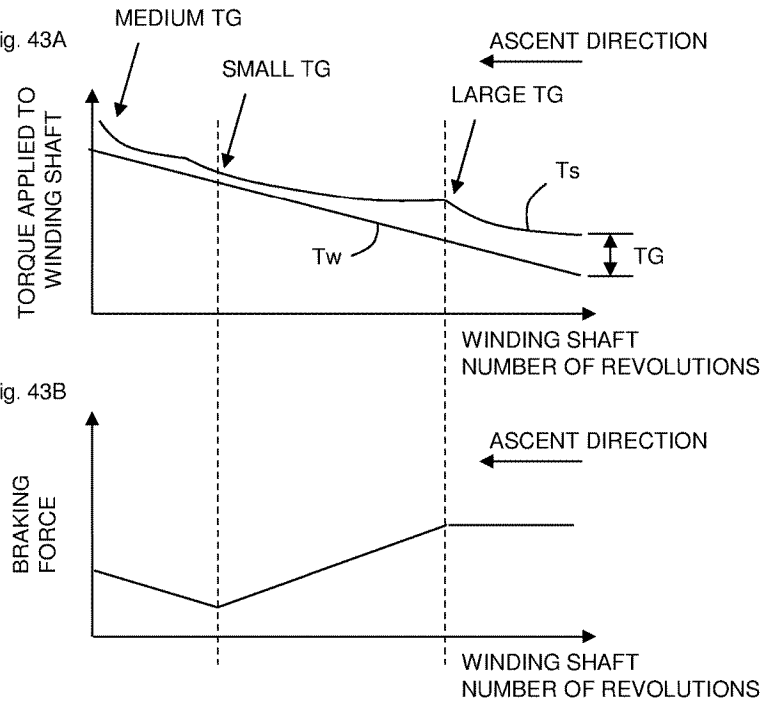
Fig. 43A
Fig. 43B
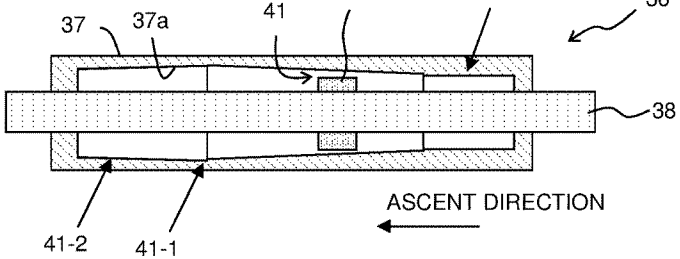
Fig. 43C

SHIELDING APPARATUS

TECHNICAL FIELD

The present invention relates to a shielding device that opens and closes a shielding member that semi-automatically operates by the weight of the shielding member or an energizing force, by rotation of a winding shaft, such as a roller screen, horizontal blind, roll-up curtain, pleated screen, vertical blind, panel curtain, curtain rail, or horizontally pulling shielding device.

BACKGROUND ART

A horizontal blind disclosed in Patent Literature 1 uses a governor device that when causing slats and bottom rail to descend by self-weight, keeps them descending at a predetermined speed or less. This governor device is configured to generate a friction force between a governor weight and a governor drum by pressing the governor weight against the governor drum by a centrifugal force resulting from the rotation of the governor shaft and to control the rotation speed of the governor shaft so that it is a predetermined speed or less, using the friction force.

On the other hand, a roller screen disclosed in Patent Literature 2 uses a damper device that when raising a screen by winding the screen around a winding shaft by the energizing force of a torsion coil spring, suppresses noise resulting from the collision of a weight bar mounted on the lower edge of the screen with a mounting frame. This damper device includes a rotary damper, a planet gear mechanism, and a rotor. The damper device controls the pull-up speed of the screen so that it is a predetermined speed or less, by engaging the rotor with the planetary gear mechanism only when the weight bar is pulled up to near the upper limit to increase the speed of the relative rotation between the case and input shaft of the rotary damper and thus increasing the braking force of the rotary damper.

CITATION LIST

Patent Literature

[Patent Literature 1] Japanese Patent No. 3140295
[Patent Literature 2] Japanese Unexamined Patent Application Publication No. 2000-27570

SUMMARY OF INVENTION

Technical Problem

The governor device of Patent Literature 1 has a problem that noise occurs due to the friction between the governor weight and governor drum. The damper device of Patent Literature 2 has a problem that it requires a complicated mechanism that changes the braking force when the weight bar is pulled up to near the upper limit.

The present invention has been made in view of the foregoing, and an object thereof is to provides shielding device including a speed controller that is able to control the automatic movement speed of a shielding member with a simple configuration and suppresses noise during operation.

Solution to Problem

According to another aspect of the present invention, a shielding device for opening and closing a shielding member by rotation of a winding shaft, the shielding device comprising a speed controller configured to control an automatic movement speed of the shielding member, wherein the speed controller comprises: a housing containing a viscous fluid; and a moving member contained in the housing and configured to move by rotation of the winding shaft, and the speed controller is configured so that resistance the moving member receives from the viscous fluid varies with movement of the moving member, is provided.

In the present invention, the moving member that moves by rotation of the winding shaft is disposed in the housing containing the viscous fluid, and a change is made to the resistance the moving member receives from the viscous fluid while it moves. According to this configuration, the braking force generated by the speed controller can be easily changed using a method such as changing the distribution resistance of the viscous fluid. Also, a braking force is generated using the resistance the moving member receives from the viscous fluid while it moves and thus noise is suppressed.

Hereinafter, various embodiments of the present invention will be provided. The embodiments provided below can be combined with each other.

Preferably, the speed controller is configured so that the moving member is able to repeatedly relatively reciprocate in a predetermined range in the housing, the predetermined range being associated with an open/close range of the shielding member and the resistance the moving member receives from the viscous fluid varies with a position of the moving member in the predetermined range.

Preferably, the speed controller is configured so that a position in which a drive torque is minimized in the open/close range of the shielding member becomes a position in which the resistance is minimized in the predetermined range.

Preferably, the speed controller is configured so that a position in which a drive torque is maximized in the open/close range of the shielding member becomes a position in which the resistance is maximized in the predetermined range.

Preferably, the speed controller is configured so that with movement of the moving member, a cross-sectional area of a distribution path of the moving member through which the viscous fluid can pass varies, the viscous fluid bypasses the distribution path and passes through a larger distribution path, or at least one elastic modulus of a member forming the distribution path varies.

Preferably, the speed controller is configured so that distribution resistance of the viscous fluid when the moving member moves in a first direction when causing the shielding member to automatically move becomes larger than distribution resistance of the viscous fluid when the moving member moves in a second direction opposite to the first direction.

Preferably, the speed controller is configured so that a moving distance of the moving member per unit rotation of the winding shaft varies with movement of the moving member.

Preferably, the speed controller is configured to be capable of switching between a link state in which rotation of the winding shaft and movement of the moving member is linked and a non-link state in which rotation of the winding shaft and movement of the moving member are not linked.

Preferably, the shielding device further comprises braking force increase means disposed in the housing, the braking force increase means being configured to increase a braking force applied to the winding shaft in a braking force increase range which is a part of movable range of the moving member.

Preferably, the braking force increase means is configured to form a piston structure with the moving member when the moving member is located in the braking force increase range.

Preferably, the braking force increase means is a rotational resistance body that when the moving member is located in the braking force increase range, increases the braking force by rotating by rotation of the winding shaft.

Preferably, the moving member is configured to rotate by rotation of the winding shaft and to move at the same time, and the rotational resistance body is configured to, when the moving member is located in the braking force increase range, become engaged with the moving member and thus to rotate with the moving member.

Preferably, the shielding device further comprises first and second resistance parts each configured to generate the resistance the moving member receives from the viscous fluid in association with the open/close range of the shielding member, wherein at least one of the first and second resistance parts is configured to change resistance received from the viscous fluid in the open/close range of the shielding member.

Preferably, the speed controller comprises an internal pressure limiter configured to, when a torque applied to the winding shaft exceeds a predetermined threshold or when an internal pressure in the housing exceeds a predetermined threshold, be activated and to reduce the internal pressure in the housing.

Preferably, the speed controller has a non-movement region in which the moving member does not move even if the winding shaft rotates in a descent direction of the shielding member, and when the winding shaft rotates in an ascent direction of the shielding member with the moving member located in the non-movement region, the moving member moves by rotation of the winding shaft.

Preferably, the shielding device is configured so that by rotating the winding shaft by self-weight of the shielding member, a lift cord whose one end is mounted on the shielding member is unwound from the winding shaft and thus the shielding member is caused to automatically descend, and the speed controller is configured so that the resistance is reduced with an descent of the shielding member.

Preferably, thrust providing means configured to provide the moving member with thrust by rotating and moving with the moving member by rotation of the winding shaft is disposed in the housing.

Preferably, the shielding device is configured so that the shielding member is caused to automatically ascend, by rotating the winding shaft by an energizing force of an energizing device and winding the shielding member around the winding shaft, and the speed controller is configured so that the resistance is increased when the shielding member is caused to ascend to near an upper limit position of the shielding member.

FIGS. 3A to E include drawings showing a speed controller 36 of the first embodiment of the present invention, in which FIG. 3A shows a state when a bottom rail 5 starts to descend; FIG. 3B shows a state immediately before the descent of the bottom rail 5 is complete; and FIGS. 3C to 3E show examples of the cross-sectional structure of the speed controller 36.

Figure 4A:
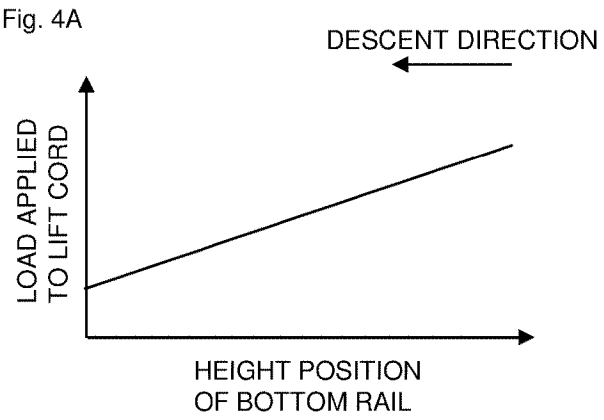
Figure 4B:
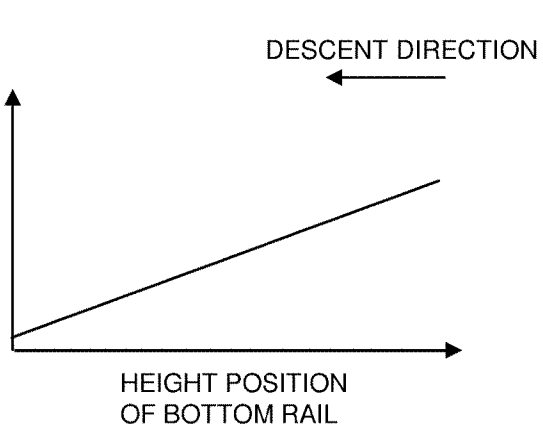
Figure 4C:
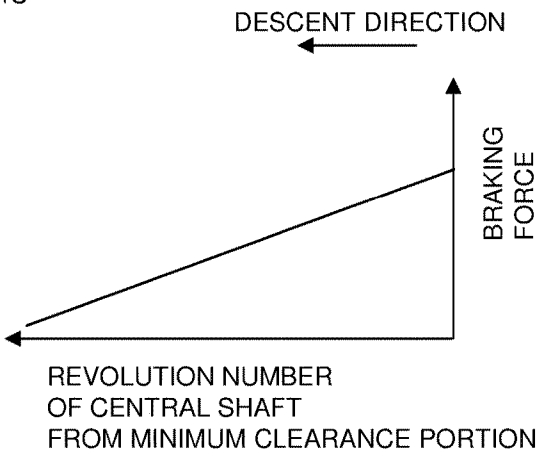

FIG. 4A is a graph showing the relationship between the height position of the bottom rail 5 of the pleated screen and the load applied to lift cords 7; FIG. 4B is a graph showing the relationship between the height position of the bottom rail 5 of the pleated screen and a braking force generated by the speed controller 36; and FIG. 4C is a graph showing the relationship between the number of revolutions of a central shaft 38 from a state in which the clearance 41 between a housing 37 and a moving member 39 is minimized and a braking force generated by the speed controller 36.

Figure 5A:
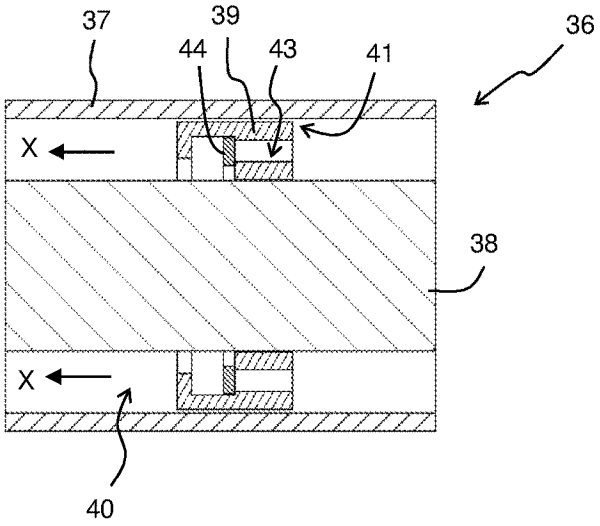
Figure 5B:
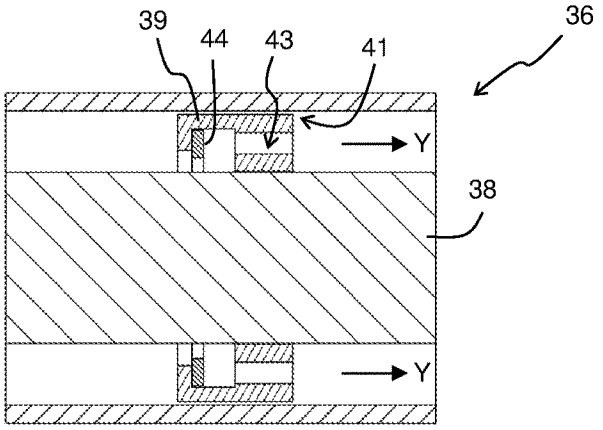

FIGS. 5A and 5B include drawings showing a speed controller 36 of a second embodiment of the present invention, in which FIG. 5A shows a state when a bottom rail 5 starts to descend; and FIG. 5B shows a state during an ascent operation of the bottom rail 5.

FIGS. 6A to 6D includes drawings showing a speed controller 36 of a third embodiment of the present invention, in which FIG. 6A is a sectional view; and FIGS. 6B to 6D are developments of the inner surfaces 37*a* of housings 37 of example configurations 1 to 3.

FIG. 7 is a perspective view showing a speed controller 36 of a fourth embodiment of the present invention.

FIGS. 8A to 8G include drawings showing a speed controller 36 of a fifth embodiment of the present invention, in which FIG. 8A is a front view (a housing 37 is a sectional view); FIG. 8B is a development of the inner surface 37*a* of the housing 37; FIG. 8C is a front view of a moving member 39; FIG. 8D is a left side view of the moving member 39; FIGS. 8E to 8G are sectional views taken along line A-A in FIG. 8C showing the state of a movable plate 39*b* in positions R, Q, P; and FIG. 8H is a graph showing the relationship between the number of revolutions and the braking force.

Figure 9A:
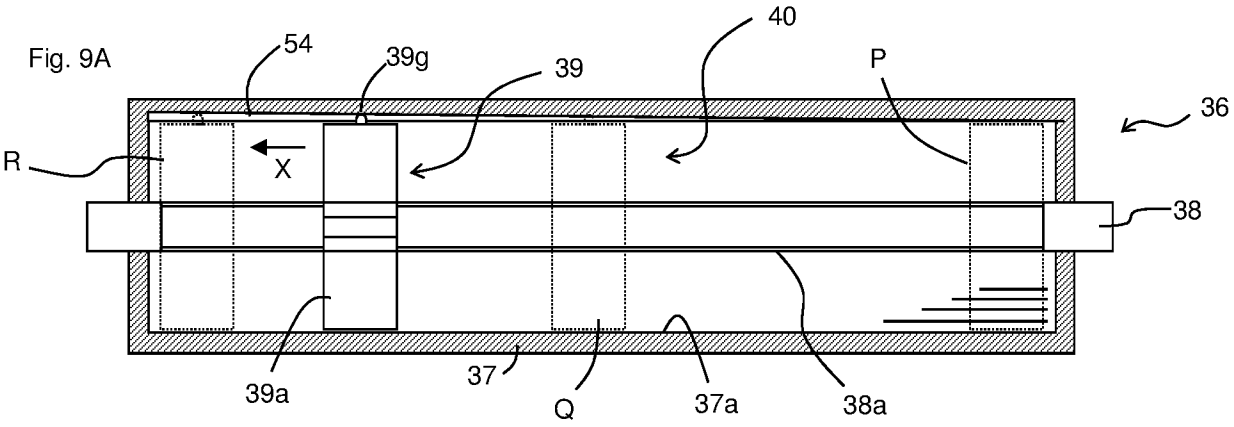
Figure 9C:
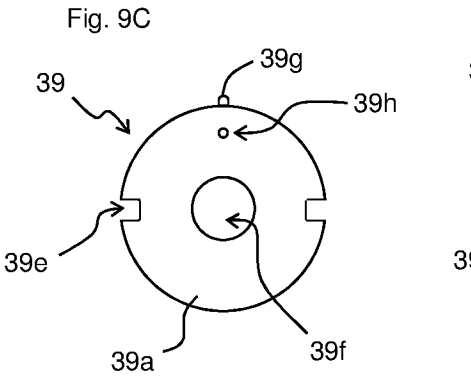
Figure 9B:
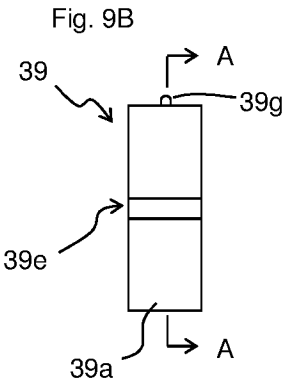
Figure 9D:
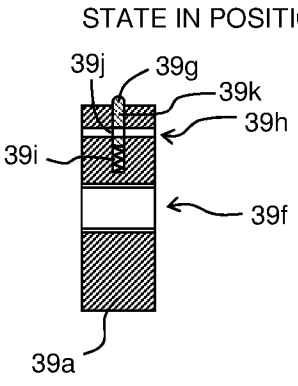
Figure 9E:
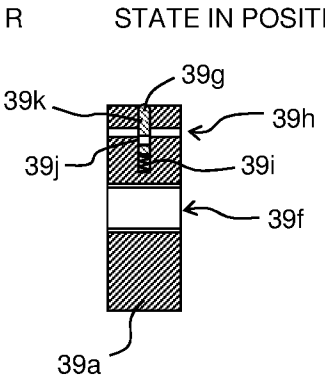

FIGS. 9A to 9E include drawings showing a speed controller 36 of a sixth embodiment of the present invention, in which FIG. 9A is a front view (a housing 37 is a sectional view); FIG. 9B is a front view of a moving member 39; FIG. 9C is a left side view of the moving member 39; and FIGS. 9D and 9E are sectional views taken along line A-A in FIG. 9B showing the state of a movable protruding member 39*k* in positions Q, P.

Figure 10A:
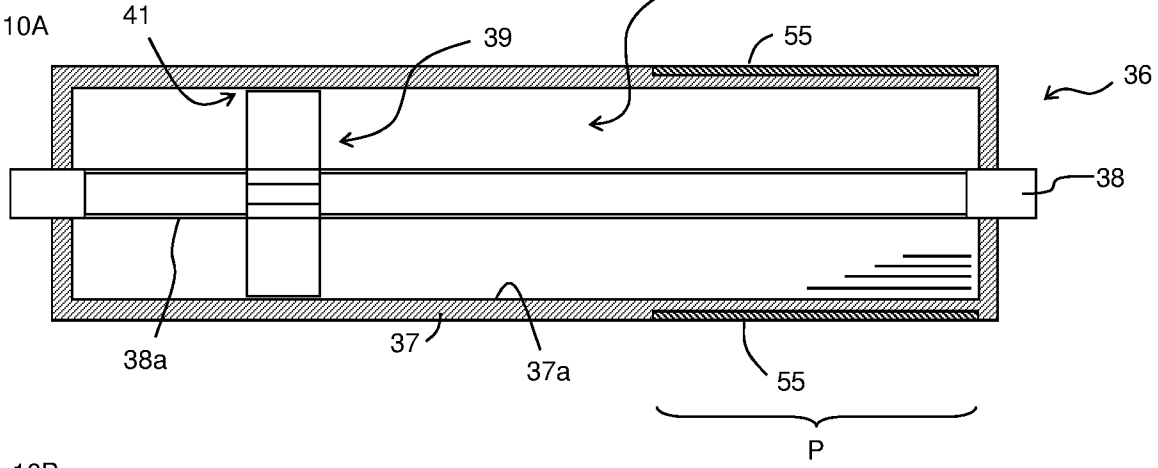
Figure 10B:
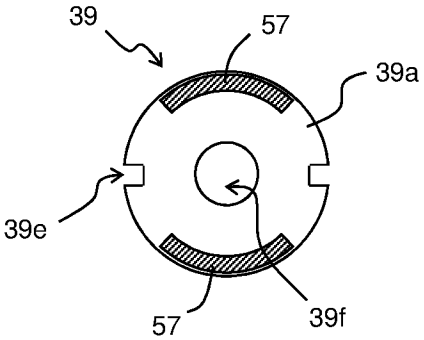

FIGS. 10A and 10B include drawings showing a speed controller 36 of a seventh of the present invention, in which FIG. 10A is a front view (a housing 37 is a sectional view); and FIG. 10B is a left side view of a moving member 39.

Figures 11A, 11B, 11C, 11D, 11E, 11F:
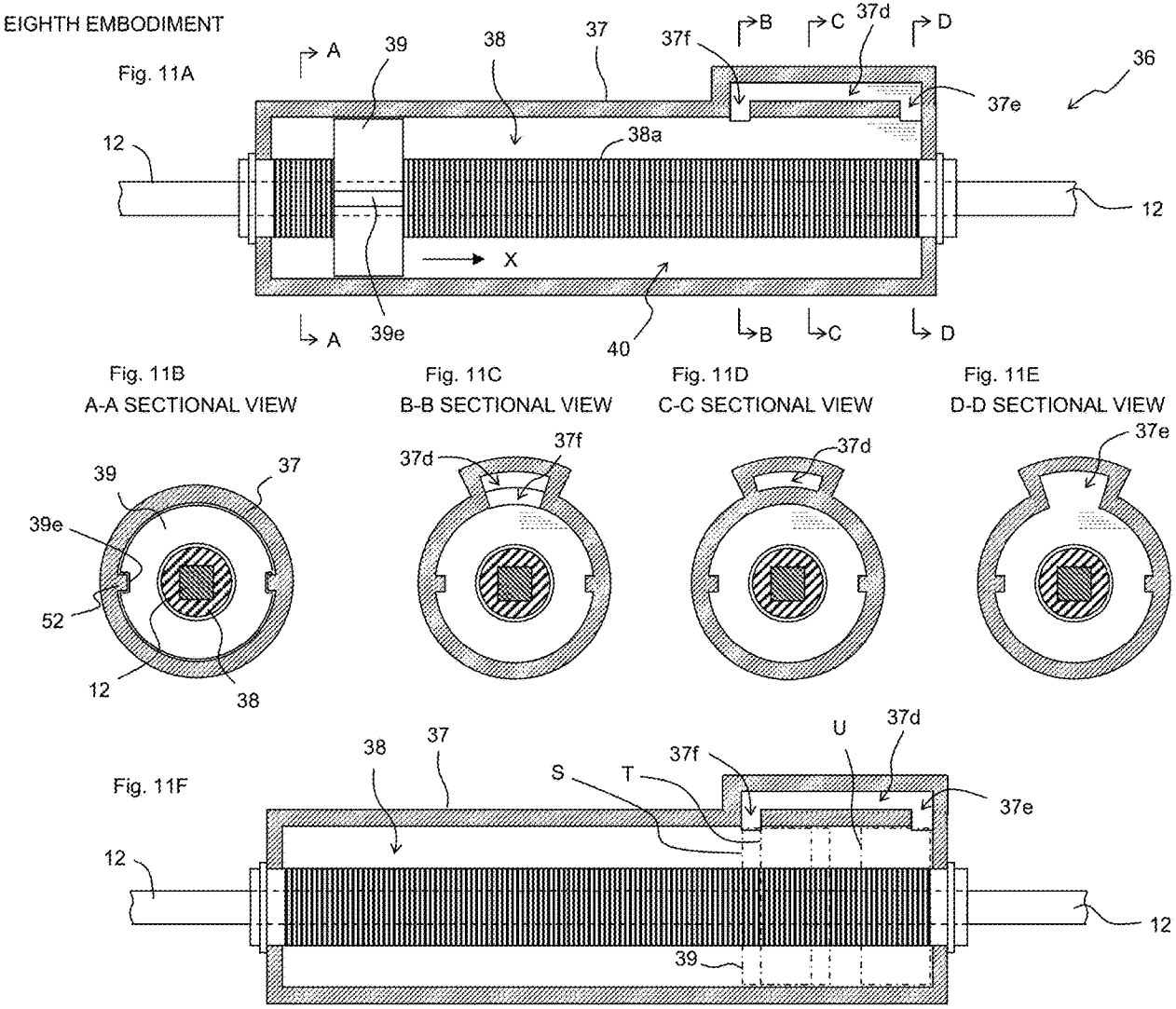

FIGS. 11A to 11F include drawings showing a speed controller 36 of an eighth embodiment of the present invention, in which FIG. 11A is a front view (a housing 37 is a sectional view); FIGS. 11B to 11E are an A-A sectional view, B-B sectional view, C-C sectional view, and D-D sectional view, respectively; and FIG. 11F is a sectional view corresponding to FIG. 11A showing the state in which a moving member 39 has moved to positions S, T, and U.

FIG. 12 is a perspective view showing a speed controller 36 of a ninth embodiment of the present invention.

Figure 13A:
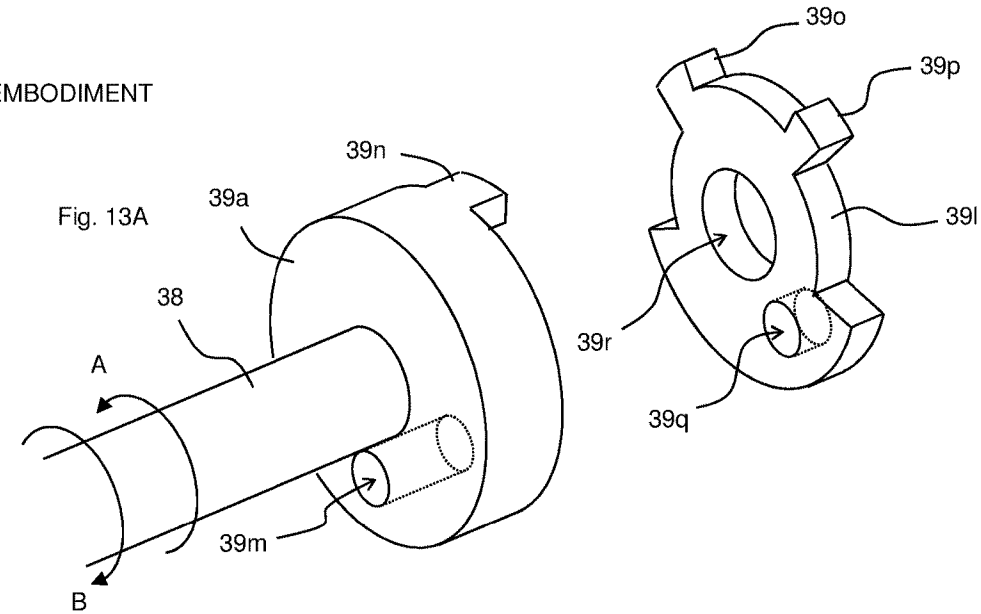
Figure 13B:
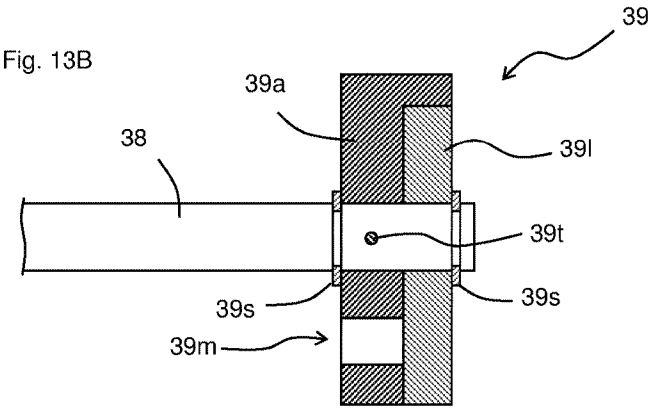

FIGS. 13A and 13B include drawings showing a moving member 39 and central shaft 38 of a speed controller 36 of a tenth embodiment of the present invention, in which FIG. 13A is a perspective view; and FIG. 13B is a sectional view.

Figure 14A:
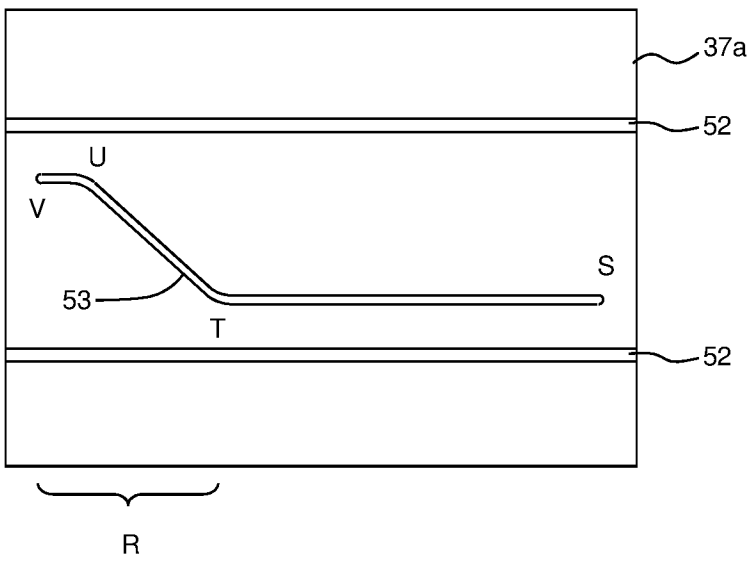
Figure 14B:
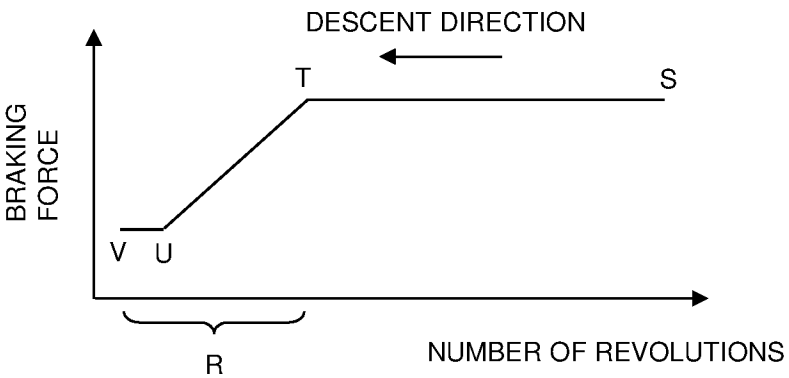

FIGS. 14A and 14B include diagrams showing a speed controller 36 of an eleventh embodiment of the present invention, in which FIG. 14A is a development of the inner surface 37*a* of a housing 37; and FIG. 14B is a graph showing the relationship between the number of revolutions and the braking force.

Figure 15A:
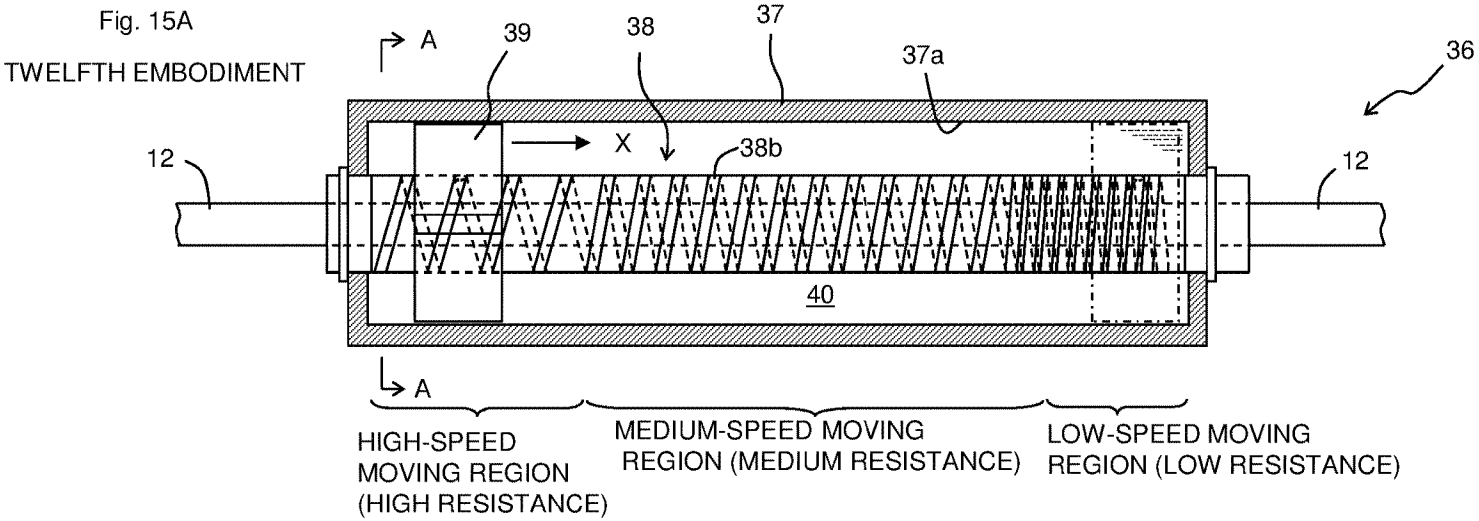
Figure 15B:
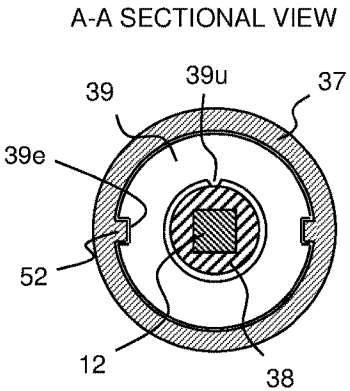

FIGS. 15A and 15B include drawings showing a speed controller 36 of a twelfth of the present invention, in which FIG. 15A is a front view (a housing 37 is a sectional view); and FIG. 15B is an A-A sectional view.

Figures 16A, 16B, 16C, 16D, 16F, 16G:
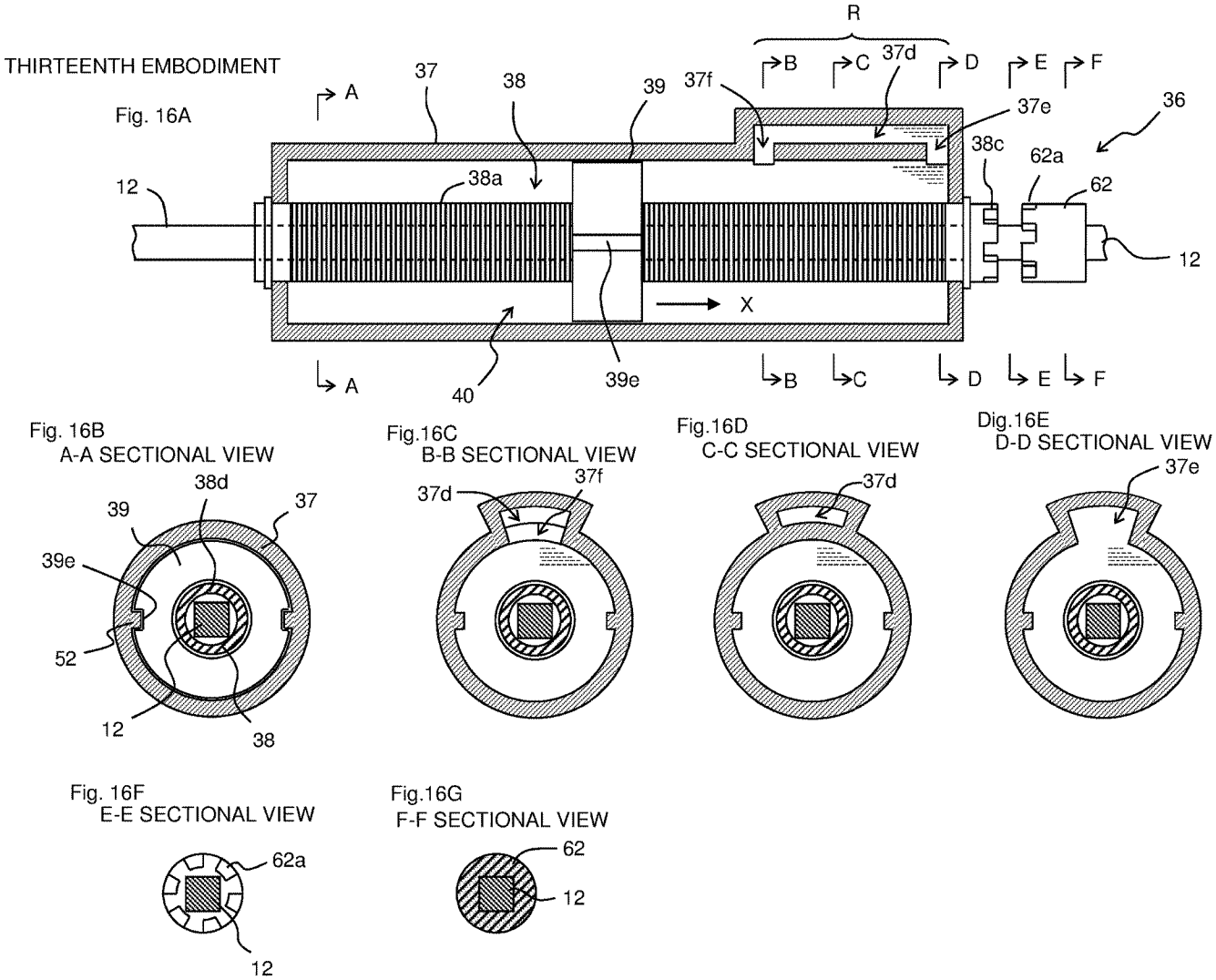

FIGS. 16A to 16G include drawings showing a speed controller 36 of a thirteenth embodiment of the present invention, in which FIG. 16A is a front view (a housing 37 is a sectional view); and FIGS. 16B to 16G are an A-A sectional view, B-B sectional view, C-C sectional view, D-D sectional view, E-E sectional view, and F-F sectional view, respectively.

FIG. 17 is a front view (a housing 37 is a sectional view) showing a state after a moving member 39 has moved with a descent of a bottom rail 5 in the speed controller 36 of the thirteenth embodiment of the present invention.

FIGS. 18A to 18E include drawings showing a speed controller 36 of a fourteenth embodiment of the present invention, in which FIG. 18A is a front view (a housing 37 is a sectional view); and FIGS. 18B to 18E are an A-A sectional view, B-B sectional view, E-E sectional view, and F-F sectional view, respectively.

Figure 19A:
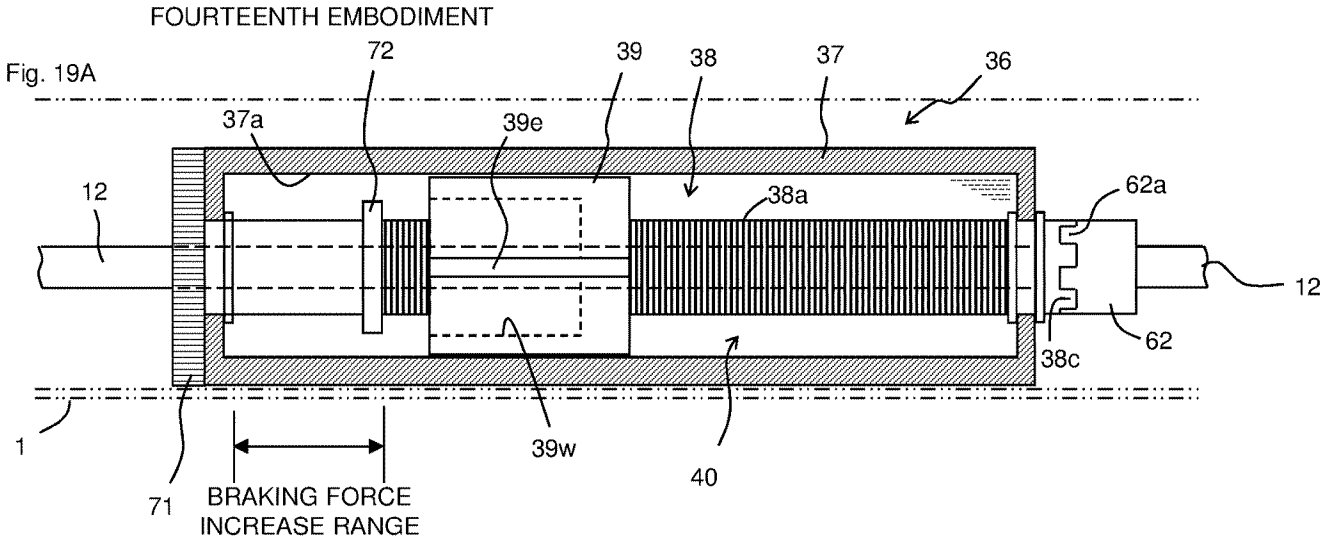
Figure 19B:
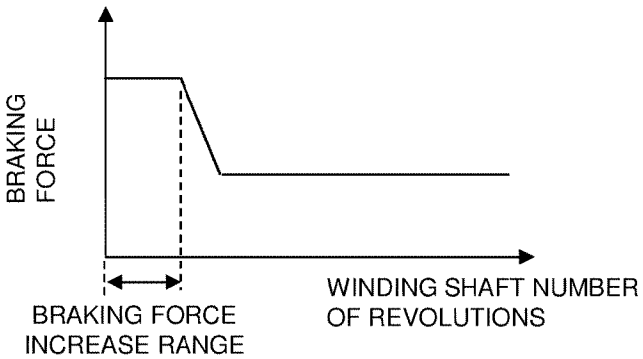

FIGS. 19A and 19B include drawings showing the speed controller 36 of the fourteenth of the present invention, in which FIG. 19A is a front view showing a state after a moving member 39 has moved (a housing 37 is a sectional view); and FIG. 19B is a graph showing the relationship between the number of revolutions and braking force.

FIG. 20 shows a speed controller 36 of a modification 1 of the fourteenth embodiment of the present invention.

FIG. 21 shows a speed controller 36 of a modification 2 of the fourteenth embodiment of the present invention.

FIG. 22 shows a speed controller 36 of a modification 3 of the fourteenth embodiment of the present invention.

Figure 23A:
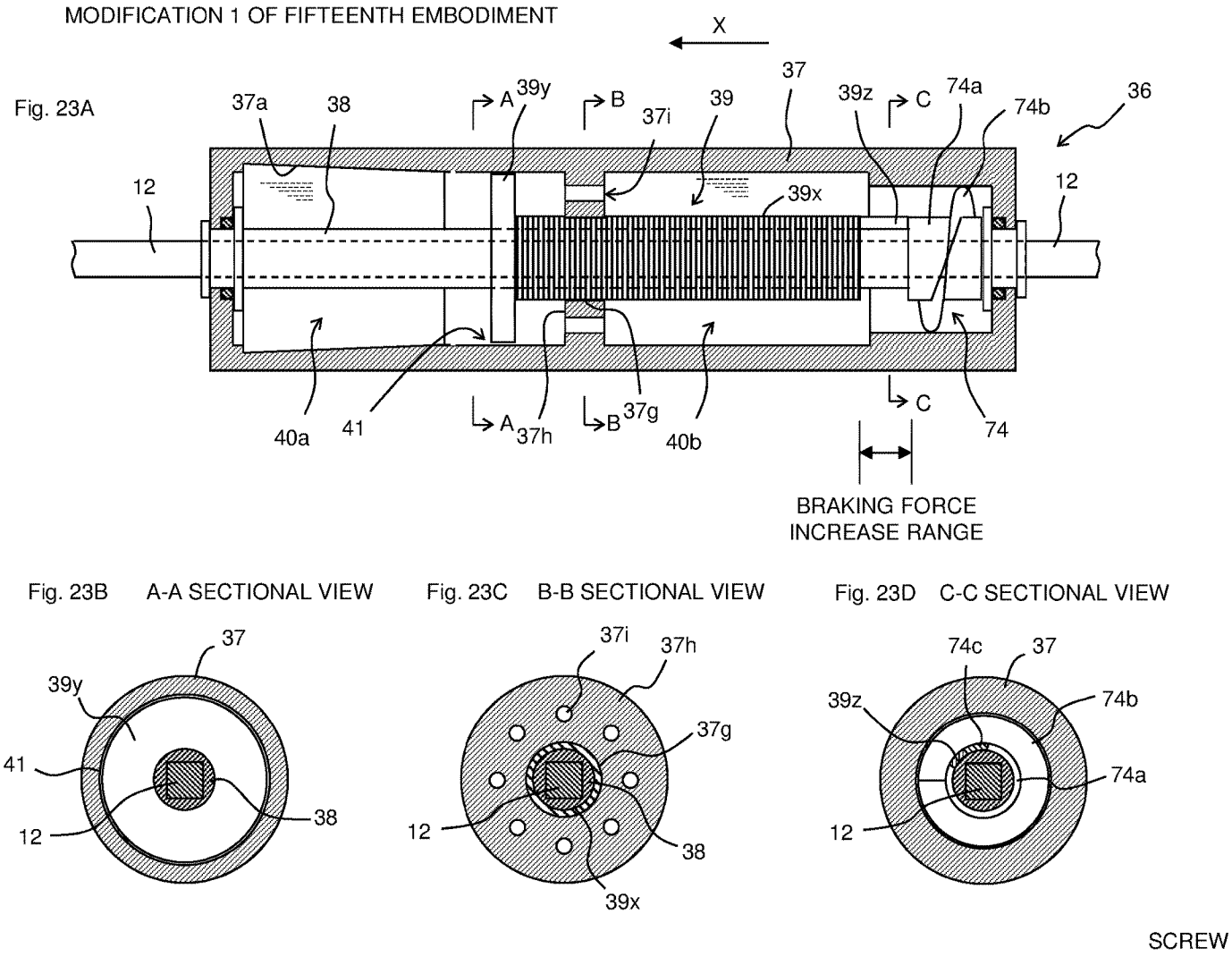

FIGS. 23A to 23D include drawings showing a speed controller 36 of a fifteenth embodiment of the present invention, in which FIG. 23A is a front view (a housing 37 is a sectional view); and FIGS. 23B to 23D are an A-A sectional view, B-B sectional view, and C-C sectional view, respectively.

FIG. 24 is a front view (a housing 37 is a sectional view) showing a state after a moving member 39 has moved in the speed controller 36 of the fifteenth embodiment of the present invention.

FIG. 25 shows a speed controller 36 of a modification 1 of the fifteenth embodiment of the present invention.

Figure 26A:
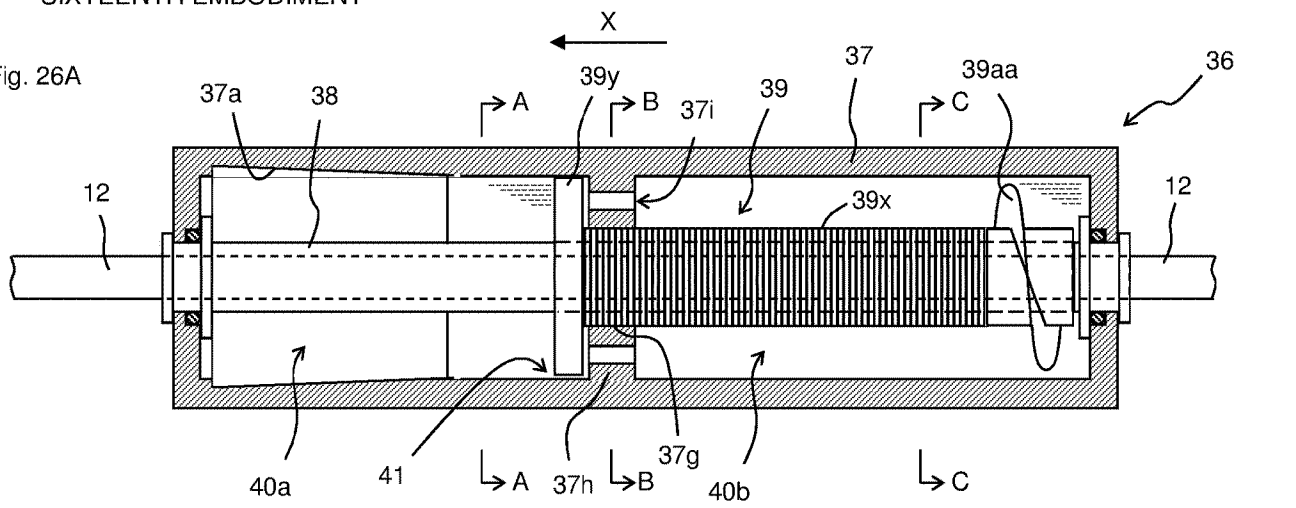
Figure 26D:
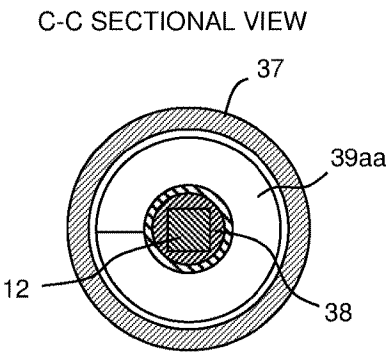
Figure 26C:
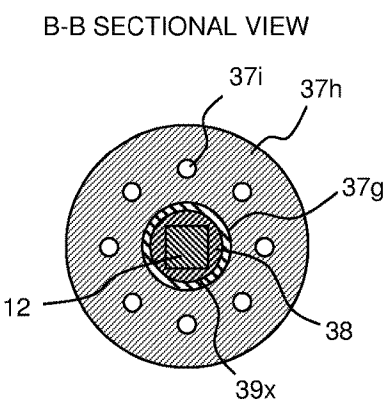
Figure 26B:
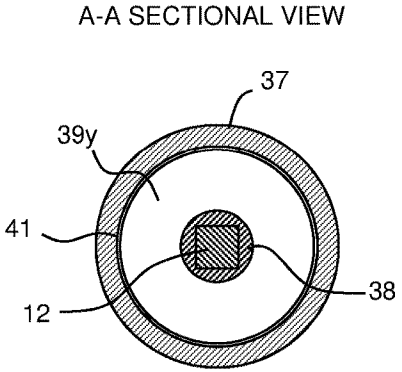

FIGS. 26A to 26D include drawings showing a speed controller 36 of a sixteenth embodiment of the present invention, in which FIG. 26A is a front view (a housing 37 is a sectional view); and FIGS. 26B to 26D are an A-A sectional view, B-B sectional view, and C-C sectional view, respectively.

FIG. 27 is a front view (a housing 37 is a sectional view) showing a state after a moving member 39 has moved in the speed controller 36 of the sixteenth embodiment of the present invention.

FIG. 28 shows a speed controller 36 of a modification 1 of the sixteenth embodiment of the present invention.

Figure 29D:
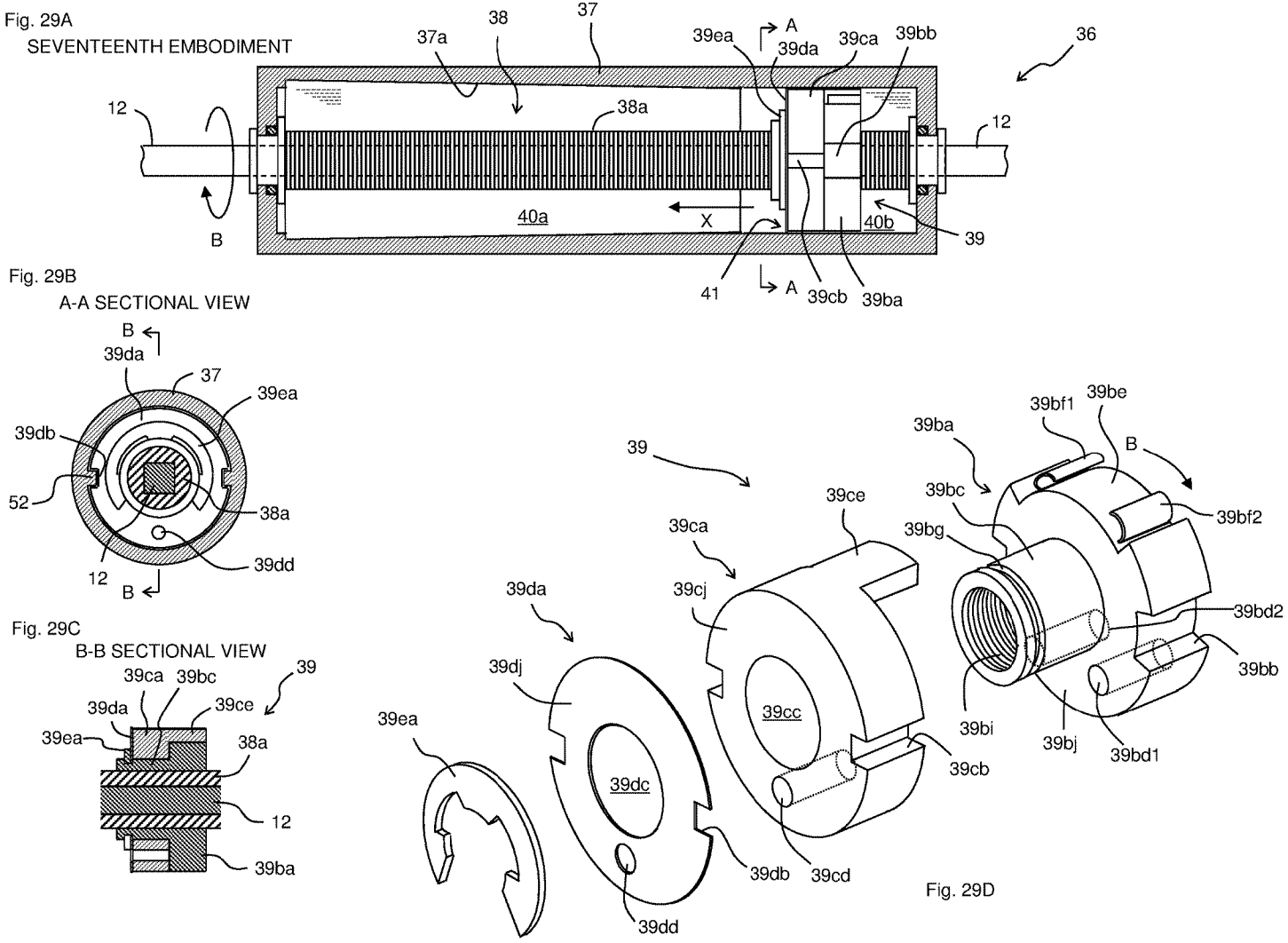

FIGS. 29A to 29D include drawings showing a speed controller 36 of a seventeenth embodiment of the present invention, in which FIG. 29A is a front view (a housing 37 is a sectional view); FIG. 29B is an A-A sectional view; FIG. 29C is B-B sectional view (the housing 37 is not shown); and FIG. 29D is an exploded perspective view of a moving member 39.

Figure 30A:
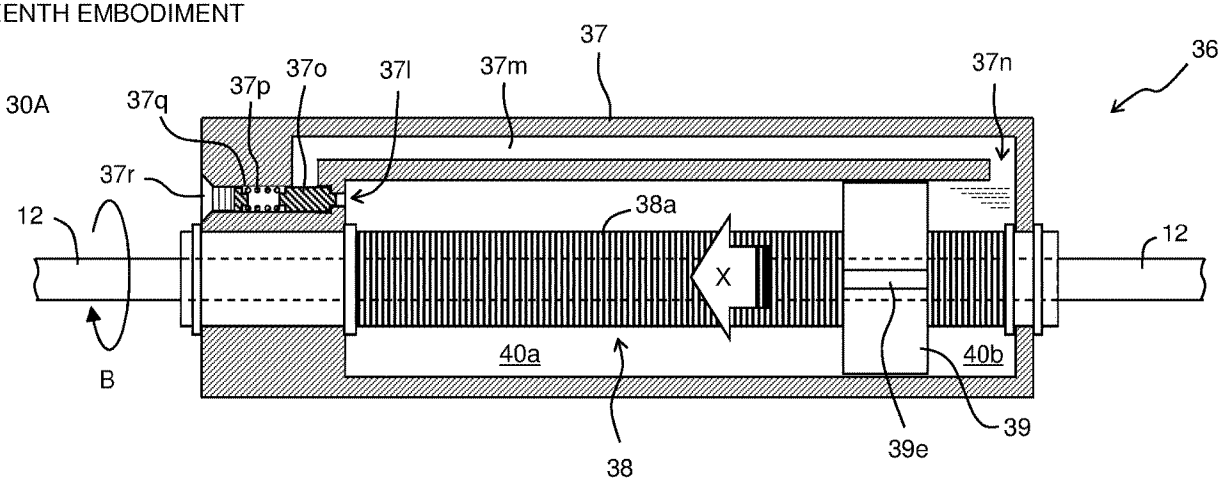
Figure 30B:
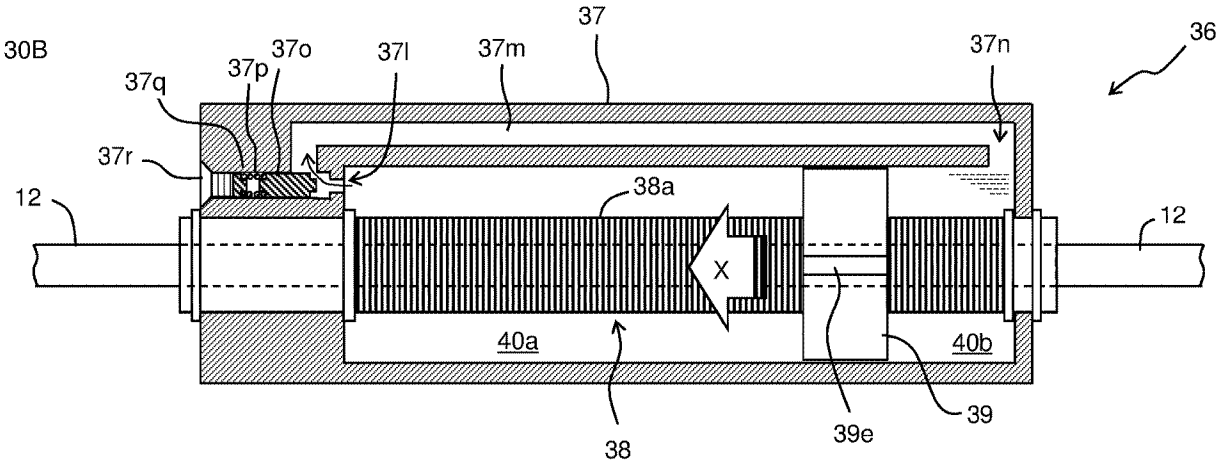

FIGS. 30A and 30B are front views (housings 37 are sectional views) of a speed controller 36 of an eighteenth embodiment of the present invention; in which FIG. 30A shows a state before an internal pressure limiter is activated; and FIG. 30B shows a state after the internal pressure limiter is activated.

FIG. 31 is a front view (a housing 37 is a sectional view) showing a speed controller 36 of a nineteenth embodiment of the present invention.

Figure 32A:
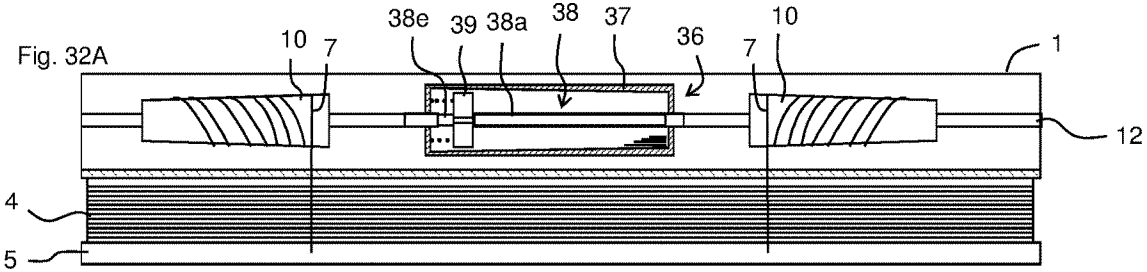
Figure 32B:
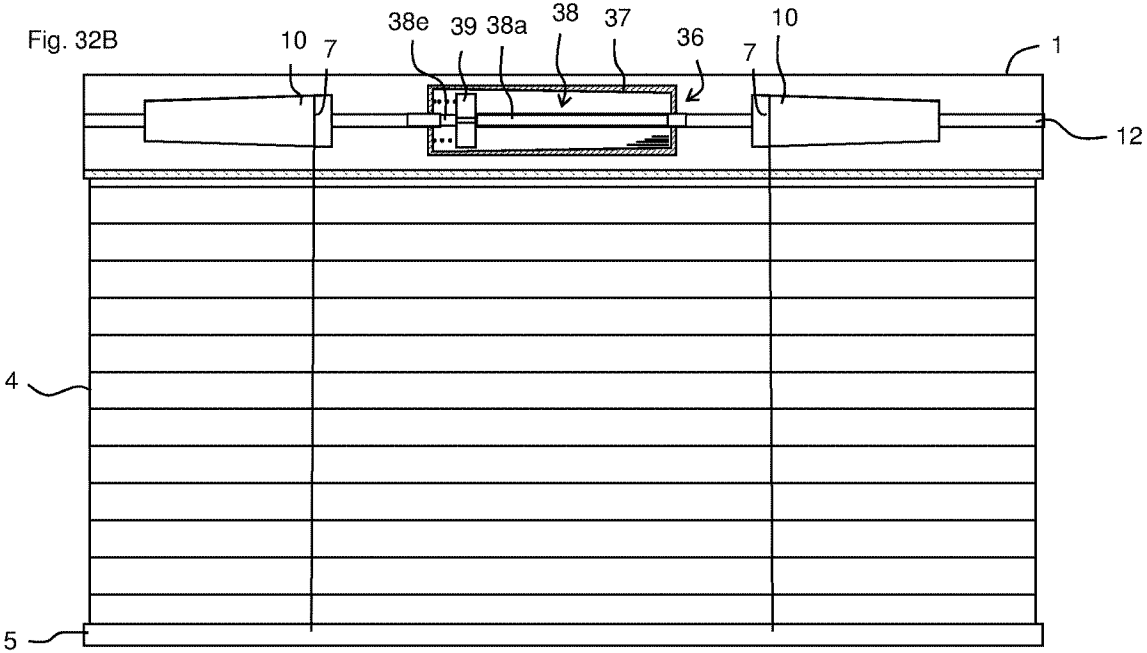

FIGS. 32A and 32B include schematic front views showing a method for assembling the speed controller 36 of the nineteenth embodiment of the present invention into a head box 1, in which FIG. 32A shows a state in which a bottom rail 5 is located in the upper limit position; and FIG. 32B shows a state in which the bottom rail 5 is located in the lower limit position.

Figure 33:
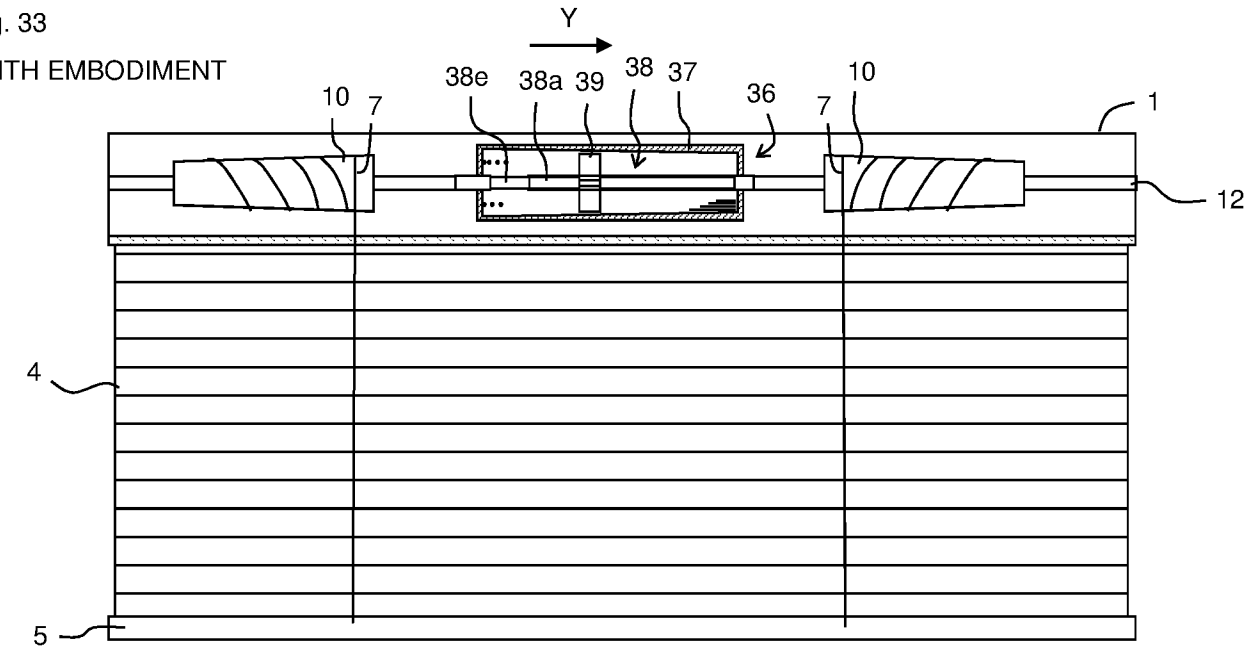

FIG. 33 is a schematic front view showing the method for assembling the speed controller 36 of the nineteenth embodiment of the present invention into the head box 1 and shows a state in which the bottom rail 5 has been raised to a midpoint.

FIG. 34 is a front view of a roller screen of a twentieth embodiment of the present invention.

FIG. 35 is a sectional view showing an energizing device 80 of a winding shaft 63 of the roller screen in FIG. 34.

FIG. 36 is a sectional view showing a speed controller 36 and clutch device 70 of the roller screen in FIG. 34.

Figure 37A:
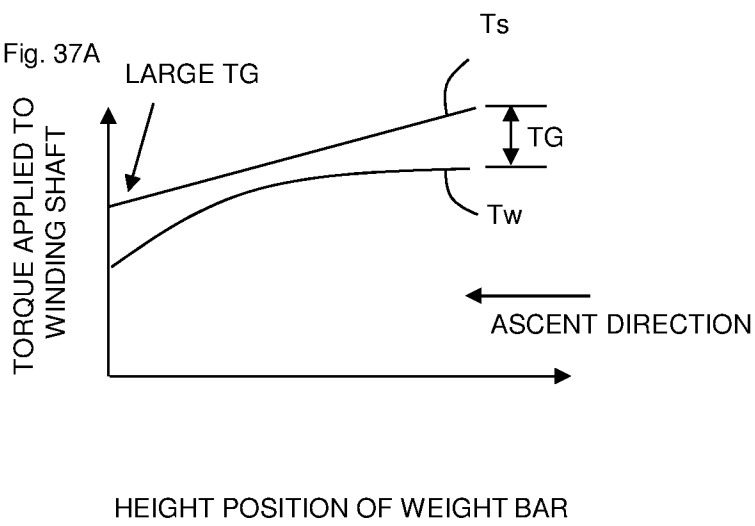
Figure 37B:
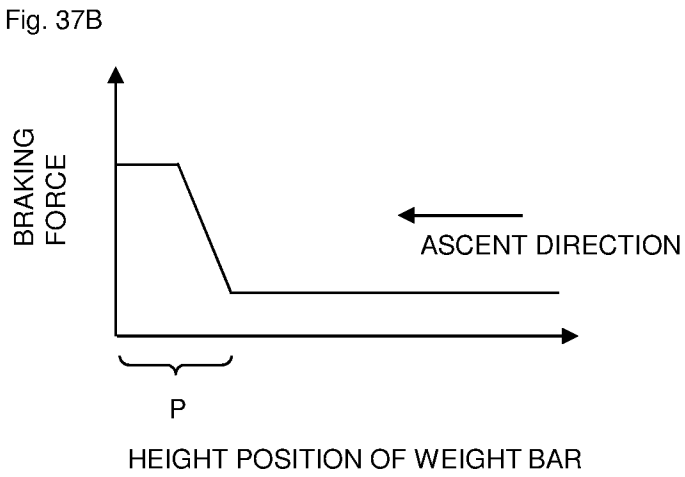

FIG. 37A is a graph showing the relationship between the height position of a weight bar 64*a* of the roller screen and a torque applied to a winding shaft; and FIG. 37B is a graph showing the relationship between the height position of the weight bar 64*a* of the roller screen and a braking force generated by the speed controller 36.

FIGS. 38A and 38B include drawings showing the speed controller 36 of the twentieth embodiment of the present invention, in which FIG. 38A shows a state when the weight bar 64*a* starts to ascend; and FIG. 38B shows a state immediately before the ascent of the weight bar 64*a* is complete.

FIG. 39 shows the inner surface 37*a* of a housing 37 of a speed controller 36 of a twenty-first embodiment of the present invention.

Figure 40A:
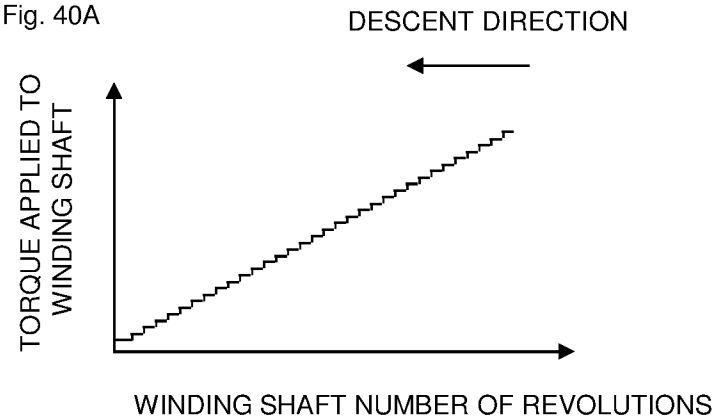
Figure 40B:
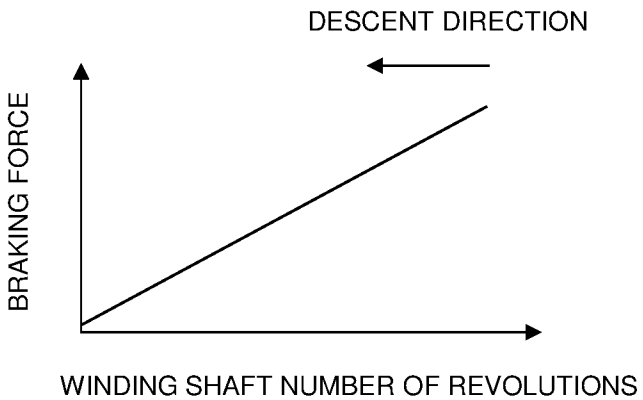

FIGS. 40A and 40B are graphs showing the relationships of a torque applied to a winding shaft and braking force to the number of revolutions of the winding shaft in a horizontal blind.

Figure 41A:
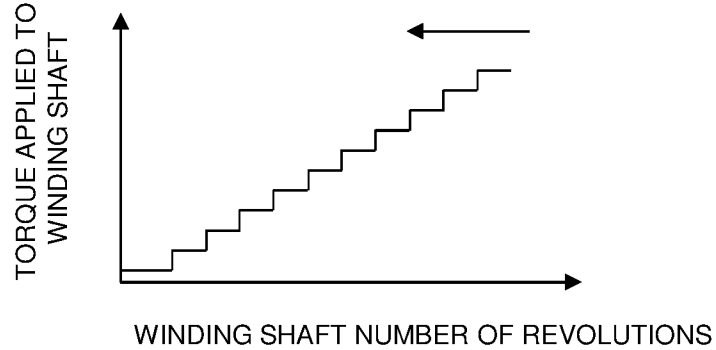
Figure 41B:
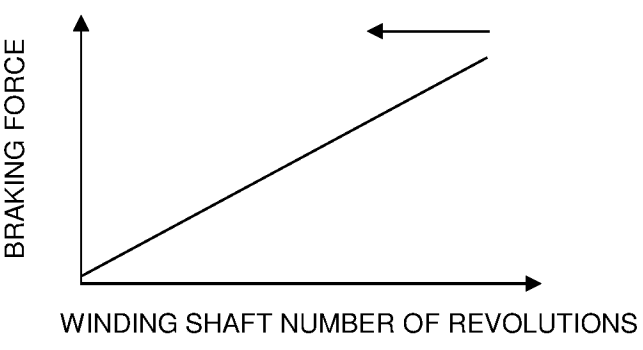

FIGS. 41A and 41B are graphs showing the relationships of a torque applied to a winding shaft and braking force to the number of revolutions of the winding shaft in a Roman shade.

Figures 42A, 42B, 42C:
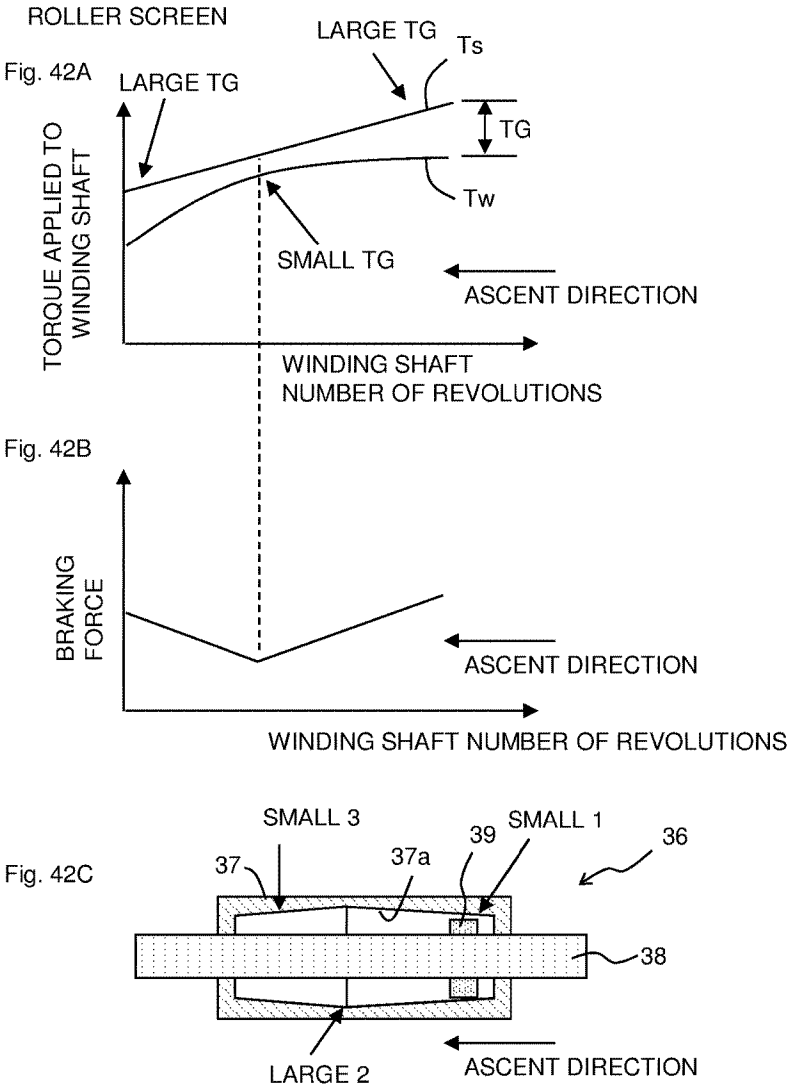

FIGS. 42A and 42B are graphs showing the relationships of a torque applied to a winding shaft and braking force to the number of revolutions of the winding shaft in a roller screen; and FIG. 42C is a sectional view showing a speed controller 36 having braking force characteristics shown in FIG. 42B.

FIGS. 43A and 43B are graphs showing the relationships of a torque applied to a winding shaft and braking force to the number of revolutions of the winding shaft in a shielding device having reverse characteristics and an automatic ascent structure; and FIG. 43C is a sectional view showing a speed controller 36 having braking force characteristics shown in FIG. 43B.

DESCRIPTION OF EMBODIMENTS

Now, embodiments of the present invention will be described. Various features described in the embodiments below can be combined with each other. Inventions are established for the respective features.

<First Embodiment>

Figure 1:
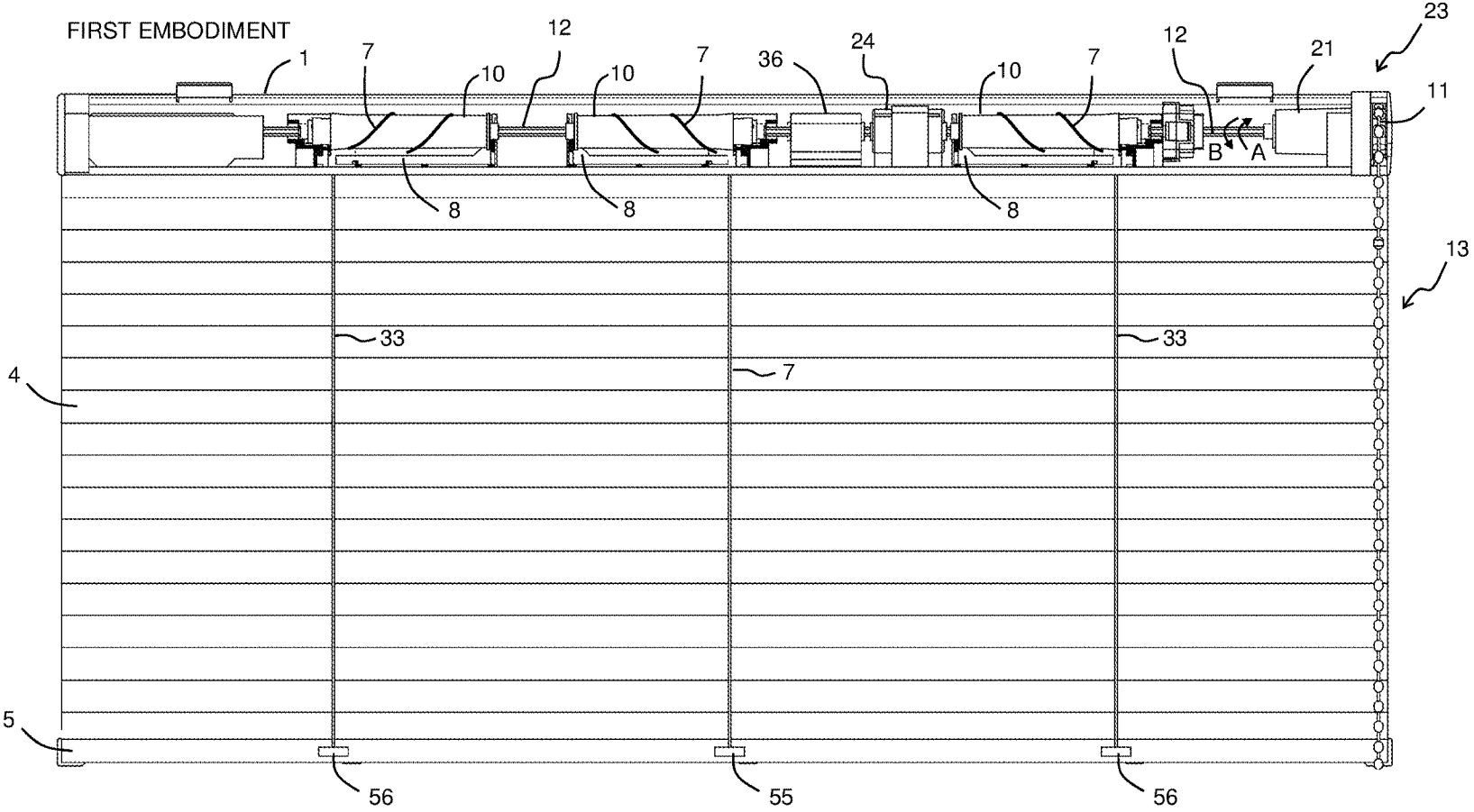
FIG. 1 is a front view of a pleated screen of a first embodiment of the present invention.
Figure 2:
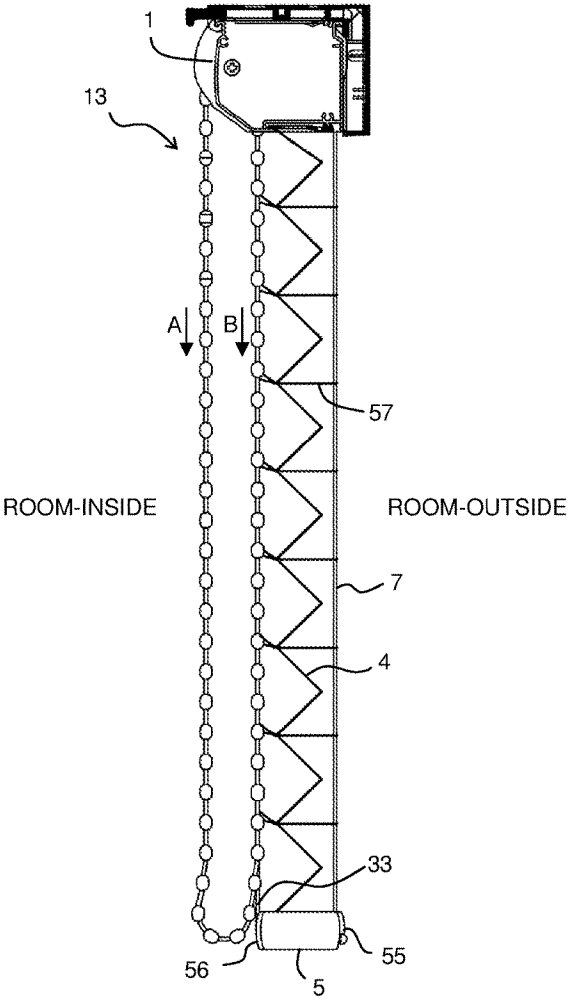
FIG. 2 is a right side view of the pleated screen in FIG. 1.

In a pleated screen of a first embodiment of the present invention shown in FIGS. 1 and 2, a screen 4 is suspended from and supported by a head box 1, and a bottom rail 5 is mounted on the lower edge of the screen 4. The screen 4 is formed of a textile that can be folded in a zigzag manner.

Pitch maintenance cords 33 for maintaining the pitch of the folds of the screen 4 are disposed between the head box 1 and bottom rail 5. Multiple annular maintenance parts 57 are disposed at equal intervals on the pitch maintenance cords 33. By inserting the maintenance parts 57 into the screen 4 and then inserting lift cords 7 for raising and lowering the bottom rail 5 into the maintenance parts 57, the maintenance parts 57 are prevented from coming off the screen 4. Thus, the pitch of the screen 4 can be maintained. The pitch maintenance cords 33 and lift cords 7 are disposed on the opposite sides of the screen 4.

Mounted on the bottom rail 5 are pitch maintenance cord holding members 56 for holding the pitch maintenance cords 33 and lift cord holding members 55 for holding the lift cords 7. The pitch maintenance cords 33 and lift cords 7 are mounted on the bottom rail 5 by these holding members.

The upper ends of the lift cords 7 are mounted on winding shafts 10. The winding shafts 10 rotate with a drive shaft 12. By winding or unwinding the lift cords around or from the winding shafts 10, the bottom rail 5 is raised or lowered. Thus, the screen 4 can be folded or extended. One edge of the head box 1 is provided with an operation unit 23 including a ball chain 13, an operation pulley 11, and a transmission clutch 21. The ball chain 13 is hung on the operation pulley 11. A rotational force in the ascent direction of the bottom rail 5 (the direction of an arrow A in FIG. 1) applied to the operation pulley 11 by the ball chain 13 is transmission to the drive shaft 12 through the transmission clutch 21. The transmission clutch 21 is configured to transmit the rotational force in the direction of the arrow A in FIG. 1 but not to transmit the rotational force in the direction of an arrow B in FIG. 1.

The drive shaft 12 is inserted in a stopper device 24 midway in the head box 1. When the user releases the ball chain 13 after raising the bottom rail 5, the stopper device 24 stops the rotation of the drive shaft 12 to prevent the bottom rail 5 from descending by self-weight.

As shown in FIG. 1, a speed controller 36 is disposed on a side of the stopper device 24. The speed controller 36 controls the rotation speed of the drive shaft 12 so that the rotation speed is a predetermined value or less, without stopping the rotation of the drive shaft 12 and thus controls the speed of the self-weight descent of the bottom rail 5.

The speed controller 36 will be described in detail below. As shown in FIGS. 3A to 3E, the speed controller 36 includes a housing 37, a central shaft 38 inserted in the housing 37, a moving member 39 contained in the housing 37. The central shaft 38 is unrotatably coupled to the drive shaft 12. Note that the drive shaft 12 itself may be inserted into the housing 37 by causing it to penetrate through the central shaft. By forming the central shaft 38 so that the portion thereof through which the drive shaft 12 penetrates has a square cross-section, it can be unrotatably coupled to the drive shaft 12. The housing 37 is unrotatably fixed to the head box 1 directly or indirectly.

A clearance 41 is formed between the inner surface 37*a* of the housing 37 and the moving member 39. A containing space 40 in the housing 37 is filled with oil. At least part of the central shaft 38 in the housing 37 is in the form of a screw shaft, and the screw shaft is immersed in oil. The moving member 39 is screwed to the central shaft 38, as well as engaged with the housing 37 so as to be slidable and unrotatable relative to the housing 37 . FIG. 3C shows one example. In this example, the inner circumference of a cross-section of the inner surface 37*a* is a circle, the outer circumferential of a cross-section of the moving member 39 is a circle spaced from the inner surface 37*a* by the clearance 41, and a protrusion 39*v* or recess on the moving member 39 is engaged with a groove 37*c* or protrusion along the length direction of the central shaft 38 in the inner surface of the housing 37. In this case, the moving member 39 and housing 37 are only required to be relatively movable and relatively unrotatable in the axial direction. FIGS. 3D and 3E show examples in which the moving member 39 and housing 37 are oval or polygonal cross-sections. In these cases, a protrusion or recess is not required. In other words, the moving member 39 and housing 37 only have to have contacts having different distances from the center point. Due to such a configuration, the moving member 39 slides by rotation of the central shaft 38. Specifically, by rotation of the central shaft 38 in the direction of the arrow B in FIG. 3A, the moving member 39 moves the in the direction of an arrow X. During the movement of the moving member 39, the oil in the containing space 40 moves from the front (the traveling direction) of the moving member 39 through the clearance 41 to the rear thereof. Resistance received by the oil at this time is distribution resistance. As the clearance 41 is narrower or as the viscosity of the oil is higher, the distribution resistance of the oil is increased. As the distribution resistance of the oil is higher, the moving member 39 receives higher resistance force from the oil. Accordingly, a greater braking force is applied to the central shaft 38. Thus, if the inner surface 37*a* is tapered, the braking force is reduced as the moving member 39 moves farther from the smallest clearance portion and the number of revolutions of the central shaft is increased, as shown in FIG. 4C. Also, by changing the size of the clearance 41 or the viscosity of the oil as necessary, the braking force applied to the central shaft 38 by the speed controller 36 can be easily controlled.

In a state in which the screen 4 is folded up, almost the entire weight of the screen 4 and bottom rail 5 is supported by the lift cords 7. Accordingly, a high load is applied to the lift cords 7. Since the screen 4 is suspended from and supported by the head box 1, the load applied to the lift cords 7 is reduced as the bottom rail 5 is lowered and the screen 4 is extended. The height position of the bottom rail 5 from the upper limit becomes lower as the number of revolutions of the shaft is increased. The relationship between the height position of the bottom rail 5 and the load applied to the lift cords 7 is shown in FIG. 4A. The bottom rail 5 attempts to descend at higher speed when it is located in a position in which a higher load is applied to the lift cords 7. For this reason, the speed controller 36 is configured so that the braking force is greater when the bottom rail 5 is located in a higher position, as shown in FIG. 4B. Thus, when lowering the bottom rail 5 from a high position, the bottom rail 5 is prevented from descending at excessive speed. In other words, in the shielding device, the braking force is changed so that it is maximized when the bottom rail 5 is located in the upper limit position and it is minimized when the bottom rail 5 is located in the lower limit position. To realize such characteristics, the inner surface 37*a* of the housing 37 of the speed controller 36 is tapered, as shown in FIGS. 3A and 3B, and the distribution resistance of the oil is gradually reduced as the moving member 39 moves in the direction of the arrow X and the clearance 41 is gradually increased. Due to this configuration, the height position of the bottom rail 5 and the braking force generated by the speed controller 36 have a relationship shown in FIG. 4B. Thus, the bottom rail 5 can be prevented from descending at excessive speed. Also, the braking force generated by the speed controller 36 can be significantly reduced immediately before the decent of the bottom rail 5 is complete. Thus, there does not occur a problem that the bottom rail 5 is not lowered to the lower limit position. That is, the lift cords can be unwound until the bottom rail 5 is lowered to the lower limit position without stopping immediately before the decent thereof is complete. This can be realized by determining the allowable minimum braking force which allows the lift cords to be unwound without the bottom rail 5 stopping until reaching the lower limit position although receiving the slide resistance of the entire rotating portion, using a wide clearance 41 and viscosity and then determining a narrow clearance 41 on these conditions so that the descent speed of the blind becomes a predetermined speed or less in a high position near the upper limit of the height of the blind. By using this blind configuration, the oil viscosity and the clearance 41 can be properly determined with respect to a shielding member having any weight or specific gravity or a shielding member having any width/height ratio. Thus, the bottom rail 5 can be lowered to the lower limit position without stopping immediately before the descent thereof is complete. While the inclination direction of the graph of FIG. 4B must be the same as that of the graph of FIG. 4A, the inclination angle of the graph of FIG. 4B may be the same as or different from the graph of FIG. 4A as long as there is obtained an allowable braking force which allows the list cords to be unwound without the bottom rail 5 stopping until reaching the lower limit position although receiving the slide resistance of the entire rotating portion, regardless of from what height position the bottom rail 5 starts to descend by self-weight. Also, the relationship between the height position of the bottom rail 5 and the braking force generated by the speed controller 36 need not be a liner relationship as shown in FIG. 4B and may be a relationship represented by a curve or line graph. The relationship between the height position and the braking force can be easily changed by changing the shape of the inner surface of the housing 37.

The operation of this pleated screen will be described below. When the user pulls the room-side portion of the ball chain 13 in the direction of an arrow A in FIG. 2, a rotational force generated by this force is transmitted to the transmission clutch 21 through the operation pulley 11. The transmission clutch 21 is configured to transmit only a rotational force in the direction of the arrow A in FIG. 1 to the drive shaft 12. Accordingly the rotational force generated by pulling the ball chain 13 in the direction of the arrow A in FIG. 2 is transmitted to the drive shaft 12, which then rotates. Due to the rotation of the drive shaft 12, the winding shafts 10, which are rotatably supported by support members 8 in the head box 1, rotate in the direction of the arrow A in FIG. 1. The lift cords 7 are wound helically, and the bottom rail 5 mounted on the ends of the lift cords 7 are raised.

If the user releases the ball chain 13 in this state, the stopper device 24 is activated, preventing the self-weight descent of the bottom rail 5. If the user again pulls the ball chain 13 in the direction of the arrow A in FIG. 2 in this state and then releases it, the stopper device 24 cancels the self-weight descent prevention operation. Thus, the lift cords 7 are unwound from the winding shafts 10, so that the bottom rail 5 descends by self-weight. As used in the present embodiment, the term "self-weight descent" corresponds to "automatic movement" in Claims.

The moving member 39 is located in a position shown in FIG. 3A at the start of the descent of the bottom rail 5, and the clearance 41 is narrow. Accordingly, the oil has high distribution resistance. As a result, the speed controller 36 generates a great braking force, preventing the bottom rail 5 from descending at excessive speed.

As the bottom rail 5 descends, the moving member 39 moves in the direction of the arrow X in FIG. 3A. Thus, the clearance 41 is gradually increased, resulting in gradual reductions in the distribution resistance of the oil and the braking force generated by the speed controller 36. Immediately before the descent of the bottom rail 5 is complete, the speed controller 36 becomes a state shown in FIG. 3B.

When the user again pulls the ball chain 13 in the direction of the arrow A in FIG. 2 in the state shown in FIG. 3B, the bottom rail 5 is raised, and the moving member 39 is moved in the direction of an arrow Y in FIG. 3B. When the bottom rail 5 reaches the upper limit position, the moving member 39 moves to the position shown in FIG. 3A.

While the case where the moving member 39 moves from the approximately the left edge of the containing space 40 of the housing 37 to the approximately right edge thereof has been described above, the moving member 39 need not reach the approximately left edge or approximately right edge of the containing space 40. If a speed controller 36 is shared by multiple pleated screens including lift cords 7 having different lengths, it is preferred to align the positions of moving members 39 when bottom rails 5 are located in the lower limit positions. The reason is that it is important to appropriately define the braking forces immediately before descents of bottom rails 5 are complete.

The present invention may be carried out in the following aspects.

The present invention can be applied not only to pleated screens but also to sunlight-shielding devicees having reverse characteristics where a sunlight-shielding material descends by self-weight (e.g., horizontal blinds, roll-up curtains). A "sunlight-shielding device having reverse characteristics" refers to a window covering in which the torques applied to the winding shafts are reduced as the lift cords are unwound. The torques applied to the winding shafts by the self-weight of the shielding material serve as drive torques for rotationally driving the winding shafts. In a horizontal blind, slats stacked on a bottom rail are loaded onto ladder cords one by one during a self-weight descent, and the torques applied to winding shafts are reduced accordingly. The relationship between the number of revolutions of each winding shaft and the torque applied to the winding shaft by the self-weight of the shielding material is represented by a graph shown in FIG. 40A. In this case, it is preferred to determine the allowable minimum braking force which allows the list cords to be unwound without the bottom rail 5 stopping until the lowest slat is loaded onto the ladder cords and the vertical strings of the ladder cords between the bottom rail and lowest slat are extended, using a wide clearance 41 and viscosity, to determine a narrow clearance 41 on these conditions so that the descent speed of the blind becomes a predetermined speed or less in a high position near the upper limit of the height of the blind, and to taper the inner surface of the housing 37 in such a manner that a braking force-winding shaft revolution number graph has an inclination approximate to that of a torque-winding shaft revolution number graph, as shown in FIG. 40B.

In a Roman shade, rings (pleats) stacked on a cord catch leave one by one during a self-weight descent, and the torques applied to winding shafts are reduced. The relationship between the number of revolutions of each winding shaft and the torque applied to the winding shaft by the self-weight of a shielding member is represented by a graph shown in FIG. 41A. As in a horizontal blind, it is preferred to taper the inner surface of the housing 37 in such a manner that a braking force-winding shaft revolution number graph has a an inclination approximate to that of a torque-winding shaft revolution number graph, as shown in FIG. 41B.

For a horizontal blind, the term "the bottom rail is located in the lower limit position" means a state in which the lift cords are unwound and thus the bottom rail is lowered; the tensile forces of the lift cords are rapidly reduced; and the bottom rail is supported by the vertical strings of the ladder cords (the vertical strings of the ladder cords between the bottom rail and the lowest slat are extended). For a Roman shade, the term "the bottom rail is located in the lower limit position" means a state in which the list cords are unwound and thus the bottom rail is lowered; and the entire load of the screen is supported by the head box. For a pleated screen, the term "the bottom rail is located in the lower limit position" means a state in which the list cords are unwound and the bottom rail is lowered; and the entire load of the screen is supported by the head box or by the head box and pitch cords in a shared manner, or a limit state in which before reaching the above states, the unwinding of the list cords is mechanically stopped by the winding part using a lower-limit device or the like and the bottom rail can be no longer lowered. If the lower-limit device is a device that also serves as an obstacle stopper and locks when detecting a mechanical slack of a list cord, the lower limit position is determined approximately at the same timing as any of the above states. On the other hand, for a blind including a lower-limit device such as a screw feed mechanism, the user can freely determine the lower limit position. In this case, the minimum braking force is determined on the basis of the lower limit position freely determined by the user.

The present invention can also be used when controlling a blind including an automatic winding mechanism using stored energy of a spring or the like so that the blind is prevented from being wound at excessive speed. In this case, alignment is made so that a proper braking force is generated for each of the positions in which there is a difference (torque gap) between the energizing force of the spring or the like and the blind load. The torque gap serves as a drive torque for rotationally driving the winding shaft. Typically, a sunlight-shielding device having normal characteristics (as the shielding member is unwound, the torque applied to the winding shaft by the self-weight of the shielding member is increased), such as a roller screen, has a structure in which power is generated by the spring motor of a torsion coil spring. As the number of torsion revolutions of the spring motor is increased by the unwinding rotation of the winding shaft, the torque generated by the spring motor is increased as shown by Ts in FIG. 42A. On the other hand, as the shielding member moves toward the lower limit position, the torque applied to the winding shaft by the self-weight of the shielding member is increased as shown by Tw in FIG. 42A. As seen above, the torque generated by the spring motor and the torque applied to the winding shaft by the self-weight of the shielding member have approximate inclination directions. In a typical structure, a torque gap is made by making the torque generated by the spring motor greater than the screen load acting on the winding shaft, and automatic winding is performed on the basis of the torque gap. A damper is disposed so that the speed is not increased excessively. If the present invention is applied to a shielding device using an automatic winding mechanism that uses the stored energy of a spring or the like, it is preferred to set a braking force in accordance with the inclination of the torque gap. In other words, it is preferred to match the increase/reduction trend of the braking force to the increase/reduction trend of the torque gap, which varies among the open/close positions during automatic operation in the shielding device. For a roller screen, as the screen descends, the torque gap TG is changed in such a manner that a large gap is changed to a small gap, which is then changed to a large gap, as shown in FIG. 42A. For this reason, it is preferred to change the cross-sectional area of the inner surface 37*a* of the housing 37 in such a manner that small 1 is changed to large 2, which is then changed small 3 in accordance with such changes, as shown in FIG. 42C and thus to make the braking force approximate to the torque gap TG, as shown in FIG. 42B. In other words, it is preferred to increase or decrease the braking force in accordance with the increase/reduction trend of the torque gap, which varies among the open/close positions during automatic operation in the shielding device. Of course, the braking force may be made approximate to the torque gap by non-linearly changing the cross-section area of the inner surface of the housing.

Among shielding devices having reverse characteristics, such as horizontal blinds, pleated screens, and Roman shades, there are ones where the shielding member ascends automatically. One example of such a shielding device is Japanese Unexamined Patent Application Publication No. 2000-130052. The present invention can also be applied to such an apparatus so that the shielding member is not wound at excessive speed. For example, assume that a tapered shape is determined on the basis of the torque gap TG (the difference between the torque Ts generated by the spring motor and the torque Tw applied to the winding shaft by the self-weight of the shielding member) shown in FIG. 43A. In this case, as shown in FIG. 43C, it is preferred to determine the allowance minimum braking force which allows the list cords to be wound using energizing means without the bottom rail stopping even if the bottom rail starts to ascend in a small-TG position in which the torque gap TG is minimized, using a wide clearance 41-1 and viscosity, to set a medium clearance 41-2 in a high position near the upper limit position of the shielding member (a position in which the torque gap is medium) on these conditions, to set a minimum clearance 41-3 in a position in which the torque gap is maximized (near the lower limit position in this load converter), and to determine a tapered shape so that the inclination of the braking force is made approximate to the inclination of the torque gap, as shown in FIG. 43B.

If the present invention is applied to a shielding device such as a horizontally pulling vertical blind, curtain rail, or panel screen or an shielding device that causes a partition to perform automation (automatic closing or opening) in one of the open and close directions using the stored energy of a spring, weight, or the like, it is preferred to make the inclination of the damper torque approximate to the inclination of the torque gap.

While, in the above embodiment, the central shaft 38 is rotated with the drive shaft 12, the central shaft 38 may be fixed to the head box 1 and the housing 37 may be rotated with the drive shaft 12. Also, the rotation of the drive shaft 12 may be transmitted in such a manner that the central shaft 38 and housing 37 rotate in opposite directions.

In the above embodiment, the moving member 39 is screwed to the central shaft 38, as well as slidably engaged with the housing 37. Alternatively, the moving member 39 may be screwed to the housing 37, as well as slidably engaged with the central shaft 38. In this case, the distribution resistance of the oil may be changed, for example, by changing the thickness of the central shaft 38 along the moving direction of the moving member 39 to change the size of the clearance between the moving member 39 and central shaft 38.

While, in the above embodiment, oil is used as a viscous fluid, a viscous fluid other than oil may be used.

<Second Embodiment>

Referring now to FIGS. 5A and 5B, a second embodiment of the present invention will be described. While the present embodiment is similar to the first embodiment, it differs in that it has a one way function (a function of not generating or significantly reducing a damper torque in rotation in the non-speed-controlled direction). Specifically, the pleated screen of the present embodiment mainly differs in that a moving member 39 includes an internal distribution path 43 and a valve member 44. The present embodiment will be described below while focusing on the difference.

As shown in FIGS. 5A and 5B, the moving member 39 includes the internal distribution path 43 penetrating through the moving member 39 and the valve member 44 that is able to open and close the internal distribution path 43. During a self-weight descent of a bottom rail 5, the moving member 39 moves in the direction of an arrow X. During this period, the valve member 44 is pressed by oil and moves to a position in which the internal distribution path 43 is closed, as shown in FIG. 5A. In this state, the oil can move from the front to the rear of the moving member 39 only through the clearance 41. Since the oil receives high distribution resistance, the speed controller 36 generates a large braking force.

On the other hand, during an ascent operation of the bottom rail 5, the moving member 39 moves in the direction of an arrow Y, and the valve member 44 is pressed by the oil and moves to a position in which the internal distribution path 43 is opened, as shown in FIG. 5B. In this state, the oil can move from the front to the rear of the moving member 39 through both the clearance 41 and internal distribution path 43. Since the oil receives low distribution resistance, the speed controller 36 generates a large braking force.

As seen above, in the present embodiment, the cross-sectional area of the distribution path of the moving member 39 through which the oil can pass in the moving direction of the moving member 39 is substantially changed using the valve member 44. Thus, the braking force of the speed controller 36 can be changed. According to this configuration, the braking force properly acts in a simple configuration during a self-weight descent of the bottom rail 5. Thus, the descent speed of the bottom rail 5 is controlled so as not to be increased excessively. Also, the braking force is reduced in the non-speed-controlled direction (during an ascent operation of the bottom rail 5). Thus, an increase in the operating force is suppressed during an ascent operation of the bottom rail 5. If the present invention is applied to a blind using an automatic winding mechanism that uses stored energy of a spring or the like, the valve is opened in the non-speed-controlled direction (during a descent-direction operation). If the present invention is applied to a horizontally-pulling window covering or an automatic closing device using stored energy of a partition, the valve is opened by rotation in the non-speed-controlled direction (the opening direction). If the present invention is applied to an automatic opening device, the valve is opened by rotation in the non-speed-controlled direction (the closing direction).

<Third Embodiment>

Referring now to FIGS. 6A to 6D, a third embodiment of the present invention will be described. While the present invention is similar to the first embodiment, it mainly differs in that the inner surface 37*a* of a housing 37 is not tapered and that with the movement of a moving member 39, the distribution resistance of oil can be changed using another means. The present embodiment will be described below while focusing on the difference.

In an example configuration 1 of the present embodiment, the inner surface 37*a* of the housing 37 is provided with many grooves 45 extending along the moving direction of a moving member 39, as shown in FIG. 6B. Oil in a containing space 40 moves from the front to the rear of the moving member 39 through the grooves 45. As shown in FIG. 6B, the number of grooves 45 around the moving member 39 is increased as the moving member 39 moves in the direction of an arrow X. Thus, the cross-sectional area of the distribution path of the oil is increased stepwise, and the distribution resistance of the oil is reduced. As a result, the braking force is reduced stepwise as the moving member 39 moves in the direction of the arrow X. In this case, the height-load inclination of the blind is preferably matched to the movement amount-braking force inclination of the moving member. By matching the increase pitch of each stage to the stepwise reduction of the shielding member, the inclination of the braking force can be further made approximate to changes in the torque resulting from the descent of the shielding member. While, in this example configuration, the number of grooves 45 is changed, the width or depth of grooves may be changed with the movement of the moving member 39. That is, it is only necessary to increase the cross-sectional area of the grooves around the moving member 39 with the movement of the moving member 39.

In an example configuration 2 of the present embodiment, the inner surface 37*a* of a housing 37 is provided with many recesses 46, as shown in FIG. 6C. Oil in a containing space 40 moves from the front to the rear of the moving member 39 through the recesses 46. As shown in FIG. 6C, the number of recesses 46 around the moving member 39 is increased as the moving member 39 moves in the direction of the arrow X. Thus, the cross-sectional area of the distribution path of the oil is increased, and the distribution resistance of the oil is reduced. While, in this example configuration, the number of recesses 46 is changed, the size or depth of recesses may be changed with the movement of the moving member 39. That is, it is only necessary to increase the cross-sectional area of the recesses around the moving member 39 with the movement of the moving member 39.

In an example configuration 3 of the present embodiment, the elastic modulus of the inner surface 37*a* of a housing 37 is changed along the moving direction of a moving member 39, as shown in FIG. 6D. When the moving member 39 is not moving, there is no substantial clearance between the housing 37 and moving member 39, or the size of the clearance between the housing 37 and moving member 39 is not substantially changed along the moving direction of the moving member 39. On the other hand, when the moving member 39 moves in the direction of the arrow X, oil elastically deforms the inner surface 37*a* of the housing 37 to form a distribution path and moves from the front to the rear of the moving member. Then, in this example configuration, the elastic modulus of the inner surface 37*a* is reduced as the moving member 39 moves. Thus, the distribution path becomes more likely to be formed, and the distribution resistance of the oil is reduced.

As seen above, although the inner surfaces 37*a* of the housings 37 of the example configurations 1 to 3 are not tapered but rather have simple configurations, the distribution resistance of the oil can be changed with the movement of the moving member 39. Also, the distribution path can be reliably opened or closed without the bottom rail stopping in the position in which the self-weight is minimized or the position in which the torque gap is minimized.

<Fourth Embodiment>

Referring now to FIG. 7, a fourth embodiment of the present invention will be described. While the present embodiment is similar to the first embodiment, it mainly differs in that the distribution resistance of oil is changed using tapered fixed shafts 49. The present embodiment will be described below while focusing on the difference.

In the present embodiment, the difference between the inner circumferences of a moving member 39 and the housing 37 is constant in the axial direction; there is no clearance or only a slight clearance therebetween; the moving member 39 are provided with penetration holes 50; and the tapered fixed shafts 49 is inserted in the penetration holes 50. Since the cross-sectional area of a penetration hole 50 is greater than that of a tapered fixed shaft 49, clearances 51 are formed between the moving members 39 and tapered fixed shafts 49. When the moving member 39 moves, oil moves from the front to the rear of the moving member 39 through the clearances 51. As the moving member 39 moves in the direction of an arrow X, the clearances 51 are enlarged, and the distribution resistance of the oil is reduced.

While, in the first to third embodiments, the distribution path of the oil is provided between the housing 37 and moving member 39, in the present embodiment, the clearances 51 between the moving member 39 and tapered fixed shafts 49 serve as main distribution paths of the oil. By changing the size of the clearances 51 with the movement of the moving member 39, the distribution resistance of the oil is changed, and a braking force is generated such that the bottom rail does not stop in the position in which the self-weight is minimized or the position in which the torque gap is minimized. Thus, the distribution path can be reliably opened and closed.

<Fifth Embodiment>

Referring now to FIGS. 8A to 8G, a fifth embodiment of the present invention will be described. While the present embodiment is similar to the first embodiment, it mainly differs in that the distribution resistance of oil is changed using a moving member 39. The present embodiment will be described below while focusing on the difference.

In the present embodiment, a moving member 39 includes a main body 39*a* having a penetration hole 39*d* and the movable plate 39*b* that is able to open and close the penetration hole 39*d*, as shown in FIG. 8. The movable plate 39*b* has a protrusion 39*c*, and the protrusion 39*c* is engaged with a groove 53 formed in the inner surface 37*a* of a housing 37. In this example, the groove 53 is formed in the inner surface 37*a* of the housing 37 so as to have a skew angle with respect to the axial direction, as shown in a development of FIG. 8B. The main body 39*a* is provided with a female screw 39*f* and a groove 39*e*. The female screw 39*f* is screwed to a male screw 38*a* formed on a central shaft 38. A protruding stripe 52 formed on the inner surface 37*a* of the housing 37 is engaged with the groove 39*e*, and the moving member 39 is relatively unrotatably contained in the housing 37. According to this configuration, by relative rotation between the housing 37 and central shaft 38, the moving member 39 slides along the axial direction of the central shaft 38.

In the present embodiment, when the moving member moves, oil in a containing space 40 moves from the containing space in the traveling direction of the moving member to the containing space in the departure direction thereof through the penetration hole 39*d* of the main body 39*a*. When the moving member is located in a position P, the penetration hole 39*d* is completely closed, as shown in FIG. 8G. Accordingly, the oil receives higher distribution resistance, and a speed controller 36 generates a larger braking force. As the moving member 39 moves in the direction of an arrow X, the protrusion 39*c* moves along the groove 53, so that the movable plate 39*b* rotationally moves. With the rotational movement of the movable plate 39*b*, the penetration hole 39*d* gradually opens, as shown in FIG. 8E to 8F, and the distribution resistance of the oil is reduced. The braking force is changed, as shown in FIG. 8H. By minimizing the self-weight of the moving member in a position R in which the penetration hole 39*d* is maximized or a position slightly preceding the position R and generating a braking force such that the open/close body does not stop midway, a shielding member can be reliably opened and closed. Also, by controlling the speed of a self-weight descent near the position P so that the speed is a predetermined speed or less, it is possible to reliably open and close the shielding member, as well as to perform speed control at the start of a self-weight descent.

<Sixth Embodiment>

Referring now to FIGS. 9A to 9E, a sixth embodiment of the present invention will be described. While the present embodiment is similar to the first embodiment, it mainly differs in that the distribution resistance of oil is changed using a movable protruding member 39*k*. The present embodiment will be described below while focusing on the difference.

In the present embodiment, a moving member 39 includes a main body 39*a* having a penetration hole 39*h* and the movable protruding member 39*k* that is able to open and close the penetration hole 39*h*, as shown in FIG. 9. The movable protruding member 39*k* has a penetration hole 39*j*. The front end 39*g* of the movable protruding member 39*k* protrudes from the main body 39*a* by energizing the movable protruding member 39*k* using an energizing member (e.g., a coil spring) 39*i*, as shown in FIG. 9D. The inner surface 37*a* of the housing 37 is provided with a groove 54 whose depth varies along the moving direction of the moving member 39. The front end 39*g* of the movable protruding member 39*k* is in contact with the upper edge of the groove 54 with the moving member 39 contained in a containing space 40.

In the present embodiment, as the moving member moves, oil in the containing space 40 moves from the containing space in the traveling direction of the moving member to the containing space in the departure direction thereof through the penetration hole 39*h* of the main body 39*a*. When the moving member is located in a position P, the front end 39*g* of the movable protruding member 39*k* is pressed by the inner surface 37*a* of the housing 37 and therefore is placed in a state shown in FIG. 9E. In this state, the position of the penetration hole 39*h* of the main body 39*a* and the position of the penetration hole 39*j* of the movable protruding member 39*k* are not matched. Accordingly, the penetration hole 39*h* is completely closed. For this reason, the oil receives higher distribution resistance, and a speed controller 36 generates has a larger braking force. As the moving member 39 moves in the direction of an arrow X, the front end 39*g* moves along the groove 54. As the groove 54 becomes deeper, the front end 39*g* protrudes, as shown in a position Q. Further, the front end 39*g* protrudes in a larger amount in a position R, as shown in FIG. 9D. This results in an increase in the overlap between the penetration hole 39*h* and penetration hole 39*j*, a reduction in the distribution resistance of the oil, and a reduction in the braking force. According to this configuration, it is possible to reduce the braking force near the position R to reliably open and close the shielding member, as well as to reduce the speed of a self-weight descent near the position P to a predetermined speed or less.

<Seventh Embodiment>

Referring now to FIGS. 10A and 10B, a seventh embodiment of the present invention will be described. While the present embodiment is similar to the first embodiment, it mainly differs in that the distribution resistance of oil is changed using a magnetic force. The present embodiment will be described below while focusing on the difference.

In the present embodiment, the outer circumference of a moving member 39 is provided with magnets 57, as shown in FIG. 10. Also, parts in the length direction of a braking force one step increased region P of the outer circumference of the housing 37 are provided with magnetic bodies 55 such as steel plates. According to this configuration, when the moving member 39 moves to the region P, the attraction between the magnets 57 and magnetic bodies 55 contracts the housing 37 and thus narrows the clearance 41 between the moving member 39 and housing 37. Also, when the magnets 57 move in the conductors 55, an eddy current occurs in the conductors 55 so as to attempt to prevent a change in the magnetic field, and a braking force acts on the magnets in the direction in which the movement of the magnets is obstructed. In the present embodiment, the oil moves from the front to the rear of the moving member 39 through the clearance 41. For this reason, by changing the size of the clearance 41 by the magnetic force in a simple configuration with the movement of the moving member 39, the distribution resistance of the oil can be changed. Also, as the moving speed of the magnets is increased, the braking force is increased by the eddy current in the conductors 55. Note that the moving member 39 may be provided with magnetic bodies, and the housing 37 may be provided with magnets. Also, both the moving member 39 and housing 37 may be provided with magnets. Any of attraction and repulsion may be caused to act between the magnets of the moving member 39 and the magnets of the housing 37. To cause attraction to act therebetween, the magnets of the housing 37 are disposed on the outer circumference of the housing 37. To cause repulsion to act between the magnets of the moving member 39 and the magnets of the housing 37, the magnets of the housing 37 are disposed in the inner surface of the housing 37. In this case, the housing 37 is expanded by the repulsion. Thus, the clearance 41 between the moving member 39 and housing 37 is widened, resulting in a reduction in the distribution resistance of the oil.

<Eighth Embodiment>

Referring now to FIGS. 11A to 11F, an eighth embodiment of the present invention will be described. While the present embodiment is similar to the fifth embodiment, it mainly differs in that the resistance that a moving member 39 receives from oil is changed using a oil distribution path 37*d* provided in a housing 37. The present embodiment will be described below while focusing on the difference.

In the present embodiment, the moving member 39 is contained in the housing 37 so as to be relatively movable in the axial direction and relatively unrotatable. The moving member 39 has a central shaft 38 screwed to the center thereof and moves in the axial direction by rotation of the central shaft 38. If the present embodiment is applied to a window covering having reverse characteristics, such as a horizontal blind, the moving member 39 is configured to, when the central shaft 38 rotates on the basis of the descent-direction rotation of the drive shaft 12, move in the direction of an arrow X in FIG. 11A. The right edge of the housing 37 is provided with an oil distribution path 37*d*. The oil distribution path 37*d* has a first opening 37*e* and a second opening 37*f* that are spaced in the moving direction of the moving member 39.

When a bottom rail 5 is located in a position remote from the lower limit position, the moving member 39 is located on the left side of the second opening 37*f*, as shown in FIG. 11A. For this reason, the oil distribution path 37*d* does not work, and the moving member 39 receives high resistance from the oil.

When the bottom rail 5 descends by self-weight and then reaches the vicinity of the lower limit position, the moving member 39 passes through a position S in FIG. 11C and then reaches a position T. In this state, the moving member 39 is located between the first opening 37*e* and second opening 37*f*. When the moving member 39 moves from the position T toward a position U, the oil present in the traveling direction of the moving member 39 enters the oil distribution path 37*d* through the first opening 37*e* and moves to the rear of the moving member through the second opening 37*f*. For this reason, the moving member 39 receives low resistance from the oil. On the other hand, when the bottom rail 5 ascends, the oil reversely flows from the traveling direction to the departure direction of the moving member by passing through 37*f*, 37*d*, and 37*e* with the movement of the moving member.

According to the present embodiment, the resistance the moving member 39 receives from the oil is sharply reduced on the above principle while the moving member 39 moves from the position S to the position T. The low resistance continues until the moving member 39 reaches the position U. For this reason, by making a setting so that the moving member 39 reaches the position S when the bottom rail 5 reaches the vicinity of the lower limit position, it is possible to reduce the braking force near the lower limit position of the bottom rail 5 so that the bottom rail 5 reliably reaches the lower limit position.

<Ninth Embodiment>

Referring now to FIG. 12, a ninth embodiment of the present invention will be described. While the present embodiment is similar to the first embodiment, it mainly differs in that a moving member 39 is fixed to a central shaft 38. The present embodiment will be described below while focusing on the difference.

In the present embodiment, the moving member 39 is fixed to the central shaft 38, as shown in FIG. 12. The central shaft 38 rotates with a drive shaft 12 of the shielding device, and the rotational resistance gives a braking force serving as a reaction force to the drive shaft 12. For example, by inserting a square shaft having a square cross-section into a square hole formed in the central shaft and having approximately the same shape as the external shape of the square shaft, the square shaft and central shaft are relatively unrotatably and relatively movably engaged with each other. The housing is fixed to a head box so as to be relatively unmovable in the axial direction and relatively unrotatable. The central shaft 38 is screwed to a base 59 fixed to the head box 1. The central shaft 38 rotates relative to the base 59 and at the same time moves in the axial direction. At this time, the drive shaft 12 and central shaft 38 move relative to each other. Due to the axial movement of the rotating central shaft 38, the moving member 39 rotates and at the same time moves in the axial direction in the containing space 40 of the housing 37. There is a slight clearance between the inner surface 37*a* and the outer circumference of the moving member 39. With the axial movement of the moving member, the oil moves from the containing space in the traveling direction of the moving member toward the containing space in the departure direction thereof through the clearance. Since the inner surface 37*a* of the housing 37 is tapered as shown in FIG. 12, the clearance is narrowed as the moving member approaches the right end of FIG. 12. The distribution resistance of the oil changes with the movement of the moving member 39. A blind is assembled in such a manner that the right edge serves as an upper part and the left edge serves as a lower part. Thus, the braking force is reduced with increases in the number of unwinding revolutions so that the braking force approximates the load characteristics of the blind. The blind is unwound without stopping near the lower limit position.

While, in the present embodiment, the central shaft 38 does not penetrate through the housing 37, it may be configured to penetrate through the housing 37.

<Tenth Embodiment>

Referring now to FIGS. 13A and 13B, a tenth embodiment of the present invention will be described. While the present embodiment is similar to the ninth embodiment, it differs in that it has a one way function (a function of not generating or significantly reducing a damper torque in rotation in the non-speed-controlled direction). The present embodiment will be described below while focusing on the difference.

In the present embodiment, a moving member 39 includes a main body 39*a* and a movable ring 39*l*, as shown in FIG. 13. The main body 39*a* is fixed to a central shaft 38 using a fixing pin 39*t*. The front end of the central shaft 38 is inserted in a shaft hole 39*r* of the movable ring 39*l*. The movable ring 39*l* is rotatably supported by the main body 39*a* by stacking the main body 39*a* and movable ring 39*l* in such a manner that an engaging protrusion 39*n* provided on the main body 39*a* and protruding in the axial direction is fitted between engaging protrusions 39*o*, 39*p* provided on the movable ring 39*l* and protruding in the radial direction and mounting fixing rings 39*s* on the front and rear thereof. During an ascent operation of a bottom rail 5, the central shaft 38 rotates in the direction of an arrow A. The main body 39*a* and movable ring 39*l* rotate integrally with the engaging protrusion 39*n* of the main body 39*a* in contact with the engaging protrusion 39*o* of the movable ring 39*l*. In this state, a penetration hole 39*m* of the main body 39*a* and a penetration hole 39*q* of the movable ring 39*l* overlap each other so that the oil can be distributed through these penetration holes. Accordingly, the oil receives low distribution resistance. For this reason, the operating force required to raise the bottom rail 5 is small. On the other hand, the central shaft 38 rotates in the direction of an arrow B during a self-weight descent of the bottom rail 5. The main body 39*a* and movable ring 39*l* rotate integrally with the engaging protrusion 39*n* of the main body 39*a* in contact with the engaging protrusion 39*p* of the movable ring 39*l*. In this state, the penetration hole 39*m* of the main body 39*a* and the penetration hole 39*q* of the movable ring 39*l* do not overlap each other and therefore the oil receives high distribution resistance. For this reason, a proper braking force occurs during the self-weight descent of the bottom rail 5. The valve is opened by rotation in the non-speed-controlled direction (the ascent direction). In a window covering, where automatic ascend is performed by an energizing force, the valve is opened by rotation in the non-speed-controlled direction (the descent direction). If the present embodiment is applied to a horizontally pulling window covering or an automatic close device using stored energy of a partition, the valve is opened by rotation in the non-speed-controlled direction (the opening direction). If the present embodiment is applied to an automatic opening device, the valve is opened by rotation in the non-speed-controlled direction (in the closing direction).

<Eleventh Embodiment>

Referring now to FIGS. 14A and 14B, an eleventh embodiment of the present invention will be described. While the present embodiment is similar to the fifth embodiment, it mainly differs in that a groove 53 has a different shape. The present embodiment will be described below while focusing on the difference.

In the fifth embodiment, the groove 53 is linear in a development shown in FIG. 8B. Thus, the penetration hole 39*d* of the main body 39*a* is gradually closed with the movement of the moving member 39, and the distribution resistance of the oil is gradually changed. In the present embodiment, on the other hand, the groove 53 is in parallel with the moving direction of a moving member 39 in a range from a position S to a position T, as shown in FIG. 14A. For this reason, a penetration hole 39*d* is kept closed until the moving member 39 moves from the position S to the position T, as shown in FIG. 8G. As a result, a speed controller 36 generates a large braking force as shown in FIG. 14B. The groove 53 has a large inclination angle in a range from the position T to a position U. For this reason, the penetration hole 39*d* is opened and placed in a state shown in FIG. 8E while the moving member 39 travels this range. Thus, the braking force generated by the speed controller 36 is reduced. While the moving member 39 moves from the position U to a position V, the weak braking force is maintained. As seen above, a region from the position T to the position V is a weak braking region R. According to this configuration, by making a setting so that the moving member 39 reaches the region R when the bottom rail 5 reaches the vicinity of the lower limit position, it is possible to reduce the braking force in the vicinity of the lower limit position of the bottom rail 5 to cause the bottom rail 5 to reliably reach the lower limit position. As seen above, in the self-weight descending sun-shielding device of the present embodiment, the braking force is reduced in a range corresponding to predetermined multiple revolutions from the lower limit position.

<Twelfth Embodiment>

Referring now to FIGS. 15A and 15B, a twelfth embodiment of the present invention will be described. While the present embodiment is similar to the eighth embodiment, it mainly differs in that the resistance a moving member 39 receives from oil is changed by changing the moving speed of the moving member 39 with the movement of the moving member 39. The present embodiment will be described below while focusing on the difference.

In the present embodiment, the moving member 39 that can move with a descent of the bottom rail 5 is disposed in a housing 37 filled with oil, and a braking force is obtained from the resistance of the oil moving through the clearance between the outer circumference of the moving member 39 and the inner surface 37*a* of the housing 37. The feed angle of a central shaft 38 having a groove 38*b* is changed in the moving range of the moving member 39. By changing the moving distance of the moving member 39 per unit rotation, the moving speed of the moving member 39 during a self-weight descent of the bottom rail 5 is changed. The braking force is changed in accordance with the position of the bottom rail 5. The braking force is increased when the bottom rail 5 is located near the upper limit position; the braking force is reduced when the bottom rail 5 is located near the lower limit position. Further, when the bottom rail 5 descends to the vicinity of the lower limit position and enters a region where the difference is reduced between a downward force based on the self-weight of the bottom rail 5 and a screen 4 and an upward force based on the spring properties of the screen 4 itself, the braking force is sufficiently reduced in this region so that the bottom rail 5 reaches the lower limit position.

The configuration of the present embodiment will be described more concretely. The moving member 39 is contained in the housing 37 so as to be relatively movable in the axial direction and relatively unrotatable. The central shaft 38 has the helical groove 38*b*. The pitch of the helix of the groove 38*b* becomes narrower as the right side of FIG. 15A is approached. The moving member 39 includes an engaging protrusion 39*u* that is engaged with the groove 39*b*.

When the central shaft 38 rotates on the basis of the downward rotation of a drive shaft 12, the helical groove 38*b* rotates together. Thus, the engaging protrusion 39*u* moves along the groove 39*u*, and the moving member 39 moves in the direction of an arrow X. The moving distance of the moving member 39 per unit rotation of the drive shaft 12 depends on the pitch of the helix of the groove 39*u*. In a high-speed moving region having a relatively large pitch, the moving member 39 moves fast and receives high resistance from the oil. As the moving member 39 moves, the pitch of the helix of the groove 39*u* becomes narrower. Thus, the moving distance of the moving member 39 per unit rotation of the drive shaft 12 (or a winding shaft 10) is reduced, and the moving member 39 receives lower resistance from the oil accordingly. For this reason, when the moving member 39 moves sequentially to the high-speed moving region, a medium-speed moving region, and a low-speed moving region with increases in the number of descending revolutions, the resistance received by the moving member 39 is also changed sequentially to high resistance, medium resistance, and low resistance. The braking force is sufficiently reduced in the vicinity of the lower limit position of the bottom rail 5 and thus the bottom rail 5 reliably reaches the lower limit position. While, in the present embodiment, the pitch of the helix of the groove 39*u* is changed in three steps, it may be changed in more steps or changed non-stepwise, that is, continuously.

<Thirteenth Embodiment>

Referring now to FIGS. 16A to 16G, a thirteenth embodiment of the present invention will be described. While the present embodiment is similar to the eighth embodiment, it mainly differs in that the rotation of a drive shaft 12 is transmitted to a central shaft 38 through a switch member 62. The present embodiment will be described below while focusing on the difference.

In the present embodiment, the central shaft 38 has an opening 38*d* having a circular cross-section, as shown in FIG. 16B, and the drive shaft 12 can idle in the opening 38*d*. The switch member 62 is disposed adjacent to one end of the central shaft 38. The switch member 62 is configured to be unrotatable relative to the drive shaft 12 and be movable relative thereto in the axial direction thereof. Engaging parts 38*c*, 62*a* are disposed on ends of the central shaft 38 and switch member 62, respectively, so as to face each other and be engageable with each other. As shown in FIGS. 16A and 16F, the engaging part 62*a* is configured in such a manner that recesses and protrusions are circumferentially alternately formed. The engaging part 38*c* has a shape complementary to that of the engaging part 62*a*. As shown in FIG. 17, when the engaging parts 38*c*, 62*a* are engaged with each other by causing the switch member 62 to slide in the direction in which it approaches the central shaft 38, the drive shaft 12 and central shaft 38 are coupled together so as to be rotatable integrally. On the other hand, when the engaging parts 38*c*, 62*a* are disengaged from each other by causing the switch member 62 to slide in the direction in which it moves away from the central shaft 38, the drive shaft 12 and central shaft 38 is decoupled from each other so that the central shaft 38 idles relative to the drive shaft 12.

According to this configuration, by rotating the central shaft 38 in a decoupled state even after inserting the drive shaft 12 into the central shaft 38, the moving member 39 can be moved to a desired position without rotating the drive shaft 12. In other words, the stroke end position of the moving member 39 can be adjusted in an assembled state. According to this configuration, the position of the moving member 39 can be adjusted after a speed controller 36 is assembled into a head box 1, resulting in improvements in assemblability.

While an upward force based on the spring properties of the screen 4 itself is acting on the bottom rail 5, the upward force may be weakened with a lapse of time. As a result, the descent speed of the bottom rail 5 may be increased compared to when the use of the shielding device is started. In the present embodiment, the central shaft 38 in a decoupled state is rotated. Thus, as shown in FIG. 17, the position of the moving member 39 when the bottom rail 5 is located in the lower limit position and the position of the moving member 39 when the bottom rail 5 is located in the upper limit position can be changed from L1 to L2 and from U1 to U2, respectively. By changing the position of the moving member 39 in this manner, the timing at which the moving member 39 reaches a second opening 37 during a descent of the bottom rail 5 is delayed, and the timing at which the braking force applied to the drive shaft 12 is reduced is delayed accordingly. Thus, the descent speed of the bottom rail 5 can be reduced.

In other words, a speed controller 36 of the present embodiment is configured to switch between a link state in which the rotation of winding shafts 10 and the movement of the moving member 39 are linked and a non-link state in which the rotation of the winding shafts 10 and the movement of the moving member 39 are not linked. In the non-link state, the moving member 39 can be moved independently of the rotation of the winding shafts 10. As with the present embodiment, other embodiments can also produce similar effects by allowing for the switching between the link state and non-link state. For example, the present embodiment can be applied to the eighth embodiment by allowing the drive shaft 12 to be inserted into and extracted from the central shaft 38.

<Fourteenth Embodiment>

Referring now to FIGS. 18 and 19, a fourteenth embodiment of the present invention will be described. While the basic configuration of the present embodiment is similar to that of the thirteenth embodiment, it mainly differs in that braking force increase means that increases the braking force applied to winding shafts 10 when a moving member 39 is located in a brake force increase range, which is a part of the movable range of the moving member 39, is disposed in a housing 37. In the present embodiment, the braking force increase means is configured to, when the moving member 39 is located in the braking force increase range, form a piston structure with the moving member 39.

The present embodiment will be described below while focusing on the difference.

In the present embodiment, a central shaft 38 is provided with a flange 72, and the moving member 39 has, on the side thereof opposite to the flange 72, a recess 39*w* that contains the flange 72 to form a piston structure. While the moving member 39 can be moved relative to the housing 37 in the axial direction by rotation of the central shaft 38, the flange 72 is disposed so as to be fixed to the central shaft 38. The flange 72 and moving member 39 can be moved relatively. According to this configuration, when the moving member 39 moves by rotation of the winding shafts 10 while the left edge of the moving member 39 is located in the braking force increase range shown in FIG. 18A, the distribution of oil between the outer circumferential surface of the moving member 39 and the inner surface 37*a* of the housing 37 causes resistance, and the distribution of the oil between the outer circumferential surface of the flange 72 and the inner surface of the recess 39*w* of the moving member 39 also causes resistance. Thus, the braking force applied to the winding shafts 10 is increased. As seen above, the flange 72 and recess 39*w* of the present embodiment form "braking force increase means" in Claims. On the other hand, as shown in FIG. 19A, when the moving member 39 departs from the braking force increase range, the piston structure formed by the flange 72 and recess 39*w* is dissolved, and the braking force applied to the winding shafts 10 is reduced accordingly. FIG. 19B shows the relationship between the number of revolutions of the winding shafts 10 when using, as a reference, a state where the moving member 39 is located at the left edge of the movable range in the housing 37 as shown in FIG. 18A, and the braking force applied to the winding shafts 10.

In a shielding device where a shielding member descends by self-weight, when a shielding member is located near the upper limit position, a high torque is applied to winding shafts 10, and the descent speed of the shielding member is more likely to be increased excessively. On the other hand, in a shielding device where a shielding member is automatically raised by a spring or the like, such as a roller screen, when a shielding member is wound so as to reach the vicinity of the upper limit position, the ascent speed thereof is more likely to be increased excessively. In these cases, by configuring these shielding devicees so that when the shielding member is located near the upper limit position, the moving member 39 is located in the braking force increase range, the braking torque (braking force) can be increased in the range in which the descent speed of the shielding member is more likely to be increased.

The speed controller 36 of the present embodiment is provided with a control dial 71. By operating the control dial 71 with the switch member 62 and central shaft 38 decoupled from each other, the central shaft 38 can be rotated without rotating the drive shaft 12 and thus the moving member 39 can be moved to any position. According to this configuration, the initial position of the moving member 39 can be easily controlled. For example, assume that the descent time of a shielding member (the time taken for the shielding member to move from the upper limit position to the lower limit position) is long in a self-weight descending shielding device. In this case, by moving the initial position of the moving member 39 in the right direction of FIG. 18A, it is possible to advance the timing when the moving member 39 departs from the braking force increase range to reduce the descent time of the shielding member. Conversely, assume that the descent speed of the shielding member is slow. In this case, by moving the initial position of the moving member 39 in the left direction of FIG. 18A, it is possible to delay the timing when the moving member 39 departs from the braking force increase range to reduce the descent speed of the shielding member. According to this configuration, the speed (descent time) can be easily controlled. Note that if the speed controller 36 of the present embodiment is applied to a roller screen, the ascent time can be easily controlled.

The present embodiment may be carried out in the following modes.

As shown in a modification 1 of FIG. 20, (1) the braking force may be gradually reduced or increased over the whole length by increasing the inner circumferential diameter of a housing 37 toward an end; and (2) the braking force can be gradually reduced or increased in the braking force increase range by forming a moving member 39 so as to increase the inner circumference diameter of a recess 39*w* of the moving member 39 toward the base end. By combining (1) and (2), the braking force may be gradually reduced or increased from the braking force increase range over the whole length.

As shown in a modification 2 of FIG. 21, instead of forming a flange 72 on a central shaft 38, a tubular member 77 may be disposed in a housing 37 so that the tubular member 77 and a recess 39*w* form a piston structure. This modification also can produce effects similar to those of the embodiments. The tubular member 77 may be fixed to a central shaft 38 or may be fixed to the housing 37. That is, the tubular member 77 may be disposed on any member as long as it is disposed so as to be movable relative to a moving member 39. Also, as shown in a modification 3 of FIG. 22, instead of forming a recess 39*w* on a moving member 39, a protrusion 39*ab* may be formed thereon, and the protrusion 39*ab* may be inserted into a small diameter part 37*j* of a housing 37 in the braking force increase range to form a piston structure. This modification also can produce effects similar to those of the embodiments. Also, instead of forming a piston structure using a protrusion 39*ab* and a housing 37, another member may be disposed in a housing 37 so that a piston structure is formed using the other member and a protrusion 39*ab*.

A member for forming a piston structure with a moving member 39 may be any type of member as long as it is a member that moves relative to the moving member 39 when the moving member 39 moves by rotation of winding shafts 10 (a member that does not move or a member that moves at a different speed or in a different direction from that of the moving member 39).

<Fifteenth Embodiment>

Referring now to FIGS. 23 and 24, a fifteenth embodiment of the present invention will be described. As in the fourteenth embodiment, a speed controller 36 of the present embodiment includes braking force increase means that increases the braking force applied to winding shafts 10 in the braking force increase range. However, the braking force increase means of the present embodiment consists of a rotational resistance body 74 that when a moving member 39 is located in the braking force increase range, increases the braking force applied to the winding shafts 10 by rotating by rotation of the winding shafts 10. Details will be described below.

In the present embodiment, a drive shaft 12 that rotates integrally with the winding shafts 10 is inserted in a central shaft 38 that is rotatably supported by a housing 37. The central shaft 38 rotates integrally with the drive shaft 12. A containing space 40 in the housing 37 is divided into first and second containing spaces 40*a*, 40*b* by a partition 37*h*. The partition 37*h* is provided with a hole 37*i* so that oil can move between the first and second containing spaces 40*a*, 40*b*. The hole 37*i* is provided with a female screw 37*g*.

The moving member 39 includes a flange 39*y* and a screw shaft 39*x*. The screw shaft 39*x* is screwed to the female screw 37*g*. The moving member 39 is configured to rotate by rotation of the central shaft 38. According to this configuration, the moving member 39 rotates by rotation of the central shaft 38 and at the same time moves in the axial direction of the central shaft 38.

The rotational resistance body 74 supported so as to be rotatable around the drive shaft 12 is disposed in the housing 37. The rotation of the drive shaft 12 and central shaft 38 is not directly transmitted to the rotational resistance body 74. The rotational resistance body 74 includes a base 74*a*, a screw 74*b* disposed so as to expand radially from the base 74*a*, and a protrusion 74*c* that protrudes from the base 74*a* in the direction of the moving member 39. The moving member 39 includes a protrusion 39*z* that protrudes toward the rotational resistance body 74. Only when the right end of the protrusion 39*z* is located in the braking force increase range shown in FIG. 23A, the protrusions 74*c*, 39*z* are engaged with each other and thus the rotation of the protrusion 39*z* is transmitted to the rotational resistance body 74. Note that the front ends of the protrusions 74*c*, 39*z* are provided with a tapered surface 39*zl* that allows the rotational resistance body to escape in the rotation direction when the front ends contact each other (the tapered surface of the front end of the protrusion 74*c* is not shown).

The operation of the speed controller 36 of the present embodiment will be described below.

First, in a state shown in FIGS. 23A to 23D, the protrusions 74*c*, 39*z* are engaged with each other. For this reason, the moving member 39 and rotational resistance body 74 rotate integrally by rotation of the central shaft 38 and at the same time only the moving member 39 moves in the direction of an arrow X in FIG. 23A. この状態では, ﾌﾗﾝｼﾞ 39*y* の外周面とﾊｳｼﾞﾝｸﾞ 37 の内面 37*a* の間のｵｲﾙ流通による抵抗力. In this state, the distribution of oil between the outer circumference surface of the flange 39*y* and the inner surface of the inner surface 37*a* of the housing 37 causes resistance, and the rotation of the screw 74*b* also causes resistance. Thus, the braking force applied to the winding shafts 10 is increased.

When the right end of the protrusion 39*z* departs from the braking force increase range shown in FIG. 23A with the movement of the moving member 39, the resistance caused by the rotation of the rotational resistance body 74 is no longer applied to the winding shafts 10. Thus, the braking force applied to the winding shafts 10 is reduced.

The inner circumferential diameter of the housing 37 is increased from a position shown by a position Y in FIG. 24 in the direction of an arrow X. For this reason, after the moving member 39 reaches the position Y, the braking force applied to the winding shafts 10 is gradually reduced as the moving member 39 travels in the direction of the arrow X.

The present embodiment may be carried out in the following modes.

As shown in a modification 1 of FIG. 25, in place of the screw 74*b*, a rotational resistance body 74 may include (e.g., two) impellers 74*d* that rotate in oil and receive resistance in the rotating direction.

<Sixteenth Embodiment>

Referring now to FIGS. 26 and 27, a sixteenth embodiment of the present invention will be described. While the basic configuration of the present embodiment is similar to that of the fifteenth embodiment, it mainly differs in that thrust providing means that rotates and moves with a moving member 39 by rotation of winding shafts 10 and provides thrust to the moving member 39 is disposed in a housing 37. In the present embodiment, the thrust providing means is a screw disposed on the moving member 39.

The present embodiment will be described below while focusing on the difference.

In the present embodiment, the moving member 39 is provided with the screw 39*aa*, as shown in FIGS. 26A to 26D. When the moving member 39 rotates and moves by rotation of the central shaft 38, the screw 39*aa* rotates and moves. Thrust resulting from the rotation of the screw 39*aa* smoothes the movement of the moving member 39 and thus reduces the braking force applied to the winding shafts 10.

In a shielding device where a shielding member descends by self-weight, the drive torque is reduced as the shielding member approaches the lower limit position. For this reason, when the shielding member is located near the lower limit position, the braking force generated by the speed controller 36 becomes greater than the drive torque. This may cause a problem that the shielding member stops midway without descending to the lower limit position. To solve this problem, it is preferred to reduce the braking force generated by the speed controller 36 as the shielding member approaches the lower limit position. However, the speed controller 36 of a type in which the moving member 39 is moved in the oil, as seen in the present embodiment, always generates a certain level of braking force due to the viscosity of the oil. That is, the speed controller 36 has a limitation to reducing the braking force. To reduce the braking force, it is preferred to enlarge the clearance 41 between the moving member 39 and housing 37. However, if the clearance 41 is enlarged to a certain level, the resulting clearance has less influence on the reduction of the braking force even if it is further enlarged. According to the present embodiment, the moving member 39 moves smoothly by thrust resulting from the rotation of the screw 39*aa*. Thus, the braking force generated by the speed controller 36 is reduced compared to when the screw 39*aa* is not provided.

The operation of the speed controller 36 of the present embodiment will be described below.

First, in a state shown in FIGS. 26A to 26D, the moving member 39 and screw 39*aa* rotate integrally by rotation of the central shaft 38 and at the same time move in the direction of the arrow X in FIG. 26A. In this state, the distribution of the oil between the outer circumference surface of the flange 39*y* and the inner surface of the inner surface 37*a* of the housing 37 causes resistance. However, the moving member 39 relatively smoothly moves by thrust resulting from the rotation of the screw 39*aa*. Thus, the reduced braking force is applied to the winding shafts 10.

The inner circumferential diameter of the housing 37 is increased from a position shown by a position Y in FIG. 27 in the direction of the arrow X. For this reason, after the moving member 39 reaches the position Y, the braking force applied to the winding shafts 10 is gradually further reduced as the moving member 39 travels in the direction of the arrow X.

The present embodiment may be carried out in the following modes.

As shown in a modification 1 of FIG. 28, a housing 37 may be provided with a small diameter part 37 as thrust increase means that increases thrust in the thrust increase range, which is a part of the movable range of a moving member 39. Thus, when a screw 39*aa* reaches the thrust increase range, thrust resulting from the rotation of the screw 39*aa* is increased, and the braking force is further reduced.

<Seventeenth Embodiment>

Referring now to FIGS. 29A to 29D, a seventeenth embodiment of the present invention will be described. While the basic configuration of the present embodiment is similar to those of the first and eighth embodiments, it mainly differs in that it includes an internal pressure limiter that when the torque applied to winding shafts 10 exceeds a predetermined threshold, is activated and reduces the internal pressure of a housing 37. The present embodiment will be described below while focusing on the difference.

As shown in FIG. 29A, when the drive shaft 12 rotates in the direction of an arrow B by rotation of the winding shafts 10, a moving member 39 moves in the direction of an arrow X. With the movement of the moving member 39, the internal pressure (the pressure applied by oil) in a containing space 40*a* in the traveling direction of the moving member 39 becomes higher than the internal pressure in a containing space 40*b* on the rear side of the moving member 39. Due to this pressure difference, the oil is distributed from the containing space 40*a* to the containing space 40*b* through a clearance 41. The internal pressure in the containing space 40*a* is increased as the torque applied to the winding shafts 10 is increased. For this reason, when an excessive torque is applied to the winding shafts 10, the internal pressure in the containing space 40*a* is increased excessively, resulting in the breakage of the housing 37. For this reason, the present embodiment is provided with the internal pressure limiter that when the torque applied to the winding shafts 10 exceeds predetermined threshold, is activated and reduces the internal pressure in the housing 37.

The configuration of the moving member 39 including the internal pressure limiter will be described below. As shown in FIGS. 29A to 29D, the moving member 39 of the present embodiment includes first and second moving members 39*ba*, 39*ca*, a one-way spring 39*da*, and a fixing ring 39*ea*. The first moving member 39*ba* includes a base 39*bj* and a tube 39*bc* extending from the base 39*bj* in the axial direction of a central shaft 38. At least one of the base 39*bj* and tube 39*bc* is provided with a female screw 39*bi* screwed to a male screw 38*a* of the central shaft 38. The base 39*bj* is provided with notches 39*bb*, penetration holes 39*bd*1, 39*bd*2, and a protrusion containing part 39*be* containing a regulation protrusion 39*ce* of the second moving member 39*ca*. A pair of flat springs (energizing members) 39*bf*1, 39*bf*2 are disposed in the protrusion containing part 39*be* so as to sandwich the regulation protrusion 39*ce*. The tube 39*bc* is provided with an engaging groove 39*bg* engaged with the fixing ring 39*ea*. Thus, the first moving member 39*ba* and second moving member 39*ca* have a relationship in which they are relatively rotatable and unmovable in the axial direction. The notches 39*bb* are wider than protruding stripes 52 of the housing 37. The first moving member 39*ba* is rotatable relative to the housing 37 with the protruding stripes 52 contained in the notches 39*bb*.

The second moving member 39*ca* includes a base 39*cj* and the regulation protrusion 39*ce* protruding from the base 39*cj* toward the first moving member 39*ba*. The base 39*cj* is provided with grooves 39*cb*, a central opening 39*cc*, and a penetration hole 39*cd*. A base 39*dj* of the one-way spring 39*da* is provided with grooves 39*db*, a central opening 39*dc*, and a penetration hole 39*dd*. The grooves 39*cb* and 39*db* of the second moving member 39*ca* and one-way spring 39*da* have approximately the same width as the protruding stripes 52 of the housing 37. For this reason, with the protruding stripes 52 engaged with the grooves 39*cb*, 39*db*, the second moving member 39*ca* and one-way spring 39*da* are unrotatable relative to the housing 37 and only movable in the axial direction of the central shaft 38.

When the fixing ring 39*ea* is engaged with the engaging groove 39*bg* with the tube 39*bc* inserted in the central openings 39*cc*, 39*dc* of the second moving member 39*ca* and one-way spring 39*da*, the second moving member ca and one-way spring 39*da* are relatively rotatably held by the first moving member 39*ba*. Note that in this state, the regulation protrusion 39*ce* is sandwiched between the pair of flat springs 39*bf*1, 39*bf*2 and thus the relative rotation between the first and second moving members 39*ba*, 39*ca* is regulated. Also, in this state, the penetration hole 39*cd* and penetration hole 39*dd* overlap each other. On the other hand, the penetration holes 39*bd*1, 39*bd*2 are disposed so as not to overlap the penetration holes 39*cd*, 39*dd* (the penetration holes 39*bd*1, 39*bd*2 are closed, since the closed surface of the base 39*bj* of the first moving member 39*ba* is located so as to face the penetration hole 39*dd*). Thus, the axial movement of the oil through the penetration holes is prevented.

The operation of the speed controller 36 of the present embodiment will be described below.

When a torque is applied to the winding shafts 10 in the direction of the arrow B in FIG. 29A (in the descent direction of the shielding member), the torque is transmitted to the first moving member 39*ba* through the drive shaft 12 and central shaft 38. Thus, the torque is applied to the first moving member 39*ba* in the direction of an arrow B in FIG. 29D. The first moving member 39*ba* moves in the direction of the arrow X in FIG. 29A with the flat spring 39*bf*1 elastically deformed in accordance with the magnitude of the applied torque. The first moving member 39*ba* rotates relative to the second moving member 39*ca* by the amount of the deformation of the flat spring 39*bf*1, and the penetration hole 39*bd*1 approaches the penetration hole 39*cd* accordingly. Since the penetration hole 39*dd* is blocked by the closed surface of the base 39*bj* of the first moving member 39*ba* within a allowable torque with respect to the speed controller 36, the oil does not move in the axial direction. As described above, the braking force is gradually reduced by the gradually expanded tapered inner surface 37*a*.

As the torque applied to the winding shafts 10 is increased, the amount of deformation of the flat spring 39*bf*1 is increased. The amount of rotation of the first moving member 39*ba* relative to the second moving member 39*ca* is also increased. If the torque applied to the winding shafts 10 exceeds the predetermined threshold due to an excessive external force, the penetration hole 39*bd*1 overlaps the penetration hole 39*cd* and therefore is opened. Thus, the oil is allowed to move through the penetration holes 39*bd*2, 39*cd*, 39*dd*, and the internal pressure in the containing space 40 is reduced, and the occurrence of an excessive pressure is prevented.

Then, when the torque applied to the winding shafts 10 is reduced, the shape of the flat spring 39*bf*1 is elastically restored. This results in a reduction in the amount of deformation of the flat spring 39*bf*1 and a reduction in the amount of rotation of the first moving member 39*ba* relative to the second moving member 39*ca*. Thus, the penetration hole 39*bd*1 is automatically prevented from overlapping the penetration hole 39*cd* (is closed), and the movement of the oil through the penetration holes is blocked.

On the other hand, when a torque is applied to the winding shafts 10 in a direction opposite to the direction of the arrow B FIG. 29A (in the ascent direction of the shielding member), the torque is transmitted to the first moving member 39*ba* through the drive shaft 12 and central shaft 38. Thus, the torque is applied to the first moving member 39*ba* in a direction opposite to the direction of the arrow B in FIG. 29D. The first moving member 39*ba* moves in a direction opposite to the direction of the arrow X in FIG. 29A with the flat spring 39*bf*1 elastically deformed in accordance with the magnitude of the applied torque. The first moving member 39*ba* rotates relative to the second moving member 39*ca* by the amount of the deformation of the flat spring 39*bf*2, and the penetration hole 39*bd*2 approaches the penetration hole 39*cd* accordingly. If the torque applied to the winding shafts 10 exceeds the predetermined threshold, the penetration hole 39*bd*2 overlaps the penetration hole 39*cd*. Thus, the oil is allowed to move through the penetration holes 39*bd*2, 39*cd*, 39*dd*, and the internal pressure in the containing space 40 is reduced. As seen above, in the present embodiment, regardless of the rotating direction of the torque applied to the winding shafts 10, when the torque exceeds the predetermined threshold, the internal pressure in the housing 37 is reduced, and the occurrence of an excessive pressure is prevented.

The outer diameter of the one-way spring 39*da* is slightly larger than that of the second moving member 39*ca*. When the moving member 39 moves in the direction of the arrow X in FIG. 29A, the size of the clearance 41 is determined by the difference between the outer diameter of the one-way spring 39*da* and the inner diameter of the housing 37. On the other hand, when the moving member 39 moves in the direction opposite to the direction of the arrow X, the one-way spring 39*da* shrinks and thus the clearance 41 expands. As a result, the resistance the moving member 39 receives from the oil is reduced.

The present embodiment may be carried out in the following modes.

Examples of a phenomenon in which an excessive torque is applied to the winding shafts 10 include forceful pull-down of the shielding member by the user and being caught on the shielding member by the user. If such a phenomenon occurs, an excessive torque is applied to the winding shafts 10 in the descent direction of the shielding member. On the other hand, a phenomenon in which an excessive torque is applied to the winding shafts 10 in the ascent direction of the shielding member is less likely to occur. For this reason, there may be used a configuration in which the flat spring 39*bf*2 and penetration hole 39*bd*2 are omitted; and when a torque exceeding the predetermined threshold is applied to the winding shafts 10 in the descent direction of the shielding member, the internal pressure limiter is activated. In this case, the regulation protrusion 39*ce* is sandwiched between the flat spring 39*bf*1 and the sidewall of the protrusion containing part 39*be*.

There may be used configurations other than those described above as long as the moving member moving in the direction in which a brake torque occurs can be opened and is opened with an excessive torque.

<Eighteenth Embodiment>

Referring now to FIGS. 30A and 30B, a eighteenth embodiment of the present invention will be described. The present embodiment is similar to the seventeenth embodiment in that it includes an internal pressure limiter. However, the present embodiment mainly differs from the seventeenth embodiment in that while the internal pressure limiter of the seventeenth embodiment is activated when the torque applied to the winding shafts 10 exceeds the predetermined threshold, the internal pressure limiter of the present embodiment is activated when the internal pressure in a housing 37 exceeds a predetermined threshold. The present embodiment will be described below while focusing on the difference.

In the present embodiment, the housing 37 has a first opening 37*l* and a second opening 37*n* spaced in the moving direction of a moving member 39 in the housing 37 (preferably, disposed on both edges of the movable range of the moving member 39). The first and second openings 37*l*, 37*n* are coupled through an oil distribution path 37*m*. The first opening 37*l* is provided with a valve 37*o*. The valve 37*o* is energized toward the first opening 37*l* by a coil spring (energizing member) 37*p* contained in an energizing member containing part 39*q*. The energizing member containing part 39*q* is closed by a screw 37*r*, and one end of the coil spring 37*p* is supported by the screw 37*r*.

The operation of a speed controller 36 of the present embodiment will be described below.

When an allowed torque is applied to winding shafts 10 in the direction of an arrow B in FIG. 30A (the descent direction of a shielding member), the torque is transmitted to a moving member 39 through a drive shaft 12 and a central shaft 38. The moving member 39 moves in the direction of an arrow X. The distribution resistance of oil in the clearance between the outer circumference of the moving member and the inner circumference of the housing generates a braking force, which then causes the shielding device to operate at a controlled speed. At this time, the internal pressure in a containing space 40*a* in the traveling direction of the moving member 39 is increased. If a force in the direction of the arrow X applied to the valve 37*o* by the increased internal pressure exceeds an energizing force applied to the valve 37*o* by the coil spring 37*p*, the valve 37*o* moves in the direction of the arrow X. However, the valve is not opened if the torque is the allowable torque or less. If a torque equal to or greater than the allowable torque is applied to the central shaft 38 of the speed controller 36 by an external force or the like during a descent of the shielding member, the internal pressure in the containing space 40*a* exceeds the predetermined threshold, and the valve 37*o* moves to the position in which the first opening 37*l* is opened. Thus, the oil is allowed to move through the first opening 37*l*, oil distribution path 37*m*, and second opening 37*n;* the internal pressure in the containing space 40 is reduced; and the occurrence of an excessive pressure is prevented. When the excessive pressure is eliminated, the valve 37*o* is automatically closed by the energizing force of the coil spring 37*p*, and the state in which an braking force can be generated in the allowable torque range is restored.

The internal pressure limiter that is activated on the basis of an increase in the internal pressure in the containing space 40*a* may be disposed on the moving member 39. Also, there may be disposed an internal pressure limiter that is activated on the basis of an increase in the internal pressure in the containing space 40*b* when the moving member 39 moves in a direction opposite to the direction of the arrow X.

There may be used configurations other than those described above as long as the configurations include an open/close structure that when an excessive torque is applied to the brake, allows oil to flow from a pressure-increased containing part to a pressure-reduced containing part.

<Nineteenth Embodiment>

Referring now to FIGS. 31 to 33, a nineteenth embodiment of the present invention will be described. While the present embodiment is similar to the fifth embodiment, it mainly differs in that a central shaft 38 is provided with a part 38*e* that does not have a male screw 38*a* (a non-screw part). The present embodiment will be described below while focusing on the difference.

In the present embodiment, as shown in FIG. 31, approximately the entire central shaft 38 except for a portion close to the left edge of a containing space 40 is provided with a male screw 38*a*, and the non-screw part 38*e* is disposed at the left edge of the containing space 40. When a bottom rail 5 is located in a high position, a moving member 39 is screwed to the male screw 38*a*. When the central shaft 38 rotates with a self-weight descent of the bottom rail 5, the moving member 5 moves in the direction of an arrow X. As in the first embodiment, the inner surface 37*a* of a housing 37 is tapered. Thus, the resistance the central shaft 38 receives from oil with a self-weight descent of the bottom rail 5 is reduced.

When the moving member 39 reaches the non-screw part 38*e*, the screwing between the moving member 39 and male screw 38*a* is released. Even if the central shaft 38 is further rotated in the descent direction of the bottom rail 5 in this state, the moving member 39 does not move.

The moving member 39 is energized toward the male screw 38*a* by an energizing member (e.g., a coil spring) 58. Accordingly, when the central shaft 38 is rotated in the upward direction of the bottom rail 5, the moving member 39 is again screwed to the male screw 38*a*. As the bottom rail 5 descends, the moving member 39 moves toward the right edge of the containing space 40.

The speed controller 36 of the present embodiment is characterized in that it is easily assembled into a head box 1. Referring now to FIGS. 32 and 33, a method for assembling the speed controller 36 into the head box 1 will be described.

First, as shown in FIG. 32A, the speed controller 36 is mounted in the head box 1 with the bottom rail 5 raised to the upper limit position. The moving member 39 is previously disposed on the non-screw part 38*e*.

Then, as shown in FIG. 32B, the bottom rail 5 is lowered to the lower limit position. At this time, the drive shaft 12 and central shaft 38 rotate in the descent direction by rotation of the winding shafts 10. Since the moving member 39 is already disposed on the non-screw part 38*e*, the moving member 39 does not move even when the central shaft 38 rotates.

When the drive shaft 12 is rotated in the ascent direction of the bottom rail 5 in a state shown in FIG. 32B, the central shaft 38 is also rotated in the same direction. The moving member 39 is energized by the energizing member 58. Accordingly, when the central shaft 38 is rotated in the upward direction of the bottom rail 5, the moving member 39 is immediately screwed to the male screw 38*a*. As the bottom rail 5 ascends, the moving member 39 moves in the direction of an arrow Y in FIG. 33. When the bottom rail 5 is lowered again, the moving member 39 moves in the direction of the arrow X in FIG. 31. When the bottom rail 5 reaches the lower limit position, the moving member 39 reaches the non-screw part 38*e*.

As seen above, by providing the non-screw part 38*e*, even if the speed controller 36 is mounted in the head box 1 in the upper limit position of the bottom rail 5, the position of the moving member 39 when the bottom rail 5 is located in the lower limit position can be set accurately. Note that the speed controller 36 may be mounted in the head box 1 when the bottom rail 5 is located in a position other than the upper limit position. The moving member 39 only has to reach the non-screw part 38*e* by the time when the bottom rail 5 reaches the lower limit position. For this reason, when mounting the speed controller 36 in the head box 1, it need not be previously disposed on the non-screw part 38*e*. Specifically, the following configuration may be used: when mounting the speed controller 36 in the head box 1, the moving member 39 is previously disposed on the male screw 38*a;* the moving member 39 moves toward the non-screw part 38*e* with a descent of the bottom rail 5; and the moving member 39 reaches the non-screw part 38*e* by the time when the bottom rail 5 reaches the lower limit position. Even in this case, the position of the moving member 39 when the bottom rail 5 is located in the lower limit position can be set accurately.

In other words, in the present embodiment, the speed controller 36 has a non-movement region (non-screw part) in which even if the winding shafts 10 rotates the in the descent direction of the bottom rail 5, the moving member 39 does not move and is configured so that when the winding shafts 10 rotate in the descent direction of the bottom rail 5 with the moving member 39 located in the non-movement region, the moving member 39 moves by rotation of the winding shafts 10. By configuring the speed controller 36 in this manner, there is obtained an effect of accurately setting the position of the moving member 39 when the bottom rail 5 is located in the lower limit position.

<Twentieth Embodiment>

Referring now to FIGS. 34 to 38, a twentieth embodiment of the present invention will be described. In the present embodiment, a speed controller 36 is used in order to control the ascending speed when causing the screen of a roller screen to automatically ascend. Details will be describe below.

In a roller screen shown in FIG. 34, support brackets 62*a*, 62*b* are mounted on both ends of a mounting frame 61 mounted on the upper frame or the like of a window through fittings, and a winding shaft 63 is rotatably supported between the support brackets 62*a*, 62*b*.

A screen 64 is suspended from the winding shaft 63, and a weight bar 64*a* is mounted on the lower edge of the screen 64. An operation cord 64*b* is suspended from the weight bar 64*a*. The screen 64 is raised and lowered on the basis of the rotation of the winding shaft 63.

The winding shaft 63 includes an energizing device 80 that provides the winding shaft 63 with a rotational force in the pull-up direction of the screen 64, the speed controller 36 that controls the rotation speed of the winding shaft based on the rotational force to a predetermined speed, and a clutch device 70 that maintains the screen 64 in a desired pull-down position against the rotational force provided by the energizing device 80.

The configuration of the energizing device 80 will be described concretely. As shown in FIG. 35, a wind plug 65 unrotatably supported by the support bracket 62*a* is disposed on one side in the winding shaft 63, and one end of a torsion coil spring 66 is fixed to the wind plug 65.

The wind plug 65 has one end of the a guide pipe 67 fixed to the central portion thereof, and the guide pipe 67 is inserted in the torsion coil spring 66. A pipe stopper 68 is fitted and fixed to the other end of the guide pipe 67. A drive plug 69 fitted to the inner circumferential surface of the winding shaft 63 is rotatably supported by the pipe stopper 68. The other end of the torsion coil spring 66 is fixed to the drive plug 69.

When the winding shaft 63 is rotated in the descent direction of the screen 64, the drive plug 69 is rotated integrally with the winding shaft 63 and thus the torsion coil spring 66 stores energy. When the winding shaft 63 is rotated in the pull-up direction of the screen by the energizing force of the torsion coil spring 66, the energy of the torsion coil spring 66 is lost.

As shown in FIG. 36, the clutch device 70 is disposed on the other side in the winding shaft 63. When the user operates the operation cord 64*b* to pull up the screen 64 to a desired position and then releases the operation cord 64*b*, the clutch device 70 maintains the screen 64 in the desired position against the energizing force of the torsion coil spring 66. When the user operates the operation cord 64*b* in this state to slightly pull down the screen 64, the clutch device 70 is deactivated, and the screen 64 is pulled up on the basis of the energizing force of the torsion coil spring 66.

The speed controller 36 is disposed adjacent to the clutch device 70 in the winding shaft 63. The speed controller 36 includes a housing 37 and a central axis 38 inserted in the housing 37. The housing 37 is fixed to a winding pipe. The housing 37 is rotated integrally with the winding shaft 63. An end of the central axis 38 is fixed to a fixed shaft. For example, as shown in FIG. 36, the end of the central axis 38 may be fitted to a drum 76 of the clutch device 70. The drum 76 is a fixed shaft, since it is unrotatably supported by the support bracket 62*b*. The central shaft 38 is unrotatably supported by the support bracket 62*b*.

When the number of torsion revolutions of the spring motor is increased with the unwinding rotation of the winding shaft 63, the torque generated by the energizing device 80 is increased as shown by Ts in FIG. 37A. On the other hand, the torque applied to the winding shaft 63 by the self-weight of the screen 64 is increased as the screen 64 moves toward the lower limit position, as shown by Tw in FIG. 37A. When the screen 64 approaches the upper limit position, the torque gap TG, which is the difference between Ts and Tw, is increased. Thus, the weight bar 64*a* disposed on the lower edge of the screen 64 is more likely to vigorously collide with the mounting frame 61 and make noise. For this reason, in the roller screen of the present embodiment, the speed controller 36 is configured to increase the braking force when the weight bar 64*a* is pulled up to near the upper limit position to reach a braking force one step increase region P, as shown in FIG. 37B. As seen above, in the present embodiment, the braking force is increased or reduced in multiple steps in accordance with the increase/reduction trend of the torque gap that varies among open/close positions during automatic operation in the shielding device. Also, in this roller screen, the braking force is increased in a range corresponding to predetermined multiple revolutions from the upper limit position.

Referring now to FIG. 38, the configuration of the speed controller 36 of the present embodiment will be described. While the configuration of the speed controller 36 of the present embodiment is similar to that of the speed controller 36 of the first embodiment, the shape of the inner surface 37*a* of a housing 37 differs from that of the first embodiment. Specifically, in the speed controller 36 of the present embodiment, the inner surface 37*a* is not tapered, and the clearance 41 between the moving member 39 and housing 37 is narrowed at the time point when the weight bar 64*a* reaches the vicinity of the upper limit position. More specifically, when the weight bar 64*a* is located in the lower limit position, the moving member 39 is located near the left edge in a containing space 40, as shown in FIG. 38A. When the winding shaft 63 is rotated by the energizing force of the energizing device 80, the screen 64 is wound around the winding shaft 63 and thus the weight bar 64*a* starts to ascend. At the same time, the housing 37 is rotated, and the moving member 39 moves in the direction of an arrow X. In this state, the clearance 41 between the moving member 39 and housing 37 is large. Thus, oil receives low distribution resistance, and the speed controller 36 generates a small braking force. The winding shaft 63 is further rotated and thus the screen 64 is further wound. Immediately before the ascent of the weight bar 64*a* is complete, the moving member 39 reaches a braking force one step increase region P consisting of a small diameter part 37*b* located near the right edge of the containing space 40. When the moving member 39 reaches the region P, the clearance 41 between the moving member 39 and housing 37 is narrowed. Thus, the distribution resistance of the oil is increased, and the braking force generated by the speed controller 36 is increased.

<Twenty-First Embodiment>

Referring now to FIG. 39, a twenty-first embodiment of the present invention will be described. The present embodiment discloses another configuration for increasing the braking force of a speed controller 36 when a weight bar 64*a* is pulled up to near the upper limit position in a roller screen similar to the twentieth embodiment. Details will be described below.

The speed controller 36 of the present embodiment has a configuration similar to that of the fifth embodiment except that a groove 53 has a different shape. In the fifth embodiment, the groove 53 is linear in the development shown in FIG. 8B. For this reason, as the moving member 39 moves, the penetration hole 39*d* of the main body 39*a* is gradually closed. Thus, the distribution resistance of the oil is gradually changed. In the present embodiment, on the other hand, the groove 53 is in parallel with the moving direction of a moving member 39 in a range from a position S to a position T, as shown in FIG. 39. For this reason, until the moving member 39 moves from the position S to the position T, a penetration hole 39*d* is kept opened, as shown in FIG. 8E. As a result, the speed controller 36 generates a small braking force. Since the groove 53 is inclined at a large angle in a range from the position T to a position U, the penetration hole 39*d* is closed while the moving member 39 travels this range, and becomes a state shown in FIG. 8G. As a result, the braking force generated by the speed controller 36 is increased. A region from the position T to a position V serves as the braking force one step increase region P. For this reason, by configuring the moving member 39 so that when the weight bar 64*a* becomes a state immediately before the ascent thereof is complete, the moving member 39 reaches the position U, the braking force generated by the speed controller 36 can be sharply increased immediately before the ascent of the weight bar 64*a* is complete.

<Other Embodiments>

The configurations disclosed in the first to nineteenth embodiments can also be applied to roller screens without departing from the intent thereof.

REFERENCE SIGNS LIST

1: head box
4: screen
5: bottom rail
7: lift cord
8: support member
10: winding shaft
11: operation pulley
12: drive shaft
13: ball chain
21: transmission clutch
4: stopper device
33: pitch maintenance cord
36: speed controller
37: housing
38: central shaft
39: moving member
40: containing space
41: clearance

The invention claimed is:

1. A shielding device for opening and closing a shielding member by rotation of a winding shaft, the shielding device comprising:

a speed controller configured to control an automatic movement speed of the shielding member, wherein the speed controller comprises a housing containing a viscous fluid; and a moving member contained in the housing and configured to move by rotation of the winding shaft, and the speed controller is configured so that resistance the moving member receives from the viscous fluid varies with movement of the moving member.

2. The shielding device of claim 1, wherein the speed controller is configured so that the moving member is able to repeatedly relatively reciprocate in a predetermined range in the housing, the predetermined range being associated with an open/close range of the shielding member and the resistance the moving member receives from the viscous fluid varies with a position of the moving member in the predetermined range.

3. The shielding device of claim 2, wherein the speed controller is configured so that a position in which a drive torque is minimized in the open/close range of the shielding member becomes a position in which the resistance is minimized in the predetermined range.

4. The shielding device of claim 2, wherein the speed controller is configured so that a position in which a drive torque is maximized in the open/close range of the shielding member becomes a position in which the resistance is maximized in the predetermined range.

5. The shielding device of claim 1, wherein the speed controller is configured so that with movement of the moving member, a cross-sectional area of a distribution path of the moving member through which the viscous fluid can pass varies, the viscous fluid bypasses the distribution path and passes through a larger distribution path, or at least one elastic modulus of a member forming the distribution path varies.

6. The shielding device of claim 1, wherein the speed controller is configured so that distribution resistance of the viscous fluid when the moving member moves in a first direction when causing the shielding member to automatically move becomes larger than distribution resistance of the viscous fluid when the moving member moves in a second direction opposite to the first direction.

7. The shielding device of claim 1, wherein the speed controller is configured so that a moving distance of the moving member per unit rotation of the winding shaft varies with movement of the moving member.

8. The shielding device of claim 1, wherein the speed controller is configured to be capable of switching between a link state in which rotation of the winding shaft and movement of the moving member is linked and a non-link state in which rotation of the winding shaft and movement of the moving member are not linked.

9. The shielding device of claim 1, further comprising a braking force increase means disposed in the housing, the braking force increase means being configured to increase a braking force applied to the winding shaft in a braking force increase range which is a part of movable range of the moving member.

10. The shielding device of claim 9, wherein the braking force increase means is configured to form a piston structure with the moving member when the moving member is located in the braking force increase range.

11. The shielding device of claim 9, wherein the braking force increase means is a rotational resistance body that when the moving member is located in the braking force increase range, increases the braking force by rotating by rotation of the winding shaft.

12. The shielding device of claim 11, wherein the moving member is configured to rotate by rotation of the winding shaft and to move at the same time, and the rotational resistance body is configured to, when the moving member is located in the braking force increase range, become engaged with the moving member and thus to rotate with the moving member.

13. The shielding device of claim 1, further comprising first and second resistance parts each configured to generate the resistance the moving member receives from the viscous fluid in association with the open/close range of the shielding member, wherein at least one of the first and second resistance parts is configured to change resistance received from the viscous fluid in the open/close range of the shielding member.

14. The shielding device of claim 1, wherein the speed controller comprises an internal pressure limiter configured to, when a torque applied to the winding shaft exceeds a predetermined threshold or when an internal pressure in the housing exceeds a predetermined threshold, be activated and to reduce the internal pressure in the housing.

15. The shielding device of claim 1, wherein the speed controller has a non-movement region in which the moving member does not move even if the winding shaft rotates in a descent direction of the shielding member, and when the winding shaft rotates in an ascent direction of the shielding member with the moving member located in the non-movement region, the moving member moves by rotation of the winding shaft.

16. The shielding device of claim 1, wherein the shielding device is configured so that by rotating the winding shaft by self-weight of the shielding member, a lift cord whose one end is mounted on the shielding member is unwound from the winding shaft and thus the shielding member is caused to automatically descend, and the speed controller is configured so that the resistance is reduced with an descent of the shielding member.

17. The shielding device of claim 16, wherein thrust providing means configured to provide the moving member with thrust by rotating and moving with the moving member by rotation of the winding shaft is disposed in the housing.

18. The shielding device of claim 1, wherein the shielding device is configured so that the shielding member is caused to automatically ascend, by rotating the winding shaft by an energizing force of an energizing device and winding the shielding member around the winding shaft, and the speed controller is configured so that the resistance is increased when the shielding member is caused to ascend to near an upper limit position of the shielding member.

* * * * *